US010311991B2

(12) United States Patent
Oishi

(10) Patent No.: US 10,311,991 B2
(45) **Date of Patent: *Jun. 4, 2019**

(54) HIGH-STRENGTH AND HIGH-ELECTRICAL CONDUCTIVITY COPPER ALLOY ROLLED SHEET AND METHOD OF MANUFACTURING THE SAME

(75) Inventor: Keiichiro Oishi, Tokyo (JP)

(73) Assignee: MITSUBISHI SHINDOH CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/144,034

(22) PCT Filed: Dec. 25, 2009

(86) PCT No.: PCT/JP2009/071606

§ 371 (c)(1),
(2), (4) Date: Jul. 11, 2011

(87) PCT Pub. No.: WO2010/079708

PCT Pub. Date: Jul. 15, 2010

(65) Prior Publication Data

US 2011/0265916 A1 Nov. 3, 2011

(30) Foreign Application Priority Data

Jan. 9, 2009 (JP) ..... 2009-003813

(51) Int. Cl.
*C22C 9/02* (2006.01)
*C22C 9/06* (2006.01)
(Continued)

(52) U.S. Cl.
CPC ..... *H01B 1/026* (2013.01); *C22C 9/02* (2013.01); *C22C 9/06* (2013.01); *C22F 1/08* (2013.01)

(58) Field of Classification Search
CPC ..... H01B 1/026; C22C 9/02; C22C 9/06; C22F 1/08
(Continued)

(56) References Cited

U.S. PATENT DOCUMENTS 2,074,713 A * 3/1937 Tross ..... 29/415
4,073,667 A 2/1978 Caron et al.
(Continued)

FOREIGN PATENT DOCUMENTS

CN 1546701 A 11/2004
CN 1693502 A 11/2005
(Continued)

OTHER PUBLICATIONS

JP 2001-316742, Sudo et al., Published Nov. 2001. (machine translation).*
(Continued)

*Primary Examiner* — Keith Walker
*Assistant Examiner* — John A Hevey
(74) *Attorney, Agent, or Firm* — Griffin and Szipl PC

(57) ABSTRACT

A high-strength and high-electrical conductivity copper alloy rolled sheet has an alloy composition containing 0.14 to 0.34 mass % of Co, 0.046 to 0.098 mass % of P, 0.005 to 1.4 mass % of Sn and the balance including Cu and inevitable impurities, wherein [Co] mass % representing a Co content and [P] mass % representing a P content satisfy the relationship of $3.0 \leq ([Co]-0.007)/([P]-0.009) \leq 5.9$. In a metal structure, precipitates are formed, the shape of the precipitates is substantially circular or elliptical, the precipitates have an average grain diameter of 1.5 to 9.0 nm, or 90% or more of all the precipitates have a diameter of 15 nm or less to be fine precipitates, and the precipitates are uniformly dispersed. With the precipitation of the fine precipitates of Co and P and the solid-solution of Sn, the
(Continued)

strength, conductivity and heat resistance are improved and a reduction in costs is realized.

24 Claims, 3 Drawing Sheets

(51) Int. Cl.
*C22F 1/08* (2006.01)
*H01B 1/02* (2006.01)

(58) Field of Classification Search
USPC ..... 148/433; 420/472
See application file for complete search history.

(56) References Cited

U.S. PATENT DOCUMENTS

| | | | | |
|---|---|---|---|---|
| 4,260,432 | A | 4/1981 | Plewes | |
| 4,388,270 | A | 6/1983 | Stavish et al. | |
| 4,427,627 | A | 1/1984 | Guerlet et al. | |
| 4,666,667 | A | 5/1987 | Kamio et al. | |
| 5,004,498 | A | 4/1991 | Shimamura et al. | |
| 5,322,575 | A | 6/1994 | Endo et al. | |
| 5,814,168 | A | 9/1998 | Hatakeyama et al. | |
| 6,132,529 | A | 10/2000 | Hatakeyama et al. | |
| 6,254,702 | B1 * | 7/2001 | Hana | C22C 9/06 148/433 |
| 7,608,157 | B2 | 10/2009 | Oishi | |
| 7,928,541 | B2 | 4/2011 | Miwa et al. | |
| 8,986,471 | B2 * | 3/2015 | Oishi | B21C 1/003 148/433 |
| 9,163,300 | B2 * | 10/2015 | Oishi | C22C 9/02 |
| 9,455,058 | B2 | 9/2016 | Oishi | |
| 9,512,506 | B2 * | 12/2016 | Oishi | C22C 9/02 |
| 2006/0016528 | A1 | 1/2006 | Hatakeyama | |
| 2006/0260721 | A1 | 11/2006 | Oichi | |
| 2007/0051442 | A1 | 3/2007 | Yamamoto et al. | |
| 2007/0221396 | A1 | 9/2007 | Izumida et al. | |
| 2009/0014102 | A1 | 1/2009 | Hatakeyama | |
| 2009/0084473 | A1 | 4/2009 | Aruga et al. | |
| 2010/0008817 | A1 | 1/2010 | Ando | |
| 2010/0047112 | A1 | 2/2010 | Fugono et al. | |
| 2010/0206513 | A1 | 8/2010 | Hattori et al. | |
| 2010/0297464 | A1 | 11/2010 | Oishi | |
| 2011/0056596 | A1 | 3/2011 | Oishi | |
| 2011/0100676 | A1 * | 5/2011 | Oishi et al. | 174/126.1 |
| 2011/0200479 | A1 | 8/2011 | Mihara et al. | |
| 2015/0198391 | A1 * | 7/2015 | Oishi | B21C 1/003 428/544 |
| 2017/0103825 | A1 | 4/2017 | Oishi et al. | |

FOREIGN PATENT DOCUMENTS

| | | | |
|---|---|---|---|
| EP | 1630240 | A1 | 3/2006 |
| JP | 60-245753 | A | 12/1985 |
| JP | 60-245754 | A | 12/1985 |
| JP | 63-65039 | A | 3/1988 |
| JP | 01-108322 | A | 4/1989 |
| JP | 04-272148 | A | 9/1992 |
| JP | 06-094390 | A | 4/1994 |
| JP | 8-120368 | A | 5/1996 |
| JP | 10-130754 | A | 5/1998 |
| JP | 10-168532 | | 6/1998 |
| JP | 11-97609 | A | 4/1999 |
| JP | 11-256255 | | 9/1999 |
| JP | 2001-214226 | A | 8/2001 |
| JP | 2001-316742 | | 11/2001 |
| JP | 2003-268467 | | 9/2003 |
| JP | 2004-137551 | | 5/2004 |
| JP | 2004-292917 | A | 10/2004 |
| JP | 2007-031795 | A | 2/2007 |
| JP | 2007-100111 | A | 4/2007 |
| TW | 200417616 | | 9/2004 |
| TW | 200706660 | | 2/2007 |
| WO | 2004/079026 | A1 | 9/2004 |
| WO | 2007-139213 | A1 | 12/2007 |
| WO | 2008/041584 | A1 | 4/2008 |
| WO | 2008/099892 | A1 | 8/2008 |
| WO | 2009/107586 | A1 | 9/2009 |
| WO | WO2009107586 | A1 * | 9/2009 |

OTHER PUBLICATIONS

JP 2001-214226, Nagata et al., Published Aug. 2001. (machine translation).*

International Search Report issued in corresponding application PCT/JP2009/071599, completed Mar. 19, 2010 and dated Apr. 6, 2010.

International Search Report issued in related application PCT/JP2008/070410, completed Jan. 23, 2009 and dated Feb. 10, 2009.

Restriction Election issued in co-pending related U.S. Appl. No. 13/144,034 dated Apr. 18, 2012.

Office Action issued in related Canadian application 2,706,199 dated Dec. 2, 2011.

Espacenet English Abstract of JP 10-130754 (filed as Exhibit A1 in related U.S. Appl. No. 12/555,990), modified 2011, May 19, 1998.

Definition of Tensile Strength, at http://metals.about.com/library/bldef-Tensile-Strength.htm (2002), (filed as Exhibit A2 in related U.S. Appl. No. 12/555,990).

"Definition of Hardness," at http://metals.about.com/library/bldef-Hardness.htm (2002), (filed as Exhibit A3 in related U.S. Appl. No. 12/555,990).

"Definition of Proof Stress," at http://metals.about.com/library/bldef-Proof-Stress.htm (2002), (filed as Exhibit A4 in related U.S. Appl. No. 12/555,990).

Pierre Leroux, Breakthrough Indentation Yield Strength Testing (Nanovea 2011), (filed as Exhibit A5 in related U.S. Appl. No. 12/555,990).

Standards Handbook: Part 2—Alloy Data, Wrought Copper and Copper Alloy Mill Products 34 and 38 (Copper Development Association, Inc. 1985), (filed as Exhibit A8 in related U.S. Appl. No. 12/555,990).

Yield Strength—Strength(Mechanics) of Materials, at http://www.engineersedge.com/material_science/yield_strength.htm (downloaded Apr. 18, 2012), two pages.

J.R. Davies (ed.), ASM Specialty Handbook Copper and Copper Alloys 8-9 (ASM International), filed as Exhibit A in related U.S. Appl. No. 13/514,680.

E. Paul Degarmo et al., Materials and Processes in Manufacturing 402-404, 432-434, 989-998 (John Wiley & Sons, Inc. 2003).

Data Sheet No. A 6 Cu-DHP, Consel International Pour Le Developpement Du Cuivre, pp. 1, 2 and 4 (1968) submitted in a related application as Exhibit B.

Office Action issued in co-pending related U.S. Appl. No. 12/555,990 dated Apr. 14, 2011.

International Search Report issued in corresponding application No. PCT/JP2009/053216, completed May 19, 2009 and dated May 26, 2009.

International Search Report issued in corresponding application PCT/JP2009/071606, completed Mar. 19, 2010 and dated Apr. 6, 2010.

Office Action issued in related Taiwanese application 097143579 dated Oct. 24, 2012.

J.R. Davies (ed.), ASM Specialty Handbook Copper and Copper Alloys 8-9 (ASM International), filed as Exhibit A in related application.

J.R. Davies (ed.), ASM Specialty Handbook Copper and Copper Alloys 243-247 (ASM International 2001), filed as Exhibit D in related application.

ASM Specialty Handbook, Copper and Copper Alloys, 2001, p. 521.

Taiwanese office action issued in related matter 099100411 dated Oct. 22, 2013.

E. Paul Degarmo et al., Materials and Processes in Manufacturing 383-384 (9th ed. 2003), filed herewith as Exhibit A1.

Copper Parts Data Book, pp. 88 and 94 (1997).

(56) References Cited

OTHER PUBLICATIONS

Copper and Copper Alloys, ASM Specialty Handbook, pp. 3-4, and 454 (2001).
1994 Annual Book of ASTM Standards, vol. 02.01, 480-486 and 514-521 (1994), filed in a related application Exhibit A1.
Fundamentals of Rockwell Hardness Testing, www.wilsonsinstrumenets.com, 2004, pp. 1-15.
Office Action issued in corresponding Indian Patent Application 3469/DELNP/2010 dated Dec. 20, 2016.
Office Action issued in co-pending Indian application 8945/DELNP/2010 dated Aug. 24, 2017.
Office Action issued in co-pending related U.S. Appl. No. 14/596,630 dated Sep. 22, 2017,
Office Action issued in co-pending related U.S. Appl. No. 15/297,633 dated Sep. 22, 2017,

* cited by examiner

【FIG. 1】
EET MANUFACTURING PROCESS
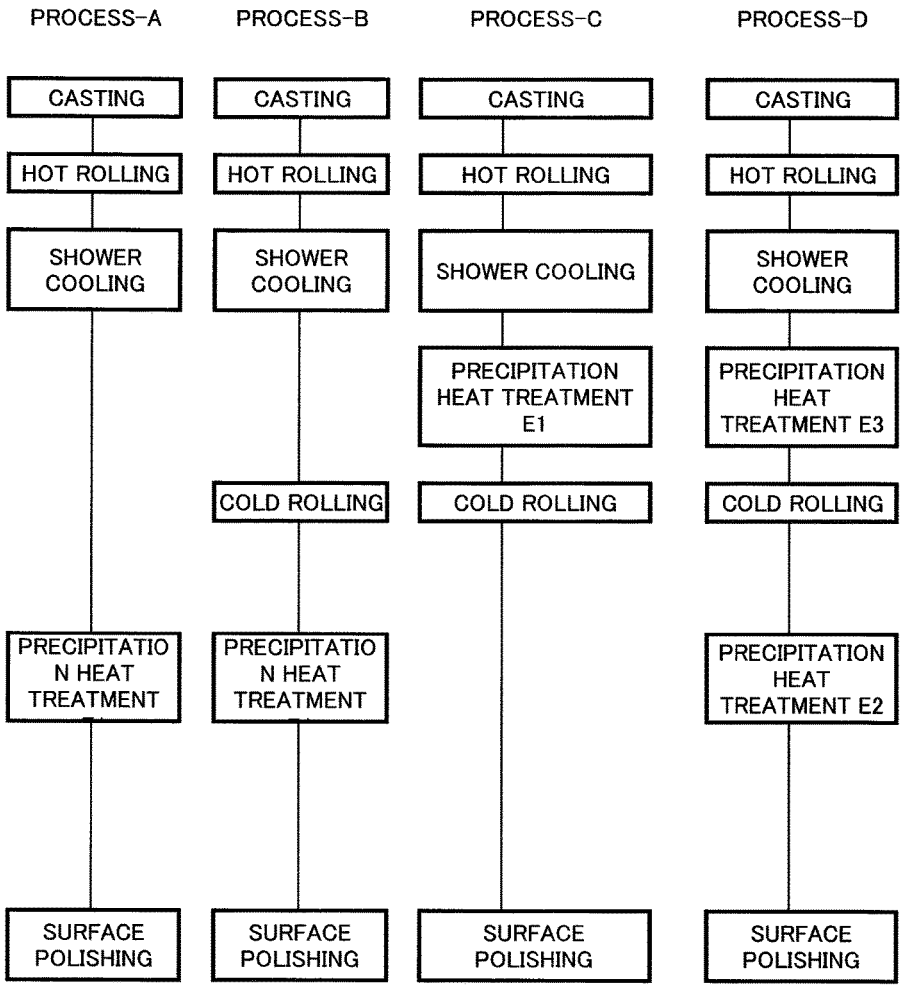

【FIG. 2】
THIN SHEET MANUFACTURING PROCESS
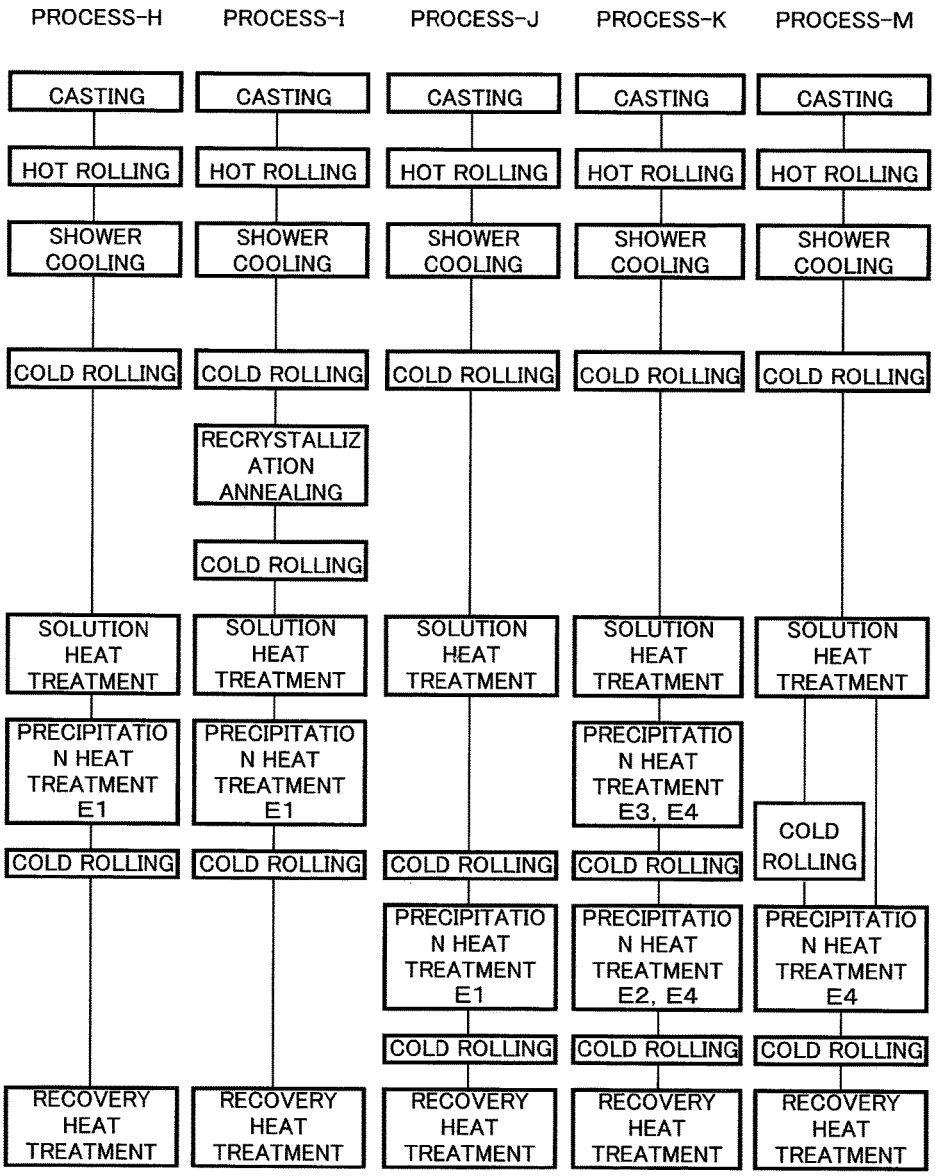

【FIG. 3】
(a)
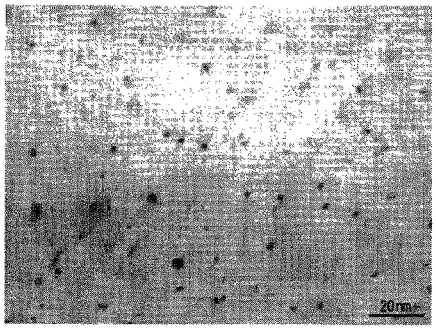
20nm
ALLOY NO. 21
PROCESS A1
TABLES 6 AND 7
TEST NO. 1
AVERAGE GRAIN DIAMETER OF PRECIPITATES 2.4nm
(b)
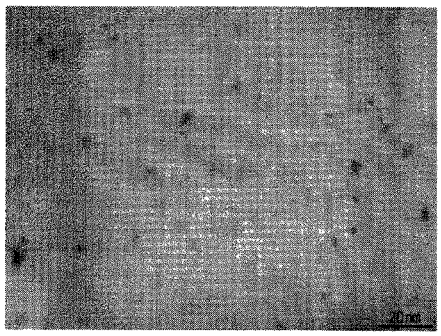
20nm
ALLOY NO. 21
PROCESS H1
TABLES 12 AND 13
TEST NO. 1
AVERAGE GRAIN DIAMETER OF PRECIPITATES 3nm

HIGH-STRENGTH AND HIGH-ELECTRICAL CONDUCTIVITY COPPER ALLOY ROLLED SHEET AND METHOD OF MANUFACTURING THE SAME

This is a National Phase Application in the United States of International Patent Application No. PCT/JP2009/071606, filed Dec. 25, 2009, which claims priority on Japanese Patent Application No. 2009-003813, filed Jan. 9, 2009. The entire disclosures of the above patent applications are hereby incorporated by reference.

TECHNICAL FIELD

The present invention relates to a high-strength and high-electrical conductivity copper alloy rolled sheet which is produced by a process including a precipitation heat treatment and a method of manufacturing the high-strength and high-electrical conductivity copper alloy rolled sheet.

BACKGROUND ART

In the past, copper sheets have been used in various industrial fields as a material for connectors, electrodes, connecting terminals, terminals, sensing members, heat sinks, bus bars, backing plates, molds and motor members such as end rings and rotor bars by utilizing excellent electrical and heat conductivity thereof. However, since pure copper including C1100 and C1020 has low strength, the use per unit area is increased to ensure the strength and thus cost increases occur and weight increases also occur.

Cr—Zr copper (1 mass % Cr-0.1 mass % Zr—Cu), which is a solution aging•precipitation type alloy, is known as a high-strength and high-electrical conductivity copper alloy. However, in general, this alloy is prepared through a heat treatment in which a hot-rolled material is re-heated at 950° C. (930° C. to 990° C.) and then subjected to immediate quenching and aging. Alternatively, the alloy is prepared through a series of heat treatments in which after hot rolling, a hot-rolled material is further subjected to plastic forming by hot or cold forging or the like in some cases, subjected to a solution heat treatment so as to be heated at 950° C. and rapidly cooled, and then subjected to aging. The high-temperature process of 950° C. not only requires significant energy, but oxidation loss occurs when the heating operation is performed in the air. In addition, because of the high temperature, diffusion easily occurs and the materials stick to each other, so an acid cleaning process is required.

For this reason, the heat treatment is performed at 950° C. in an inert gas or in vacuum. However, although the oxidation loss is prevented, the cost is increased, extra energy is also required and the sticking problem is not solved. Further, regarding the characteristics, grains become coarse and problems occur in fatigue strength since the heating operation is performed at high temperatures. Meanwhile, in a hot rolling process in which the solution heat treatment is not performed, only very poor strength can be obtained. In a hot rolling process, in the case of Cr—Zr copper, coarse grains are precipitated during the hot rolling due to a decrease in material temperature during the hot rolling, and thus a sufficient solution heat-treated state cannot be obtained even when a quenching operation is immediately performed after the hot rolling. In addition, Cr—Zr copper requires special management since a temperature condition range of the solution heat-treating is narrow, and if a cooling rate is not high enough, the solution is not realized. Moreover, since a large amount of active Zr and Cr is included, restrictions are imposed on the melting and casting. As a result, excellent tension strength and electrical conductivity are obtained, but the cost is increased.

In the automobile field using a copper sheet, while a decrease in the vehicle body weight is required to improve fuel efficiency, the number of components such as a connecting terminal, connector, relay and bus bar is increased due to the high-level informatization and the acquisition of electronic properties and hybrid properties (an increase in the number of electrical components) in a vehicle, and the number of members such as a heat sink for cooling the mounted electronic components is also increased. Accordingly, a copper sheet to be used is required to have a smaller thickness and higher strength. Originally, in comparison to the case of home appliances and the like, the usage environment is harsh, as the temperature of the vehicle interior, as well as the engine room, increases in summer (especially). Further, due to a high-voltage and high-current usage environment, it is particularly required to lower stress relaxation properties when a copper sheet is used in a connecting terminal, a connector and the like. The low stress relaxation properties mean that a contact pressure or spring properties of a connector and the like are not lowered in a usage environment of, for example, 100° C. In this specification, in a stress relaxation test to be described later, a low stress relaxation rate indicates "low" or "good" stress relaxation properties and a high stress relaxation rate indicates "high" or "bad" stress relaxation properties. It is preferable that a copper alloy rolled sheet has a low stress relaxation rate.

In addition, in many cases, due to the demands for high reliability, important electrical components are joined to each other by brazing, not soldering. Further, for example, also in motors, brazing is employed to join an end ring and a rotor bar, and high material strength is required after the joining to improve the performance speed of motors. Examples of a brazing filler material include Bag-7 (56Ag-22Cu-17Zn-5Sn alloy brazing filler material), described in JIS Z 3261, and a recommended brazing temperature thereof is in the high temperature range of 650° C. to 750° C. Accordingly, a copper sheet for use in relays, connecting terminals, sensing members, rotor bars, end rings and the like is required to have heat resistance of, for example, about 700° C.

In addition, for backing plates, molds and the like, non-deforming with respect to a temperature increase during manufacturing or use is required. For example, a material is required which has high strength at high temperatures of 300° C. to 400° C. Moreover, in some cases, friction diffusion welding is employed to join sheets to each other during manufacturing and thermal spraying is carried out in a process for increasing the heat resistance of a surface. It is required that a decrease in strength and electrical conductivity is small even upon exposure to high temperatures in a short time. In addition, for power modules and the like, copper for use in a heat sink or a heat spreader is joined to ceramic as a base sheet. Soldering is employed for the above joining, but Pb-free has become general for solder as well, and thus high-melting point solder such as Sn—Cu—Ag is used. In mounting a heat sink, a heat spreader and the like, it is required that not only does softening not occur but also that deformation and warpage do not occur and a thinner wall thickness is demanded in view of weight reduction and economy. A copper material is required to be not easily deformed even when exposed to high temperatures. That is, a copper material is required to have high heat resistance and high strength at high temperatures.

A copper alloy is known which includes 0.01 to 1.0 mass % of Co, 0.005 to 0.5 mass % of P and the balance including Cu and inevitable impurities (for example, see JP-A-10-168532). However, such copper alloy is also insufficient in both strength and electrical conductivity.

DISCLOSURE OF THE INVENTION

The present invention solves the above-described problems, and an object of the invention is to provide a high-strength and high-electrical conductivity copper alloy rolled sheet, which has high strength, high electrical conductivity and excellent heat resistance and is inexpensive, and a method of manufacturing the high-strength and high-electrical conductivity copper alloy rolled sheet.

In order to achieve the object, the invention provides a high-strength and high-electrical conductivity copper alloy rolled sheet which has an alloy composition containing 0.14 to 0.34 mass % of Co, 0.046 to 0.098 mass % of P, 0.005 to 1.4 mass % of Sn and the balance including Cu and inevitable impurities, in which [Co] mass % representing a Co content and [P] mass % representing a P content satisfy the relationship of $3.0 \leq ([Co]-0.007)/([P]-0.009) \leq 5.9$, and in which in a metal structure, precipitates are formed, the shape of the precipitates is substantially circular or elliptical on a two-dimensional observation plan, the precipitates are made to have an average grain diameter of 1.5 to 9.0 nm, or 90% or more of all the precipitates is made to have a diameter of 15 nm or less to be fine precipitates, and the precipitates are uniformly dispersed.

According to the invention, by the precipitation of fine precipitates of Co and P and the solid-solution of Sn, the strength and electrical conductivity of a high-strength and high-electrical conductivity copper alloy rolled sheet are improved.

It is desirable that 0.16 to 0.33 mass % of Co, 0.051 to 0.096 mass % of P and 0.005 to 0.045 mass % of Sn are contained and [Co] mass % representing a Co content and [P] mass % representing a P content satisfy the relationship of $3.2 \leq ([Co]-0.007)/([P]-0.009) \leq 4.9$. In this manner, the amount of Sn is closer to its lower limit in the composition range and thus the conductivity of a high-strength and high-electrical conductivity copper alloy rolled sheet is improved.

It is desirable that 0.16 to 0.33 mass % of Co, 0.051 to 0.096 mass % of P and 0.32 to 0.8 mass % of Sn are contained and [Co] mass % representing a Co content and [P] mass % representing a P content satisfy the relationship of $3.2 \leq ([Co]-0.007)/([P]-0.009) \leq 4.9$. In this manner, the amount of Sn is closer to its upper limit in the composition range and thus the strength of a high-strength and high-electrical conductivity copper alloy rolled sheet is improved.

In addition, it is desirable that there is provided a high-strength and high-electrical conductivity copper alloy rolled sheet which has an alloy composition containing 0.14 to 0.34 mass % of Co, 0.046 to 0.098 mass % of P, 0.005 to 1.4 mass % of Sn, at least one of 0.01 to 0.24 mass % of Ni and 0.005 to 0.12 mass % of Fe and the balance including Cu and inevitable impurities, in which [Co] mass % representing a Co content, [Ni] mass % representing a Ni content, [Fe] mass % representing a Fe content and [P] mass % representing a P content satisfy the relationship of $3.0 \leq ([Co]+0.85\times[Ni]+0.75\times[Fe]-0.007)/([P]-0.009) \leq 5.9$ and the relationship of $0.012 \leq 1.2\times[Ni]+2\times[Fe] \leq [Co]$, and in which in a metal structure, precipitates are formed, the shape of the precipitates is substantially circular or elliptical on a two-dimensional observation plan, the precipitates are made to have an average grain diameter of 1.5 to 9.0 nm, or 90% or more of all the precipitates is made to have a diameter of 15 nm or less to be fine precipitates, and the precipitates are uniformly dispersed. In this manner, fine precipitates of Co, P and the like are formed by Ni and Fe and thus the strength and heat resistance of a high-strength and high-electrical conductivity copper alloy rolled sheet are improved.

It is desirable that at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained. In this manner, Al, Zn, Ag, Mg or Zr renders S, which is contaminated during a recycle process of the copper material, harmless and prevents intermediate temperature embrittlement. In addition, since these elements further strengthen the alloy, the ductility and strength of a high-strength and high-electrical conductivity copper alloy rolled sheet are improved.

It is desirable that conductivity is equal to or greater than 45(% IACS), and a value of $(R^{1/2}\times S\times(100+L)/100)$ is equal to or greater than 4300 when conductivity is denoted by R(% IACS), tensile strength is denoted by S ($N/mm^2$) and elongation is denoted by L(%). In this manner, strength and electrical conductivity are improved and the balance between strength and electrical conductivity becomes excellent and thus a thin rolled sheet can be produced at a low cost.

It is preferable that the high-strength and high-electrical conductivity copper alloy rolled sheet is manufactured by a manufacturing process including hot rolling, that a rolled material subjected to the hot rolling has an average grain size equal to or greater than 6 μm and equal to or less than 70 μm, or satisfies the relationship of $5.5\times(100/RE0) \leq D \leq 90\times(60/RE0)$ where a rolling ratio of the hot rolling is denoted by RE0(%) and a grain size after the hot rolling is denoted by D μm, and that when a cross-section of the grain taken along a rolling direction is observed, when a length in the rolling direction of the grain is denoted by L1 and a length in a direction perpendicular to the rolling direction of the grain is denoted by L2, an average value of L1/L2 is 4.0 or less. In this manner, strength, ductility and conductivity are improved and the balance among strength, ductility and electrical conductivity becomes excellent and thus a thin rolled sheet can be produced at a low cost.

It is desirable that the tensile strength at 400° C. is equal to or greater than 200($N/mm^2$). In this manner, high-temperature strength is increased and thus a rolled sheet according to the invention can be used in a high-temperature state.

It is desirable that Vickers hardness (HV) after heating at 700° C. for 100 seconds is equal to or greater than 90, or 80% or more of a value of Vickers hardness before the heating. In this manner, excellent heat resistance is obtained and thus a rolled sheet according to the invention can be used in circumstances exposed to a high-temperature state including a process when a product is manufactured from the material.

It is desirable that a method of manufacturing the high-strength and high-electrical conductivity copper alloy rolled sheet includes: heating and hot-rolling an ingot at temperatures of 820° C. to 960° C.; performing cooling in which an average cooling rate until the temperature of the rolled material subjected to the final pass of the hot rolling or the temperature of the rolled material goes down from 700° C. to 300° C. is 5° C./sec or greater; and performing a precipitation heat treatment which is performed at temperatures of 400° C. to 555° C. for 2 to 24 hours after the hot rolling and satisfies the relationship of $275 \leq (T-100\times th^{-1/2}-110\times(1-RE/100)^{1/2}) \leq 405$ where a heat treatment temperature is denoted by T (° C.), a holding period of time is denoted by th (h) and a rolling ratio of the cold rolling between the hot rolling and the precipitation heat treatment is denoted by RE (%). In this manner, fine precipitates of Co and P are precipitated by the manufacturing condition and thus the strength, conductivity and heat resistance of a high-strength and high-electrical conductivity copper alloy rolled sheet are further improved. In addition, a high-temperature long-time solution heat treatment is not required and thus manufacturing can be carried out at a low cost.

It is desirable that a method is implemented including: subjecting a rolled material to a solution heat treatment in which the highest reached temperature is in the range of 820° C. to 960° C., a holding period of time from "the highest reached temperature−50° C." to the highest reached temperature is in the range of 2 to 180 seconds and the relationship of $90 \leq (Tmax-800) \times ts^{1/2} \leq 630$ is satisfied where the highest reached temperature is denoted by Tmax (° C.) and a holding period of time is denoted by ts (s); performing cooling in which an average cooling rate from 700° C. to 300° C. is 5° C./sec or greater after the solution heat treatment; performing a precipitation heat treatment at temperatures of 400° C. to 555° C. for 1 to 24 hours which satisfies a relationship of $275 \leq (T-100 \times th^{-1/2}-110 \times (1-RE/100)^{1/2} \leq 405$ where a heat treatment temperature is denoted by T (° C.), a holding period of time is denoted by th (h) and a rolling ratio of the cold rolling before the precipitation heat treatment is denoted by RE (%), or a precipitation heat treatment in which the highest reached temperature is in the range of 540° C. to 760° C., a holding period of time from "the highest reached temperature−50° C." to the highest reached temperature is in the range of 0.1 to 5 minutes and the relationship of $330 \leq (Tmax-100 \times tm^{-1/2}-100 \times (1-RE/100)^{1/2}) \leq 510$ is satisfied where a holding period of time is denoted by tm (min); performing cold rolling after the final precipitation heat treatment; and performing a heat treatment in which the highest reached temperature is in the range of 200° C. to 560° C., a holding period of time from "the highest reached temperature−50° C." to the highest reached temperature is in the range of 0.03 to 300 minutes and the relationship of $150 \leq (Tmax-60 \times tm^{-1/2}-50 \times (1-RE2/100)^{1/2}) \leq 320$ is satisfied where a rolling ratio of the cold rolling is denoted by RE2. In this manner, fine precipitates of Co and P are precipitated by the manufacturing condition and thus the strength, conductivity and heat resistance of a high-strength and high-electrical conductivity copper alloy rolled sheet are further improved. In addition, a high-temperature long-time solution heat treatment is not required and thus manufacturing can be carried out at a low cost.

BRIEF DESCRIPTION OF THE DRAWINGS

FIG. 1 shows flow diagrams of thick sheet manufacturing processes of a high-performance copper alloy rolled sheet according to an embodiment of the invention.

FIG. 2 shows flow diagrams of thin sheet manufacturing processes of the high-performance copper alloy rolled sheet according to an embodiment of the invention.

FIG. 3 shows photographs of metal structure of the high-performance copper alloy rolled sheet according to an embodiment of the invention.

BEST MODE FOR CARRYING OUT THE INVENTION

A high-strength and high-electrical conductivity copper alloy rolled sheet (hereinafter, referred to as a high-performance copper alloy rolled sheet) according to embodiments of the invention will be described. In this specification, the high-performance copper alloy rolled sheet is a sheet subjected to a hot rolling process and also includes a so-called "coil" which is wound in a coil or traverse form. The invention proposes a high-strength and high-electrical conductivity copper alloy rolled sheet having an alloy composition, wherein the alloy composition comprises 0.14 to 0.34 mass % of Co, 0.046 to 0.098 mass % of P, 0.005 to 1.4 mass % of Sn and the balance including Cu and inevitable impurities, wherein [Co] mass % representing a Co content and [P] mass % representing a P content satisfy the relationship of $3.0 \leq ([Co]-0.007)/([P]-0.009) \leq 5.9$, and wherein in a metal structure, precipitates are formed, the shape of the precipitates is substantially circular or elliptical on a two-dimensional observation plan, the precipitates are made to have an average grain diameter of 1.5 to 9.0 nm, or 90% or more of all the precipitates is made to have a diameter of 15 nm or less to be fine precipitates, and the precipitates are uniformly dispersed. Additional, particularly beneficial, embodiments of the invention are provided in accordance with the following subsidiary high-strength and high-electrical conductivity copper alloy rolled sheets. In accordance with a second high-strength and high-electrical conductivity copper alloy rolled sheet embodiment of the invention, the first embodiment is modified so that 0.16 to 0.33 mass % of Co, 0.051 to 0.096 mass % of P and 0.005 to 0.045 mass % of Sn are contained and [Co] mass % representing a Co content and [P] mass % representing a P content satisfy the relationship of $3.2 \leq ([Co]-0.007)/([P]-0.009) \leq 4.9$. In a third high-strength and high-electrical conductivity copper alloy rolled sheet embodiment of the invention, the first embodiment is modified so that 0.16 to 0.33 mass % of Co, 0.051 to 0.096 mass % of P and 0.32 to 0.8 mass % of Sn are contained and [Co] mass % representing a Co content and [P] mass % representing a P content satisfy the relationship of $3.2 \leq ([Co]-0.007)/([P]-0.009) \leq 4.9$. The invention also proposes a high-strength and high-electrical conductivity copper alloy rolled sheet having an alloy composition according to a fourth embodiment of the invention, wherein the alloy composition comprises 0.14 to 0.34 mass % of Co, 0.046 to 0.098 mass % of P, 0.005 to 1.4 mass % of Sn, at least one of 0.01 to 0.24 mass % of Ni and 0.005 to 0.12 mass % of Fe and the balance including Cu and inevitable impurities, wherein [Co] mass % representing a Co content, [Ni] mass % representing a Ni content, [Fe] mass % representing a Fe content and [P] mass % representing a P content satisfy the relationship of $3.0 \leq ([Co]+0.85 \times [Ni]+0.75 \times [Fe]-0.007)/([P]-0.009) \leq 5.9$ and the relationship of $0.012 \leq 1.2 \times [Ni]+2 \times [Fe] \leq [Co]$, wherein in a metal structure, precipitates are formed, the shape of the precipitates is substantially circular or elliptical on a two-dimensional observation plan, the precipitates are made to have an average grain diameter of 1.5 to 9.0 nm, or 90% or more of all the precipitates is made to have a diameter of 15 nm or less to be fine precipitates, and the precipitates are uniformly dispersed. Additional, particularly beneficial, embodiments of the invention are provided in accordance with the following subsidiary high-strength and high-electrical conductivity copper alloy rolled sheets. In accordance with a fifth high-strength and high-electrical conductivity copper alloy rolled sheet embodiment of the invention, the first embodiment, the second embodiment, the third embodiment, or the fourth embodiment is modified so that at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained. In accordance with a sixth high-strength and high-electrical conductivity copper alloy rolled sheet embodiment of the invention, the first embodiment, the second embodiment, the third embodiment, the fourth embodiment, or the fifth embodiment is modified so that conductivity is equal to or greater than 45(% IACS), and a value of ($R^{1/2}\times S\times(100+L)/100$) is equal to or greater than 4300 when conductivity is denoted by R(% IACS), tensile strength is denoted by S(N/mm$^2$) and elongation is denoted by L(%). In accordance with a seventh high-strength and high-electrical conductivity copper alloy rolled sheet embodiment of the invention, the first embodiment, the second embodiment, the third embodiment, the fourth embodiment, the fifth embodiment, or the sixth embodiment is modified so that the copper alloy rolled sheet is manufactured by a manufacturing process including hot rolling, wherein a rolled material subjected to the hot rolling has an average grain size equal to or greater than 6 μm and equal to or less than 70 μm, or satisfies the relationship of $5.5\times(100/RE0)\leq D\leq 90\times(60/RE0)$ where a rolling ratio of the hot rolling is denoted by RE0(%) and a grain size after the hot rolling is denoted by D μm, and when a cross-section of the grain taken along a rolling direction is observed, when a length in the rolling direction of the grain is denoted by L1 and a length in a direction perpendicular to the rolling direction of the grain is denoted by L2, an average value of L1/L2 is 4.0 or less. In accordance with an eighth high-strength and high-electrical conductivity copper alloy rolled sheet embodiment of the invention, the first embodiment, the second embodiment, the third embodiment, the fourth embodiment, the fifth embodiment, the sixth embodiment, or the seventh embodiment is modified so that the tensile strength at 400° C. is equal to or greater than 200(N/mm$^2$). In accordance with a ninth high-strength and high-electrical conductivity copper alloy rolled sheet embodiment of the invention, the first embodiment, the second embodiment, the third embodiment, the fourth embodiment, the fifth embodiment, the sixth embodiment, the seventh embodiment, or the eighth embodiment is modified so that wherein Vickers hardness (HV) after heating at 700° C. for 100 seconds is equal to or greater than 90, or 80% or more of a value of Vickers hardness before the heating. In accordance with a tenth high-strength and high-electrical conductivity copper alloy rolled sheet embodiment of the invention, the first embodiment, the second embodiment, the third embodiment, the fourth embodiment, the fifth embodiment, the sixth embodiment, the seventh embodiment, the eighth embodiment, or the ninth embodiment is modified so that a method of manufacturing the high-strength and high-electrical conductivity copper alloy rolled sheet, comprises heating and hot-rolling an ingot at temperatures of 820° C. to 960° C.; performing cooling in which an average cooling rate until the temperature of the rolled material subjected to the final pass of the hot rolling or the temperature of the rolled material goes down from 700° C. to 300° C. is 5° C./sec or greater; and performing a precipitation heat treatment which is performed at temperatures of 400° C. to 555° C. for 1 to 24 hours after the hot rolling and satisfies the relationship of $275\leq(T-100\times th^{-1/2}-110\times(1-RE/100)^{1/2})\leq 405$ where a heat treatment temperature is denoted by T (° C.), a holding period of time is denoted by th (h) and a rolling ratio of the cold rolling between the hot rolling and the precipitation heat treatment is denoted by RE (%). In accordance with an eleventh high-strength and high-electrical conductivity copper alloy rolled sheet embodiment of the invention, the first embodiment, the second embodiment, the third embodiment, the fourth embodiment, the fifth embodiment, the sixth embodiment, the seventh embodiment, the eighth embodiment, or the ninth embodiment is modified so that a method of manufacturing the high-strength and high-electrical conductivity copper alloy rolled sheet, comprises subjecting a rolled material to a solution heat treatment in which the highest reached temperature is in the range of 820° C. to 960° C., a holding period of time from "the highest reached temperature−50° C." to the highest reached temperature is in the range of 2 to 180 seconds and the relationship of $90\leq(Tmax-800)\times ts^{1/2}\leq 630$ is satisfied where the highest reached temperature is denoted by Tmax (° C.) and a holding period of time is denoted by ts (s); performing cooling in which an average cooling rate from 700° C. to 300° C. is 5° C./sec or greater after the solution heat treatment; performing a precipitation heat treatment at temperatures of 400° C. to 555° C. for 1 to 24 hours which satisfies a relationship of $275\leq(T-100\times th^{-1/2}-110\times(1-RE/100)^{1/2}\leq 405$ where a heat treatment temperature is denoted by T (° C.), a holding period of time is denoted by th (h) and a rolling ratio of the cold rolling before the precipitation heat treatment is denoted by RE (%), or a precipitation heat treatment in which the highest reached temperature is in the range of 540° C. to 760° C., a holding period of time from "the highest reached temperature−50° C." to the highest reached temperature is in the range of 0.1 to 25 minutes and the relationship of $330\leq(Tmax-100\times tm^{-1/2}-100\times(1-RE/100)^{1/2})\leq 510$ is satisfied where a holding period of time is denoted by tm (min); performing cold rolling after the final precipitation heat treatment; and performing a heat treatment in which the highest reached temperature is in the range of 200° C. to 560° C., a holding period of time from "the highest reached temperature−50° C." to the highest reached temperature is in the range of 0.03 to 300 minutes and the relationship of $150\leq(Tmax-60\times tm^{-1/2}-50\times(1-RE2/100)^{1/2})\leq 320$ is satisfied where a rolling ratio of the cold rolling is denoted by RE2. When an alloy composition is expressed in this specification, the bracketed element symbol such as [Co] represents a value of the content (mass %) of the corresponding element. In this specification, calculation expressions are shown by using the aforesaid displaying method of the content value. In the respective calculation expressions, the calculation is performed such that the content is 0 when the corresponding element is not contained. In this specification, calculation expressions are shown by using the aforesaid displaying method of the content value. In the respective calculation expressions, the calculation is performed such that the content is 0 when the corresponding element is not contained. The first to fifth invention alloys are collectively referred to as the invention alloy.

The first invention alloy has, generally, an alloy composition containing 0.14 to 0.34 mass % (preferably 0.16 to 0.33 mass %, more preferably 0.18 to 0.33 mass %, and most preferably 0.20 to 0.29 mass %) of Co, 0.046 to 0.098 mass % (preferably 0.051 to 0.096, more preferably 0.054 to 0.096 mass %, and most preferably 0.054 to 0.0.092 mass %) of P, 0.005 to 1.4 mass % of Sn, and the balance including Cu and inevitable impurities, in which [Co] mass % representing a Co content and [P] mass % representing a P content satisfy the relationship of $X1=([Co]-0.007)/([P]-0.009)$ where X1 is in the range of 3.0 to 5.9, preferably in the range of 3.1 to 5.2, more preferably in the range of 3.2 to 4.9, and most preferably in the range of 3.4 to 4.2.

The second invention alloy has, generally, an alloy composition containing 0.16 to 0.33 mass % (preferably 0.18 to 0.33 mass % and most preferably 0.20 to 0.29 mass %) of Co, 0.051 to 0.096 mass % (preferably 0.054 to 0.094 mass % and most preferably 0.054 to 0.0.092 mass %) of P, 0.005 to 0.045 mass % of Sn, and the balance including Cu and inevitable impurities, in which [Co] mass % representing a Co content and [P] mass % representing a P content satisfy the relationship of X1=([Co]−0.007)/([P]−0.009) where X1 is in the range of 3.2 to 4.9 (most preferably in the range of 3.4 to 4.2).

The third invention alloy has, generally, an alloy composition containing 0.16 to 0.33 mass % (preferably 0.18 to 0.33 mass % and most preferably 0.20 to 0.29 mass %) of Co, 0.051 to 0.096 mass % (preferably 0.054 to 0.094 mass % and most preferably 0.054 to 0.0.092 mass %) of P, 0.32 to 0.8 mass % of Sn, and the balance including Cu and inevitable impurities, in which [Co] mass % representing a Co content and [P] mass % representing a P content satisfy the relationship of X1=([Co]−0.007)/([P]−0.009) where X1 is in the range of 3.2 to 4.9 (most preferably in the range of 3.4 to 4.2).

The fourth invention alloy has, generally, an alloy composition having the same composition ranges of Co, P and Sn as in the first invention alloy and containing at least one of 0.01 to 0.24 mass % (preferably 0.015 to 0.18 mass % and more preferably 0.02 to 0.09 mass %) of Ni and 0.005 to 0.12 mass % (preferably 0.007 to 0.06 mass % and more preferably 0.008 to 0.045 mass %) of Fe, and the balance including Cu and inevitable impurities, in which [Co] mass % representing a Co content, [Ni] mass % representing an Ni content, [Fe] mass % representing a Fe content and [P] mass % representing a P content satisfy the relationship of X2=([Co]+0.85×[Ni]+0.75×[Fe]−0.007)/([P]−0.009) where X2 is in the range of 3.0 to 5.9, preferably in the range of 3.1 to 5.2, more preferably in the range of 3.2 to 4.9, and most preferably in the range of 3.4 to 4.2, and the relationship of X3=1.2×[Ni]+2×[Fe] where X3 is in the range of 0.012 to [Co], preferably in the range of 0.02 to (0.9×[Co]), and more preferably in the range of 0.03 to (0.7×[Co]).

The fifth invention alloy has, generally, an alloy composition having the composition of the first invention alloy to the fourth invention alloy and further containing at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr.

Next, a high-performance copper alloy rolled sheet manufacturing process will be, generally, described. The high-performance copper alloy rolled sheet manufacturing process includes a thick sheet manufacturing process of manufacturing mainly a thick sheet and a thin sheet manufacturing process of manufacturing mainly a thin sheet. In this specification, a thick sheet has a thickness of about 3 mm or greater and a thin sheet has a thickness of less than about 3 mm. However, there is no strict boundary between the thick sheet and the thin sheet. The thick sheet manufacturing process includes a hot rolling process and a precipitation heat treatment. In the hot rolling process, an ingot is heated at temperatures of 820° C. to 960° C. to start hot rolling, and a cooling rate until the temperature of the rolled material subjected to the final pass of the hot rolling or the temperature of the rolled material goes down from 700° C. to 300° C. is 5° C./sec or greater. An average grain size of the metal structure after the cooling is in the range of 6 to 70 μm, and is preferably in the range of 10 to 50 μm. Alternatively, when a processing rate of the hot rolling is denoted by RE0(%) and a grain size after the hot rolling is denoted by D μm, the expression $5.5\times(100/RE0)\leq D\leq 90\times(60/RE0)$ is satisfied and the expression $8\times(100/RE0)\leq D\leq 75\times(60/RE0)$ is preferably satisfied. In addition, when a cross-section of the grain taken along a rolling direction is observed, an average value of L1/L2 is 4.0 or less when a length in the rolling direction of the grain is denoted by L1 and a length in a direction perpendicular to the rolling direction of the grain is denoted by L2. After the hot rolling process, the precipitation heat treatment is performed. The precipitation heat treatment is a heat treatment which is performed at temperatures of 400° C. to 555° C. for 1 to 24 hours. When a heat treatment temperature is denoted by T(° C.), a holding period of time is denoted by th(h) and a rolling ratio of the cold rolling between the hot rolling and the precipitation heat treatment is denoted by RE(%), the relationship of $275\leq(T-100\times th^{-1/2}-110\times(1-RE/100)^{1/2}\leq 405$ is satisfied. As described above, the expression expressing the relationship between the heat treatment temperature, the holding period of time and the rolling ratio is referred to as a precipitation heat treatment conditional expression. The cold rolling may be performed before or after the precipitation heat treatment. The precipitation heat treatment may be performed several times or a recovery heat treatment to be described later may be performed.

The thin sheet manufacturing process includes a solution heat treatment, a precipitation heat treatment and a recovery heat treatment. The solution heat treatment is performed on a rolled material subjected to the hot rolling process, a cold rolling process and the precipitation heat treatment are properly performed after the solution heat treatment and the recovery heat treatment is performed last. In the solution heat treatment, a rolled material is subjected to the solution heat treatment in which the highest reached temperature is in the range of 820° C. to 960° C., a holding period of time from "the highest reached temperature−50° C." to the highest reached temperature is in the range of 2 to 180 seconds and the relationship of $90\leq(Tmax-800)\times ts^{1/2}\leq 630$ is satisfied where the highest reached temperature is denoted by Tmax (° C.) and a holding period of time is denoted by ts (s). A cooling rate from 700° C. to 300° C. is set to 5° C./sec or greater. An average grain size of the metal structure after the cooling is in the range of 6 to 70 μm, preferably in the range of 7 to 50 μm, more preferably in the range of 7 to 30 μm, and most preferably in the range of 8 to 25 μm. The precipitation heat treatment includes two heat treatment conditions. One of them is that a heat treatment temperature is in the range of 400° C. to 555° C., a holding period of time is in the range of 1 to 24 hours and the relationship of $275\leq(T-100\times th^{-1/2}-110\times(1-RE/100)^{1/2})\leq 405$ is satisfied where a heat treatment temperature is denoted by T (° C.), a holding period of time is denoted by th(h) and a rolling ratio of the cold rolling before the precipitation heat treatment is denoted by RE (%). The other heat treatment condition is that the highest reached temperature is in the range of 540° C. to 760° C., a holding period of time from "the highest reached temperature−50° C." to the highest reached temperature is in the range of 0.1 to 5 minutes and the relationship of $330\leq(Tmax-100\times tm^{-1/2}-100\times(1-RE/100)^{1/2})\leq 510$ is satisfied where a holding period of time is denoted by tm (min). The recovery heat treatment is a heat treatment in which the highest reached temperature is in the range of 200° C. to 560° C., a holding period of time from "the highest reached temperature−50° C." to the highest reached temperature is in the range of 0.03 to 300 minutes and the relationship of $150\leq(T-60\times tm^{-1/2}-50\times(1-RE2/100)^{1/2})\leq 320$ is satisfied where a rolling ratio of the cold rolling after the final precipitation heat treatment is denoted by RE2.

The basic principle of the high-performance copper alloy rolled sheet manufacturing process will be, generally, described. As means for obtaining high strength and high electrical conductivity, there are structure controlling methods mainly including aging precipitation hardening, solid solution hardening and grain refinement. However, in general, regarding high electrical conductivity, electrical conductivity is inhibited when additional elements are subjected to solid solution in the matrix, and depending on the elements, the electrical conductivity is markedly inhibited even by adding a small amount thereof in some cases. Co, P and Fe, which are used in the invention, are elements markedly inhibiting the electrical conductivity. For example, about 10% loss occurs in the electrical conductivity by the single addition of only 0.02 mass % of Co, Fe or P to pure copper. Further, in the case of an aging precipitation type alloy, it is nearly impossible for additional elements to be completely and efficiently precipitated without remaining in the matrix in a solid solution state. The invention has an advantage in that when the additional elements Co, P and the like are added in accordance with predetermined numerical expressions, Co, P and the like in the solid solution state can be almost precipitated in the subsequent precipitation heat treatment while strength, ductility and other properties are satisfied. In this manner, high electrical conductivity can be ensured.

In the cases of notable age-hardening copper alloys other than Cr—Zr copper, such as titanium copper and Corson alloy (Ni and Si are added thereto), even when a complete solution heat-treating and aging treatment are performed, a large amount of Ni, Si or Ti remains in the matrix in comparison to the case of the invention. As a result, strength is increased but a disadvantage occurs in that electrical conductivity is inhibited. In addition, in the solution heat treatment at high temperatures which is generally required in the complete solution heat-treating and aging precipitation process, when a heating operation is performed at typical solution heat temperatures of 800° C. to 950° C. for several tens of seconds, in some cases, for several seconds or more, grains become as coarse as about 100 μm. The coarsened grains have a negative effect on various mechanical properties. Moreover, the complete solution heat-treating and aging precipitation process leads to a large increase in cost due to the restriction in production volume. As for the structure controlling, grain refinement is mainly employed, but when an additional element amount is small, the effect thereof is also small.

The invention relates to a composition of Co, P and the like, Co, P and the like subjected to solid solution by performing a hot rolling process or high-temperature short-time annealing on a rolled sheet, and finely precipitating Co, P and the like in a subsequent precipitation heat treatment with each other, and at the same time, the recovery of ductility of the matrix and the work hardening by cold rolling are also combined therewith when the cold rolling with a high rolling ratio of, for example, 50% or more is performed. That is, by combining the composition, the solution heat-treating (solid-solution) during the process and the precipitation with each other, and further combining the recovery of the ductility of the matrix during the precipitation heat treatment and the work hardening by the cold working when the cold working is performed, high electrical conductivity, high strength and high ductility can be obtained. In the alloy having a composition according to the invention, not only can additional elements be subjected to solid solution during the hot working process as described above, but the solution heat sensitivity thereof is lower than those of age-hardening type precipitation alloys including Cr—Zr copper. In the case of a conventional alloy, solution heat-treating is not sufficiently carried out if cooling is not rapidly performed from a high temperature state at which elements are subjected to solid solution, that is, a solution heat-treated state. However, the invention alloy is characterized in that because of its low solution heat sensitivity, solution heat-treating is sufficiently carried out in a normal hot rolling process even when the temperature of a rolled material is lowered during the hot rolling, the rolling takes a long time in addition to the decrease in temperature and the cooling operation is performed at a cooling rate of shower cooling after the rolling. A description will be given of a temperature decrease of a rolled material during the hot rolling. For example, even when hot rolling of an 200 mm-thickness ingot at 910° C. is started, the hot rolling up to an intended sheet thickness cannot be performed in a single time and thus the rolling is performed several or tens of times. Accordingly, a long time is required and the temperature of the rolled material is lowered. Further, as the rolling proceeds, the sheet thickness becomes smaller and the temperature of the rolled material is lowered because the cooling is carried out by air cooling, because the material is brought into contact with a rolling roll and the heat is thus lost, or because coolant for cooling the rolling roll reaches the rolled material. Although also depending on rolling conditions, due to the increasing number of rolling operations and the increasing length of the rolled material, the temperature of the rolled material generally decreases in the range of 50° C. to 150° C. and a period of time of about 40 to 120 seconds is required for the rolling from the start of rolling when the rolling is performed into a sheet having a thickness of about 25 mm. In addition, when the rolling is performed into a sheet having a thickness of about 18 mm, the temperature decrease is in the range of about 100° C. to 300° C. and the period of time which is required for the rolling is in the range of about 100 to 400 seconds from the start of rolling. As described above, when the temperature of a rolled material is lowered during the hot rolling and a long time is required to perform the rolling, the solution heat-treated state is no longer retained and coarse precipitates not contributing to strength are precipitated in an age-hardening copper alloy such as Cr—Zr copper. Moreover, after the rolling operation, the precipitation further proceeds in a cooling operation performed by shower cooling or the like. In this specification, the phenomenon in which, even when a temperature decrease occurs during the hot rolling and the cooling rate after the hot rolling is low, it is difficult for atoms subjected to solid solution at high temperatures to be precipitated is referred to as "the solution heat sensitivity is low", and the phenomenon in which, when a temperature decrease occurs during the hot rolling or the cooling rate after the hot rolling is low, the atoms are easily precipitated is referred to as "the solution heat sensitivity is high".

Next, reasons for the addition of elements will be described. High strength and electrical conductivity cannot be obtained with the single addition of Co. However, when P and Sn are also added, high strength, high heat resistance and high ductility are obtained without damaging heat and electrical conductivity. With the single addition, the strength is increased to some degree, but there is no significant effect. When the content of Co is greater than the upper limit of the composition range of the invention alloy, the effect is saturated. Since Co is rare metal, the cost is increased and the electrical conductivity is damaged. When the content of Co is smaller than the lower limit of the composition range of the invention alloy, an effect of high strength cannot be exhibited even when P is also added. The lower limit of Co is 0.14 mass %, preferably 0.16 mass %, more preferably 0.18 mass %, and further more preferably 0.20 mass %. The upper limit is 0.34 mass %, preferably 0.33 mass %, and more preferably 0.29 mass %.

By also adding P in addition to Co and Sn, high strength and high heat resistance (temperature) are obtained without damaging heat and electrical conductivity. With the single addition, fluidity and strength are improved and grains are made refined. When the content of P is greater than the upper limit of the composition range, the above-described effects of fluidity, strength and fine grains are saturated. Heat and electrical conductivity are also damaged. In addition, cracking occurs easily during the casting or hot rolling. Moreover, ductility, particularly, bendability becomes worse. When the content of P is smaller than the lower limit of the composition range, the effect of high strength cannot be exhibited. The upper limit of P is 0.098 mass %, preferably 0.096 mass %, and more preferably 0.092 mass %. The lower limit thereof is 0.046 mass %, preferably 0.051 mass %, and more preferably 0.054 mass %.

The strength, electrical conductivity, ductility, stress relaxation properties, heat resistance, high-temperature strength, hot deformation resistance and deformability become better by adding Co and P in the above-described ranges. When even anyone of the compositions of Co and P is smaller than the range, the effects of all of the above-described properties are not significantly exhibited and the electrical conductivity becomes extremely worse. When larger than the range, the electrical conductivity becomes far worse in this manner and drawbacks occur as in the single addition of the respective elements. Both of the elements Co and P are essential elements for achieving the object of the invention, and by a proper mixing ratio of Co and P, the strength, heat resistance, high-temperature strength and the stress relaxation properties are improved without damaging the electrical and heat conductivity. As the contents of Co and P come closer to the upper limits in the composition ranges of the invention alloy, all the above properties are improved. Basically, the above fact is based on the precipitation of ultrafine precipitates in an amount contributing to the strength by the binding of Co to P. The addition of Co and P suppresses the growth of recrystallized grains during the hot rolling and allows fine grains to be maintained from the tip end to the rear end of a hot-rolled material even at high temperatures. Also, the addition of Co and P allows softening and recrystallization of the matrix to be markedly slowed during the precipitation heat treatment. However, also in the case of the above effect, when the contents of Co and P exceed the composition ranges of the invention alloy, an improvement in properties is almost never apparent and the above-described drawbacks are caused.

It is desirable that the content of Sn is in the range of 0.005 to 1.4 mass %. However, the content is preferably in the range of 0.005 to 0.25 mass % when high electrical and heat conductivity is required with the strength decreased to some degree. The content is more preferably in the range of 0.005 to 0.095 mass %, and particularly, when the electrical conductivity is required, it is desired that the content is in the range of 0.005 to 0.045 mass %. Although also depending on the contents of other elements, when the content of Sn is equal to or less than 0.095 mass % or equal to or less than 0.045 mass %, high electrical conductivity of 67% IACS or 70% IACS or greater, or high electrical conductivity of 72% IACS or 75% IACS or greater is obtained in terms of conductivity. Conversely, in the case of high strength, although also depending on the balance with the contents of Co and P, the content of Sn is preferably in the range of 0.26 to 1.4 mass %, more preferably in the range of 0.3 to 0.95 mass %, and most preferably in the range of 0.32 to 0.8 mass %.

Only with the addition of Co and P, that is, only with the precipitation based on Co and P, the heat resistance of the matrix is insufficient and unstable because static and dynamic recrystallization temperatures are low. By adding Sn of a small amount equal to or greater than 0.005 mass %, the recrystallization temperature during the hot rolling is raised and thus grains which are formed during the hot rolling are made fine. In the precipitation heat treatment, Sn increases a softening and recrystallization temperature of the matrix, and thus a recrystallization start temperature is raised and grains in the recrystallization portion are made refined. Further, the addition of Sn suppresses the precipitation of Co and P even when the material temperature is lowered during the hot rolling and the hot rolling takes a long time. For these reasons, even when cold rolling with a high rolling ratio is performed in the precipitation heat treatment, Co, P and the like can be precipitated just before the stage of recrystallization due to the increased heat resistance of the matrix. That is, in the hot rolling stage, Sn allows Co, P and the like to be further subjected to solid solution. Conversely, in the precipitation heat treatment, Sn allows Co, P and the like to be largely precipitated before the recrystallization. That is, the addition of Sn lowers the solution heat sensitivity of Co, P and the like, and as a result, the precipitates based on Co and P are further finely and uniformly dispersed. In addition, when the cold rolling with a high rolling ratio is performed, the precipitation occurs actively just before the formation of recrystallization grains and thus the hardening by the precipitation and a significant improvement in ductility by the recovery and recrystallization can be achieved at the same time. Accordingly, by the addition of Sn, high electrical conductivity and ductility can be ensured while high strength is maintained.

In addition, Sn improves the electrical conductivity, strength, heat resistance, ductility (particularly, bendability), stress relaxation properties and abrasion resistance. Particularly, since heat sinks or connection metal fittings which are used in electrical usage such as terminals and connectors in which high current flows require high electrical conductivity, strength, ductility (particularly, bendability) and stress relaxation properties, the high-performance copper alloy rolled sheet of the invention is most suitable. Further, heat sink materials, which are used in hybrid cars, electrical vehicles, computers and the like, and rapidly rotating motor members require high reliability and are thus brazed. However, even after the brazing, the heat resistance showing high strength is important and the high-performance copper alloy rolled sheet of the invention is most suitable. Moreover, the invention alloy has high high-temperature strength and heat resistance. Accordingly, in Pb-free solder mounting of heat spreader materials, heat sink materials and the like for use in power modules and the like, warpage or deformation does not occur even when the thickness is made thinner and the invention alloy is most suitable for these materials.

When strength is insufficient, solution hardening by 0.26 mass % or more of Sn improves the strength while slightly sacrificing the electrical conductivity. When the content of Sn is equal to or greater than 0.32 mass %, the effect is further exhibited. In addition, since abrasion resistance depends on hardness or strength, the abrasion resistance is also influenced. The lower limit of Sn is 0.005 mass % and the most preferable lower limit is equal to or greater than 0.008 mass % to obtain the strength, heat resistance of the matrix and bendability. When the content of Sn exceeds the upper limit of 1.4 mass %, heat and electrical conductivity and bendability are lowered and hot deformation resistance is increased, so cracking easily occurs during the hot rolling.

In the case in which priority is given to electrical conductivity over solution hardening by Sn, 0.095 mass % or less, or 0.045 mass % or less of Sn is added to sufficiently exhibit the effect. Particularly, when Sn is added in an amount exceeding 1.4 mass %, electrical conductivity becomes worse and a recrystallization temperature is lowered, and thus the matrix is recovered and recrystallized without the precipitation of Co and P. From this point of view, the upper limit is preferably 1.3 mass % or less, more preferably 0.95 mass % or less, and most preferably 0.8 mass %.

The relationship between the contents of Co and P and the relationship between the contents of Co, P, Fe and Ni are required to satisfy the following numerical expression. [Co] mass % representing a Co content, [Ni] mass % representing a Ni content, [Fe] mass % representing a Fe content and [P] mass % representing a P content satisfy the relationship of $X1=([Co]-0.007)/([P]-0.009)$ where X1 is in the range of 3.0 to 5.9, preferably in the range of 3.1 to 5.2, more preferably in the range of 3.2 to 4.9, and most preferably in the range of 3.4 to 4.2.

In addition, when Ni and Fe are added, the relationship of $X2=([Co]+0.85\times[Ni]+0.75\times[Fe]-0.007)/([P]-0.0090)$ where X2 is in the range of 3.0 to 5.9, preferably in the range of 3.1 to 5.2, more preferably in the range of 3.2 to 4.9, and most preferably in the range of 3.4 to 4.2. When the values of X1 and X2 are greater than the upper limits thereof, a large decrease in heat and electrical conductivity is caused, strength and heat resistance are lowered, the grain cannot be suppressed and hot deformation resistance is also increased. When the values of X1 and X2 are lower than the lower limits, a decrease in heat and electrical conductivity is caused, heat resistance and stress relaxation properties are lowered and hot and cold ductility is damaged. Particularly, the necessary high-level relationship between heat and electrical conductivity and strength cannot be obtained and the balance with ductility becomes worse. In addition, when the values of X1 and X2 fall outside of the ranges of the upper limit and the lower limit, the precipitates having the targeted chemical combination and diameter cannot be obtained and thus a high-strength and high-electrical conductivity material as the object of the invention cannot be obtained.

In order to obtain the high strength and high electrical conductivity as the object of the invention, a ratio of Co to P is very important. When conditions such as the composition, heating temperature and cooling rate are met, Co and P form fine precipitates in which a mass concentration ratio of Co:P is about 4:1 to 3.5:1. The precipitates are expressed by formulas such as $Co_2P$, $Co_{2.a}P$ and $Co_xP_y$, and are nearly spherical or nearly elliptical in shape and have a grain diameter of about 3 nm. In greater detail, the precipitates are in the range of 1.5 to 9.0 nm (preferably in the range of 1.7 to 6.8 nm, more preferably in the range of 1.8 to 4.5 nm, most preferably in the range of 1.8 to 3.2 nm) when defined by an average grain diameter of the precipitates shown in a plane. Alternatively, 90%, preferably 95% or more of the precipitates are in the range of 0.7 to 15 nm, more preferably in the range of 0.7 to 10 nm, and 95% or more of the precipitates are most preferably in the range of 0.7 to 5 nm in view of the distribution of diameters of the precipitates, and high strength can be obtained by uniformly precipitating the precipitates.

The precipitates are uniformly and finely distributed and also uniform in size, and the finer the grain diameters thereof, the more the grain diameters of the recrystallization portion, strength and high-temperature strength are influenced. 0.7 nm is the limit on the grain diameter which can be discriminated and measured when observed with 750,000 magnifications by using an ultrahigh-pressure transmission electron microscope (hereinafter, referred to as TEM) and when using dedicated software. Accordingly, even when there are precipitates having a diameter of less than 0.7 nm, these are excluded from the calculation of the average grain diameter, and the above-described range of "0.7 to 15 nm" has the same meaning as "15 nm or less" and the range of "0.7 to 10 nm" has the same meaning as 10 nm or less (hereinafter, the same is applied in this specification). In the precipitates, the crystallized grains which are formed in the casting are definitely not included. Further, when particularly defining a uniform dispersion of the precipitates, it can be defined that in the TEM observation with 750,000 magnifications, in an arbitrary area of 200 nm×200 nm of a microscope observation position (with the exception of unusual portions such as the outmost surface layer) to be described later, an inter-nearest neighboring precipitated grain distance of at least 90% of precipitated grains is equal to or less than 100 nm, and preferably equal to or less than 75 nm, or is at most 25 times the average grain diameter, or, in an arbitrary area of 200 nm×200 nm of a microscope observation position to be described later, the number of precipitated grains is at least 25, and preferably at least 50, that is, there are no large non-precipitation zones affecting the characteristics in a typical micro-region, that is, there are no non-uniform precipitation zones.

Since a lot of dislocations exist in a final material subjected to the cold working, the TEM observation was carried out in a material subjected to the final precipitation heat treatment or in a region with no dislocation interfering with the observation. Obviously, since the heat causing precipitates to be grown in the material is not applied, the grain diameter of the precipitates hardly changes. When the diameter of the precipitates is greater than 9.0 nm in terms of the average grain diameter, the contribution thereof to the strength becomes weaker, and when the diameter of the precipitates is less than 1.5 nm, the strength is saturated and the electrical conductivity deteriorates. In addition, when the diameter is too small, it is difficult to achieve precipitation throughout. The average grain diameter of the precipitates is preferably equal to or less than 6.8 nm, more preferably equal to or less than 4.5 nm, and most preferably in the range of 1.8 to 3.2 nm from the relationship with the electrical conductivity. Moreover, even when the average grain diameter is small, when a percentage of coarse precipitates is large, a contribution to the strength is not made. That is, since large precipitated grains having a diameter greater than 15 nm do not contribute much to the strength, a percentage of precipitated grains having a grain diameter equal to or less than 15 nm is 90% or more, preferably 95% or more, and a percentage of precipitated grains having a grain diameter equal to or less than 10 nm is more preferably 95% or more. Most preferably, a percentage of precipitated grains having a grain diameter equal to or less than 5 nm is 95% or more. Further, when the precipitates are non-uniformly dispersed, that is, when a non-precipitation zone is formed, the strength becomes lower. Regarding the precipitates, it is most preferable that three conditions, that is, a small average grain diameter, no coarse precipitates and uniform precipitation are satisfied. In addition, when a value of the precipitation heat treatment conditional expression described above and to be described later is lower than the lower limit value, the precipitates are refined, but the amount of the precipitates is small, and thus a contribution thereof to the strength is small and conductivity also becomes lower. When a value of the precipitation heat treatment conditional expression is greater than the upper limit value, conductivity is improved, but the precipitates greater than 10 μm in an average grain size and coarse grains having a diameter greater than 15 μm are increased, and thus the number of the precipitated grains is decreased and a contribution of the precipitation to the strength becomes smaller. In addition, in the case in which the cold rolling is performed before the precipitation heat treatment, when a value of the precipitation heat treatment conditional expression is lower than the lower limit value, the recovery of the ductility of the matrix is small, and when a value of the precipitation heat treatment conditional expression is greater than the upper limit value, the strength of the matrix becomes lower and high strength cannot thus be obtained. When a value of the precipitation heat treatment conditional expression is even higher, recrystallization occurs together with further coarsening of precipitates and thus a high-strength material cannot be expected.

In the invention, even when Co and P are ideally mixed and even when the precipitation heat treatment is performed under the ideal conditions, not all the Co and P are used to form precipitates. In the invention, when the precipitation heat treatment is performed under the industrially practicable mixing of Co and P and precipitation heat treatment condition, about 0.007 mass % of Co and about 0.009 mass % of P are not used to form the precipitates and are present in a solid solution state in the matrix. Accordingly, it is required to determine amass ratio of Co to P by deducting 0.007 mass % and 0.009 mass % from the mass concentrations of Co and P, respectively. That is, it is not enough to simply determine compositions of Co and P or a ratio of Co to P, and a value of ([Co]−0.007)/([P]−0.009) which is in the range of 3.0 to 5.9 (preferably in the range of 3.1 to 5.2, more preferably in the range of 3.2 to 4.9, and most preferably in the range of 3.4 to 4.2) is an essential condition. When the most preferable ratio of ([Co]−0.007) to ([P]−0.009) is achieved, target fine precipitates are formed and thus an essential requirement for a high-electrical conductivity and high-strength material is satisfied. Meanwhile, when a value of ([Co]−0.007)/([P]−0.009) is beyond the above-described ratio range, either Co or P does not form precipitates and remains in a solid solution state, and thus a high-strength material cannot be obtained and the electrical conductivity becomes worse. Moreover, since precipitates contrary to the purpose of the combination ratio are formed and thus the diameter of the precipitated grains becomes larger or the precipitates hardly contribute to the strength, a high-electrical conductivity and high-strength material cannot be obtained. As described above, since about 0.007 mass % of Co and about 0.009 mass % of P are not used to form precipitates and are present in a solid solution state in the matrix, electrical conductivity is equal to or less than 89% IACS. When considering additional elements such as Sn, electrical conductivity is about 87% IACS or less, or is about 355 W/m·K or less in terms of heat conductivity. In this regard, these values show electrical conductivity of as high as that of pure copper (phosphorus-deoxidized copper) including 0.025 mass % of P.

Since fine precipitates are formed in this manner, a material having sufficiently high strength can be obtained by a small amount of Co and P. In addition, as described above, although Sn does not directly form precipitates, the addition of Sn causes the recrystallization in the hot rolling to be delayed and causes a sufficient amount of Co and P to be subjected to solid solution. When the cold rolling with a high rolling ratio is carried out, the recrystallization temperature of the matrix is raised by the addition of Sn and thus the precipitation can be carried out simultaneously with the recovery of ductility caused by the recovery•and/or partial recrystallization of the matrix. Obviously, when the recrystallization precedes the precipitation, the matrix is completely recrystallized and softened and the strength thereof is lowered, or the precipitation hardening cannot be exhibited due to the small precipitation amount and the electrical conductivity is lowered due to unprecipitated Co and P. Conversely, when the precipitation precedes while the matrix is not softened, a big problem occurs in ductility and thus the material cannot be used industrially. In addition, when raising the precipitation heat treatment condition, the precipitates become larger and the effects due to the precipitation are negated.

Next, Ni and Fe will be described. In order to obtain the high strength and high electrical conductivity as the object of the invention, a ratio between Co, Ni, Fe and P is very important. Under certain concentration conditions, Ni and Fe replace functions of Co. In the case of Co and P, as described above, fine precipitates are formed in which a mass concentration ratio of Co:P is about 4:1 to 3.5:1. However, when Ni and Fe are added, precipitates of Co, Ni, Fe and P where a part of Co based on $Co_2P$, $Co_{2.a}P$, or $Co_{b.c}P$ is substituted with Ni or Fe by the precipitation process, for example, combination forms such as $Co_xNi_yP$, and $Co_xFe_yP$, are obtained. These precipitates are nearly spherical or nearly elliptical in shape and have a grain diameter of about 3 nm. The precipitates are in the range of 1.5 to 9.0 nm (preferably in the range of 1.7 to 6.8 nm, more preferably in the range of 1.8 to 4.5 nm, most preferably in the range of 1.8 to 3.2 nm) when being defined by an average grain diameter of the precipitates shown in a plane. Alternatively, 90%, preferably 95% or more of the precipitates are in the range of 0.7 to 15 nm in diameter, more preferably in the range of 0.7 to 10 nm, and 95% or more of the precipitates are most preferably in the range of 0.7 to 5 nm from the distribution of diameters of the precipitates, and high strength can be obtained by uniformly precipitating the precipitates.

When an element is added to copper, electrical conductivity deteriorates. For example, in general, heat and electrical conductivity is damaged by about 10% only with a 0.02 mass % single addition of Co, Fe or P to pure copper. However, when 0.02 mass % of Ni is singly added, heat and electrical conductivity is lowered only by about 1.5%.

In the above-described numerical expression ([Co]+0.85×[Ni]+0.75×[Fe]−0.007), the coefficient 0.85 of [Ni] and the coefficient 0.75 of [Fe] indicate ratios of the binding of Ni and Fe to P when a proportion of the binding of Co to P is set to 1. In addition, when a mixing ratio of Co and P is beyond the most preferable range, the precipitates are decreased, the grain refinement and uniform dispersion of the precipitates are damaged, Co or P which is not given to the precipitation is excessively present in solid solution state, and when the cold rolling is performed at a high rolling ratio, the recrystallization temperature is lowered. Accordingly, the balance between the precipitation and the recovery of the matrix is disrupted, the various characteristics of the object of the invention cannot be achieved and the electrical conductivity deteriorates. When Co, P and the like are properly mixed and fine precipitates are uniformly distributed, an excellent effect is exhibited in ductility such as bendability by the synergetic effect with Sn.

Fe and Ni act for the effective binding of Co to P. The single addition of these elements lowers the electrical conductivity and rarely contributes to an improvement in all the characteristics such as heat resistance and strength. Ni has an alternate function of Co on the basis of the addition of Co and P, and an amount of decrease in conductivity is small even when Ni is subjected to solid solution. Accordingly, even when a value of ([Co]+0.85×[Ni]+0.75×[Fe]−0.007)/([P]−0.009) is out of the center value of 3.0 to 5.9, Ni has a function of minimizing a decrease in electrical conductivity. In addition, Ni improves stress relaxation properties which are required for connectors and the like when not contributing to the precipitation. Moreover, Ni prevents the diffusion of Sn in Sn plating of connectors. However, when Ni is added in an excessive amount equal to or greater than 0.24 mass % or beyond the range of the numerical expression (1.2×[Ni]+2×[Fe]≤[Co]), the composition of precipitates gradually changes and a contribution to an improvement in strength is thus not made. In addition, hot deformation resistance increases and electrical conductivity is lowered. The upper limit of Ni is 0.24 mass %, preferably 0.18 mass %, and more preferably 0.09 mass %. The lower limit thereof is 0.01 mass %, preferably 0.015 mass %, and more preferably 0.02 mass %.

The addition of a small amount of Fe, based on the addition of Co and P, leads to an improvement in strength, an increase of the non-recrystallized structure and grain refinement of the recrystallized portion. Regarding the formation of precipitates together with Co and P, Fe is stronger than Ni. However, when Fe is added in an excessive amount equal to or greater than 0.12 mass % or beyond the range of the numerical expression (1.2×[Ni]+2×[Fe]≤[Co]), the composition of precipitates gradually changes and a contribution to an improvement in strength is thus not made. In addition, hot deformation resistance increases, and ductility and electrical conductivity are also lowered. When a calculated value of the numerical expression ([Co]+0.85×[Ni]+0.75×[Fe]−0.007)/([P]−0.009) is greater than 4.9, much of Fe is subjected to solid solution and the conductivity becomes worse. For this reason, the upper limit of Fe is 0.12 mass %, preferably 0.06 mass %, and more preferably 0.045 mass %. The lower limit thereof is 0.005 mass %, preferably 0.007 mass %, and more preferably 0.008 mass %.

Al, Zn, Ag, Mg or Zr decreases intermediate temperature embrittlement while hardly damaging the electrical conductivity, renders S harmless, which is formed and incorporated during a recycle process and improves the ductility, strength and heat resistance. For this purpose, each of Al, Zn, Ag and Mg is required to be contained in an amount equal to or greater than 0.002 mass % and Zr is required to be contained in an amount equal to or greater than 0.001 mass %. Further, Zn improves solder wettability and brazing properties. Meanwhile, the content of Zn is at least equal to or less than 0.045 mass %, and preferably less than 0.01 mass % when a manufactured high-performance copper alloy rolled sheet is subjected to brazing in a vacuum melting furnace or the like, used under vacuum, and used at high temperatures. In addition, Ag particularly improves heat resistance of an alloy. When the content exceeds the upper limit thereof, the above effect is not only saturated but electrical conductivity starts to decrease, hot deformation resistance increases, and thus hot deformability becomes worse. When the electrical conductivity is emphasized, the additional amount of Sn is preferably equal to or less than 0.095 mass %, and most preferably equal to or less than 0.045 mass %. Additional amounts of Al and Mg are preferably equal to or less than 0.095 mass %, and more preferably equal to or less than 0.045 mass %, additional amounts of Zn and Zr are preferably equal to or less than 0.045 mass % and an additional amount of Ag is preferably equal to or less than 0.3% mass %.

Next, manufacturing processes will be described with reference to FIGS. 1 and 2. FIG. 1 shows processes A to D as examples of the thick sheet manufacturing process. In the process A of the thick sheet manufacturing process, casting, hot rolling and shower cooling are performed, and after the shower cooling, a precipitation heat treatment and surface polishing are performed. In the process B, after the shower cooling, cold rolling, a precipitation heat treatment and surface polishing are performed. In the process C, after the shower cooling, a precipitation heat treatment, cold rolling and surface polishing are performed. In the process D, after the shower cooling, a precipitation heat treatment, cold rolling, a precipitation heat treatment and surface polishing are performed. Acid cleaning may be performed in place of the surface polishing. Differences among the precipitation heat treatments E1, E2 and E3 of the diagram will be described later. In the processes A to D, a facing process or an acid cleaning process is properly performed in accordance with surface properties which are required for a rolled sheet.

In the thick sheet manufacturing process, a hot rolling start temperature, a hot rolling end temperature and a cooling rate after the hot rolling are important. In this specification, a hot rolling start temperature and an ingot heating temperature have the same meaning. In the case of the invention alloy, due to low solution heat sensitivity, much of Co, P and the like is subjected to solid solution by heating (at least 820° C. or higher, and preferably 875° C. or higher) of a predetermined temperature or higher before the hot rolling. However, the higher the hot rolling end temperature is, and the higher the cooling rate is, the larger the amount of Co, P and the like, which is subjected to solid solution, becomes. The invention alloy does not require a solution heat treatment which is conventionally performed after hot rolling, and when managing hot rolling conditions such as hot rolling start temperature, hot rolling end temperature, hot rolling time and cooling rate, it is possible to sufficiently have Co, P and the like subjected to solid solution during the hot rolling process. However, it is not preferable that the hot rolling start temperature is too high because grains of the matrix become coarse. In addition, after the hot rolling, a precipitation heat treatment is performed. Cold rolling and the like may be added between the hot rolling and the precipitation heat treatment. In place of the hot rolling, hot forging may be performed under the same temperature condition.

FIG. 2 shows processes H to M (process L excluded) as examples of the thin sheet manufacturing process. In the process H, after the shower cooling, cold rolling, a solution heat treatment, a precipitation heat treatment, cold rolling and a recovery heat treatment are performed. In the process I, after the shower cooling, cold rolling, a recrystallization heat treatment, cold rolling, a solution heat treatment, a precipitation heat treatment, cold rolling and a recovery heat treatment are performed. In the process J, after the shower cooling, cold rolling, a solution heat treatment, cold rolling, a precipitation heat treatment, cold rolling and a recovery heat treatment are performed. In the process K, after the shower cooling, cold rolling, a solution heat treatment, a precipitation heat treatment, cold rolling, a precipitation heat treatment, cold rolling and a recovery heat treatment are performed. In the process M, after the shower cooling, cold rolling, a solution heat treatment, cold rolling (not essential), a precipitation heat treatment, cold rolling and a recovery heat treatment are performed. In the processes H to M, a facing process or an acid cleaning process is properly performed in order to improve surface properties of a rolled sheet. Herein, the solution heat treatment is a method of heat-treating a sheet of 0.1 to 4 mm by continuously passing it through a so-called AP line of a high-temperature heating zone (820° C. to 960° C.) for a short time during the thin sheet process by cold rolling, and a cleaning process is added thereto. In the AP line, the cooling rate is equal to or greater than 5° C./sec. The precipitation heat treatment E4 of the diagram will be described later.

In the thin sheet manufacturing process, hot rolling conditions are not important. In place of all the hot rolling conditions which are important in the thick sheet manufacturing process, a temperature of the solution heat treatment of a rolled material and a cooling rate after the heat treatment are important. In the case of the invention alloy, a larger amount of Co, P and the like is subjected to solid solution by heating (820° C. or higher) of a predetermined temperature or higher. However, the higher the heating temperature is, and the higher the cooling rate is, the larger the amount of Co, P and the like, which is subjected to solid solution, becomes. However, when the heating temperature is too high, grains (greater than 50 μm) become coarse and thus bendability becomes poor. Also, it is preferable that the precipitation heat treatment itself has the same conditions as in the processes A to D. The reason for this is that, in this thin sheet manufacturing process, Co and P are once subjected to solid solution. However, in the case in which a cold rolling ratio is greater than 40% or 50% in the processes J and K, the electrical conductivity is slowly recovered and the ductility also deteriorates when trying to obtain the highest strength. Accordingly, by the precipitation heat treatment, a state just before the recrystallization or a partially recrystallized state is achieved.

Next, hot rolling will be described. An ingot which is used in the hot rolling is in the range of about 100 to 400 mm in thickness, in the range of about 300 to 1500 mm in width and in the range of about 500 to 10000 mm in length. The ingot is heated at temperatures of 820° C. to 960° C. and requires a period of time of about 30 to 500 seconds until it is hot-rolled into a predetermined thickness and the hot rolling ends. During that time, the temperature is lowered, and particularly, when the thickness is decreased to 25 mm or 20 mm or less, the temperature of the rolled material is markedly lowered. It is definitely preferable that the hot rolling is performed in a state in which a decrease in temperature is small. In the case of the invention alloy, since a precipitation rate of Co, P and the like is low, an average cooling rate up to 700° C. after the end of the hot rolling or up to 300° C. from the temperature after the final hot rolling is required to be equal to or greater than 5° C./sec in order to maintain a solution heat-treated state of the hot-rolled material. Rapid cooling at 100° C./sec as applied for a typical precipitation type alloy is not required.

In the case of the thick sheet manufacturing process, a cold rolling process is not performed after the hot rolling, or, even when the cold rolling is performed, only a low rolling ratio equal to or less than 50% or equal to or less than 60% is given and thus an improvement in strength by work hardening is not expected. Accordingly, it is preferable that quenching, for example, water cooling in a water tank, shower cooling or forced air cooling is performed immediately after the hot rolling. When the heating temperature of an ingot is lower than 820° C., Co, P and the like are not sufficiently subjected to solid solution and solution heat-treated. In addition, since the invention alloy has high heat resistance, there is concern that a cast structure is not completely destroyed by the hot rolling and remains, although also depending on the relationship with the rolling ratio in the hot rolling. Meanwhile, when the heating temperature is higher than 960° C., the solution heat-treated state is also generally saturated, grains of a hot-rolled material become coarse and the material characteristics are affected. An ingot heating temperature is preferably in the range of 850° C. to 940° C., and more preferably in the range of 875° C. to 930° C. Most preferably, when the thickness of a hot-rolled material is equal to or larger than about 30 mm or a hot rolling processing ratio is equal to or less than 80%, an ingot heating temperature is in the range of 875° C. to 920° C., and when the thickness of a hot-rolled material is smaller than 30 mm or a hot rolling processing ratio is greater than 80%, an ingot heating temperature is in the range of 885° C. to 930° C.

In terms of the relationship with the composition, when the content of Co is greater than 0.25 mass %, an ingot heating temperature is preferably in the range of 885° C. to 940° C., and more preferably in the range of 895° C. to 930° C. The reason is that the temperature should be set high in order to render a larger amount of Co and the like subjected to solid solution, and since a large amount of Co is contained, recrystallization grains in the hot rolling can be made refined. Further, when considering a temperature decrease of the ingot (hot-rolled material) during the rolling, it is preferable that a high rolling rate is employed and a high reduction (rolling ratio) per one pass is employed. In greater detail, it is preferable that the number of rolling operations is reduced by adjusting an average rolling ratio after the fifth pass to 20% or more. Accordingly, recrystallization grains are made refined and the grain growth can be suppressed. Moreover, when a strain rate is increased, recrystallized grains are made refined. By increasing a rolling ratio and a strain rate, Co and P are maintained in a solid solution state at a lower temperature.

When the ingot is heated at a higher temperature in a temperature environment of 960° C. or lower and subjected to the hot rolling, a larger amount of Co, P and the like is subjected to solid solution, a larger amount of Co, P and the like is precipitated by the later precipitation heat treatment and the strength is increased by precipitation strengthening. However, grain sizes are increased. When a =grain size is greater than 70 μm, problems occur in bendability, ductility and high-temperature ductility. On the other hand, for example, when a heating temperature of the ingot is low and a grain size of the rolled material is less than 6 μm, high strength cannot be obtained because a sufficient solution heat-treated state is not obtained. In addition, strength at high temperatures and heat resistance are lowered. Accordingly, the upper limit of the grain size is equal to or less than 70 μm, preferably equal to or less than 55 μm, more preferably equal to or less than 50 μm, and most preferably equal to or less than 40 μm. The lower limit thereof is equal to or greater than 6 μm, preferably equal to or greater than 8 μm, more preferably equal to or greater than 10 μm, and most preferably equal to or greater than 12 μm.

As another way to express the hot rolling condition, the relationship between a grain and a hot rolling processing ratio can be prescribed as follows. That is, when a hot rolling processing ratio is denoted by RE0(%) (processing ratio: RE0=100×(1−(final thickness of sheet/thickness of ingot)) and a grain size after hot rolling is denoted by D μm, the expression $5.5\times(100/RE0)\leq D\leq 90\times(60/RE0)$ is satisfied, the expression $8\times(100/RE0)\leq D\leq 75\times(60/RE0)$ is preferably satisfied, and the expression $10\times(100/RE0)\leq D\leq 60\times(60/RE0)$ is most preferably satisfied. In the hot rolling of the invention alloy, when the hot rolling is performed in accordance with a predetermined rolling condition, at a processing ratio equal to or greater than about 60%, the coarse metal structure of an ingot is destroyed and changed into a recrystallized structure. In a stage immediately after the recrystallization, the grains are large. However, these become finer as the rolling process proceeds. From this relationship, the upper limit condition is that 90 μm is multiplied by (60/RE0) as a preferable range. On the other hand, the lower the processing ratio is, the larger the grains are. Therefore, the lower limit is that 5.5 μm is multiplied by (100/RE0). In addition, it is required that when a cross-section of the grain after the hot rolling taken along a rolling direction is observed, an average value of L1/L2 is 4.0 or less when a length in the rolling direction of the grain is denoted by L1 and a length in a direction perpendicular to the rolling direction of the grain is denoted by L2. That is, when a thickness of the hot-rolled material becomes smaller, the last half of the hot rolling may enter a warm rolling state and the grains may have a shape slightly extending in the rolling direction. The grains extending in the rolling direction do not have a large effect on ductility due to their low dislocation density. However, as a value of L1/L2 gets larger, the grains have an effect on ductility. Further, in the case of a thick sheet, a high cold rolling ratio cannot be employed and a heat treatment accompanied with the recrystallization is performed, and thus grains extending in a rolling direction basically remain and problems occur in strength, anisotropy of the characteristics, bendability and heat resistance. An average value of L1/L2 is preferably equal to or less than 2.5, and most preferably equal to or less than 1.5 including the case of a thick sheet of where a cold working ratio is equal to or less than 30%.

In the hot rolling process, it is particularly important whether, in the invention alloy, dynamic and static recrystallization can be achieved at a boundary temperature of about 750° C. within the range of 700° C. to 800° C. Although also depending on the hot rolling ratio, strain rate, composition and the like at that time, at temperatures higher than about 750° C., almost all the parts are recrystallized by the static and dynamic recrystallization, and at temperatures lower than about 750° C., a recrystallization ratio is lowered and the recrystallization hardly occurs at temperatures of 700° C. or lower. The boundary temperature also depends on the rolling ratio during the process, rolling rate, total content of Co and P and composition ratio. As the rolling ratio increases and as strong strains is applied in a short time, the boundary temperature moves to the low-temperature side. A decrease in boundary temperature causes Co, P and the like to be in a solid solution state at a lower temperature and causes precipitates in the subsequent precipitation heat treatment to be larger in amount and to be finer. In the case in which an ingot having a thickness of 150 to 250 mm is hot-rolled at about 900° C. and an average rolling ratio is set to 25%, when the thickness after the hot rolling is, for example, in the range of 25 to 40 mm, a final hot-rolling temperature is in the range of 770° C. to 850° C. and a recrystallized state of 90% or more can be obtained. In the case of a thick sheet, since cold rolling with a high rolling ratio cannot be industrially performed in the subsequent process, it is required that a larger amount of Co, P and the like is in a solid solution state by a cooling rate of 5° C./sec or greater after the heating before hot rolling or the hot rolling. Meanwhile, the balance with the grain size having an effect on the mechanical characteristics is important. When a rolling start temperature is high, the grain size after the hot rolling becomes larger and thus a rolling condition is determined in detail on the balance between the rolling start temperature and the grain size.

In the case of a thick sheet in which the thickness of a hot-rolled material is equal to or less than 25 mm, the temperature of the hot-rolled material is lower than a rolling start temperature by 100° C. or greater, and the smaller the thickness is, the more the temperature decrease is accelerated. When the thickness is in the range of 15 to 18 mm, the temperature is lowered by about 150° C. or greater. Further, a time required for rolling of one pass is about 20 seconds or more, and depending on conditions, about 50 seconds are required. In the hot-rolled material, from the point of view of temperature and time, the elements relating to the precipitation, corresponding to Co, P and the like, which are not in a solid solution state in the case of a conventional alloy, are in an industrially sufficient solid solution state in the case of the invention alloy. In addition, the solution heat-treated state can be maintained by forced shower cooling of 5° C./sec or greater after the hot rolling, as described later. One cause that lowers the solution heat sensitivity is that a small amount of Sn is contained in addition to Co, P and the like. In the case of a normal precipitation hardening type copper alloy, when the temperature of a final hot-rolled material is lower than a predetermined solution heat temperature by 100° C. or more and a period of time longer than 100 seconds is required for the hot rolling, the precipitation of the materials significantly proceeds and there remains almost no capacity to precipitate, which contributes to strength. As described above, even when a temperature decrease occurs during the hot rolling and it takes a long time to perform the hot rolling, the capacity to precipitate sufficiently remains in the invention alloy and thus the invention alloy is very different from conventional precipitation alloys.

In the cooling after the hot rolling, the solution heat sensitivity of the invention alloy is much lower than that of Cr—Zr copper or the like. Accordingly, for example, a cooling rate higher than 100° C./sec for preventing the precipitation during the cooling is not particularly required. However, when the materials are held for a long time in a high-temperature state after the hot rolling, the precipitation of coarse, precipitated grains of Co, P and the like not contributing to strength and the like proceeds, so it is preferable that a cooling operation is performed by an order of several degrees C./sec or tens of degrees C./sec after the hot rolling. In greater detail, an average cooling rate of the materials from 700° C. or from just after the rolling to a temperature range of 300° C. is equal to or higher than 2° C./sec, preferably equal to or higher than 3° C./sec, more preferably equal to or higher than 5° C./sec, and most preferably equal to or higher than 10° C./sec. Particularly, when it is difficult to perform cold rolling in the subsequent process as in the case of the thick sheet, the cooling rate is set to 5° C./sec or greater, and preferably 10° C./sec or greater to render a larger amount of Co and P subjected to solid solution, thereby precipitating a large amount of fine, precipitated grains by the precipitation heat treatment, and in this manner, high strength is obtained.

Next, hot rolling in the thin sheet manufacturing process will be described. When a thin sheet is manufactured, a final hot-rolled material is generally rolled into a thickness of 18 mm or less or 15 mm or less and thus a temperature decrease to about 700° C. to 750° C. or 700° C. or lower occurs. When the rolling is performed in a state of about 750° C. or lower, a recrystallization ratio is lowered, and at 700° C. or lower, the recrystallization hardly occurs during the hot rolling process and the rolling enters a warm rolling state. In this regard, the warm rolling is different from cold rolling and accompanied with a ductility recovery phenomenon and processing strain thereof is small. In this state, although precipitates are partially formed, less processing strain is imposed than in the case of cold rolling, so a precipitation rate of Co, P and the like is low and a large amount of Co, P and the like is in a solid solution state. It is preferable that the hot-rolled material is more rapidly cooled in order to be used as a thin sheet and a cooling rate of 2° C./sec or greater is required. In addition, since a metal structure of the material subjected to the hot rolling has an effect on the quality of the final product, it is preferable that the grains after the hot rolling are refined. In greater detail, the grains extend in a rolling direction in the warm rolling and a grain size is preferably in the range of 7 to 50 μm, and more preferably in the range of 7 to 40 μm.

During the thin sheet manufacturing process, conditions for the solution heat treatment are that the highest reached temperature is in the range of 820° C. to 960° C., a holding period of time from "the highest reached temperature−50° C." to the highest reached temperature is in the range of 2 to 180 seconds and the relationship of $90 \leq (Tmax-800) \times ts^{1/2} \leq 630$ is satisfied where the highest reached temperature is denoted by Tmax(° C.) and a holding period of time is denoted by ts(s). In the case of a thin sheet, it has a smaller thickness and a finer metal structure than those of an ingot. Accordingly, when the temperature is raised to 820° C. or higher, when a temperature increase during the heating is considered, the diffusion of Co, P and the like ends roughly in a short period of time of several seconds or tens of seconds. Accordingly, regarding solution heat-treating of Co, P and the like, the highest reached temperature is a more important condition than time. Regarding a grain size, the existence of precipitates of Co, P and the like, present in the metal structure or newly formed by this heat treatment, is important. Precipitates of Co, P and the like largely disappear during the heating in the heat treatment, but some of them are grown or newly formed so that an average grain diameter is about 20 nm, and suppress the growth of grains. The grains disappear when being exposed to a further high temperature, and grains become coarse although some time lagis caused. That is, regarding the disappearance of precipitates of Co, P and the like suppressing grains, both temperature and time are important. When considering the above-described content and a very short holding period of time, it can be said that a period of time during which holding is carried out from "the highest reached temperature−50° C." to the highest reached temperature is defined as the holding period of time. When the temperature is higher than the upper limit, grains become coarse, and when the temperature is lower than the lower limit, Co, P and the like are not sufficiently subjected to solid solution.

In this manner, when the solution heat treatment is performed under the proper condition in accordance with the above expression, for example, precipitates of Co, P and the like of about 20 nm, present at temperatures of 750° C. to 820° C. during the heating, suppress the grain growth, and when the temperature is raised to 820° C. or higher, these precipitates almost disappear and Co, P and the like are in a solid solution state. In addition, cooling is started at a stage of grain growth just before the coarsening of grains exceeding 50 μm or 70 μm. During this process, it is important that there are 20 nm (in diameter) precipitates of Co, P and the like suppressing the grain growth, which are present at temperatures slightly lower than 820° C., and different from fine precipitates of Co, P and the like contributing to strength, these precipitates disappear by controlling temperature and time, and in this manner, Co, P and the like can be in a solid solution state. A cooling rate is required to be high so that the Co and P in solid solution state are not precipitated. It is desirable that in the temperature range of 700° C. to 300° C., the cooling rate is adjusted to 5° C./sec, and preferably to 10° C./sec or greater to perform a cooling operation. In addition, a grain size after the solution heat treatment is in the range of 6 to 70 μm, preferably in the range of 7 to 50 μm, more preferably in the range of 7 to 30 μm, and most preferably in the range of 8 to 25 μm. In the invention alloy, due to the action of Co and P, the grain growth at high temperatures is less than in other copper alloys and thus grains do not become coarse even after the solution heat treatment. Due to the above-described range of a fine recrystallized grain size, not only strength is improved but also process limitation of bending work, a state of the surface subjected to the bending work and a state of the surface subjected to drawing work or press work are improved. The most suitable conditions for the solution heat treatment change somewhat in accordance with the additional amount of Co.

Conditions for the solution heat treatment are as follows if Co and P satisfy proper numerical expressions.

When the content of Co is in the range of 0.14 to 0.21 mass %, the most suitable conditions are that the highest reached temperature is in the range of 825° C. to 895° C., a holding period of time from "the highest reached temperature−50° C." to the highest reached temperature is in the range of 3 to 90 seconds and the relationship of $90 \leq Ita \leq 540$ is satisfied where the highest reached temperature is denoted by Tmax (° C.), a holding period of time is denoted by ts (s) and a heat treatment index Ita is equal to $(Tmax-800) \times ts^{1/2}$.

When the content of Co is in the range of 0.21 to 0.28 mass %, the most suitable conditions are that the highest reached temperature is in the range of 830° C. to 905° C., a holding period of time from "the highest reached temperature−50° C." to the highest reached temperature is in the range of 3 to 90 seconds and the relationship of $98 \leq Ita \leq 590$ is satisfied.

When the content of Co is in the range of 0.28 to 0.34 mass %, the most suitable conditions are that the highest reached temperature is in the range of 835° C. to 915° C., a holding period of time from "the highest reached temperature−50° C." to the highest reached temperature is in the range of 3 to 90 seconds and the relationship of $105 \leq Ita \leq 630$ is satisfied.

The larger the amount of Co, P and the like is, the slightly higher the temperature is, or the slightly longer the time is, that is required to achieve a sufficient solid solution state of Co, P and the like.

Even when a larger amount of Co, P and the like is subjected to solid solution by raising a temperature of the solution heat treatment and strength is increased by precipitating a large amount of precipitates in the subsequent precipitation heat treatment, when recrystallized grains in the solution heat-treating become coarse, bendability or ductility becomes worse, and when the size of the recrystallized grains is large, the effect obtained by the precipitation is offset also in terms of strength and thus the strength is not totally increased, and the resulting material is not suitable for connectors. Regarding the lower limit of the grain size, when an average grain size is less than 6 μm, the solution heat-treating of Co, P and the like and stress relaxation become worse, and the average grain size is preferably equal to or greater than 7 μm. That is, when comprehensively judging, from the mechanical properties of the invention alloy, a decrease in bendability or ductility and a decrease in strength by the coarsening of grains and the strengthening by the precipitation, it is preferable that the grain size is in the range of 7 to 30 μm as the above more preferable range. It is more preferable that the grain size is in the range of 8 to 25 μm. In the invention alloy, by adding Co, P and Sn, the grain growth at high temperatures can be suppressed. In addition, since the precipitation after heating is slow, Co, P and the like can be sufficiently subjected to solid solution in the high-temperature, short-time continuous heat treatment of the solution heat treatment. In a normal copper alloy, even for a short time, when a heating operation is performed for about 10 seconds at 820° C. or higher, particularly, 840° C. or higher, grains become rapidly larger, and thus it is difficult to obtain recrystallized grains of, for example, 30 μm or less. In the material after the solution heat treatment, since the matrix is completely recrystallized and precipitates hardly exist, ductility increases remarkably and little anisotropy is shown. Accordingly, the material after the solution heat treatment is excellent in formability and drawability including deep drawing and spinning. In addition, in accordance with a degree of drawing, the rolled material has sufficient formability if it is subjected to the rolling at a rolling ratio of 40% or less in the next cold rolling. When the heat-treated material and rolled material are shaped by drawing or the like and subjected to the precipitation heat treatment to be described later, work hardening is applied thereto by drawing or the like and thus they become high-strength and high-electrical conductivity materials.

Next, cold rolling will be described. A decrease in electrical conductivity by cold rolling is more markedly shown in the invention than in other copper alloys. For example, when a cold rolling ratio of the cold rolling after the precipitation heat treatment is increased, because the precipitated grains are small, the turbulence state of atoms in the vicinity of the precipitated grains has a bad effect on the electrical conductivity. In addition, because of the increasing number of vacancies, the electrical conductivity is lowered. In order to recover this, a subsequent precipitation heat treatment or a recovery heat treatment is required.

Next, a precipitation heat treatment will be described. In the invention alloy in a solution heat-treated state, a precipitation amount increases as the temperature is raised to a proper temperature and the length of time elapsed becomes longer. When the precipitates are fine and uniformly dispersed, the strength increases. When the invention alloy in a solution heat-treated state is cold-worked at a comparatively low rolling ratio (less than 40%, particularly less than 30%), a material having high strength and high electrical conductivity is obtained by the work hardening caused by the cold working and the precipitation of Co, P and the like caused by the precipitation heat treatment without particularly damaging ductility. In this stage, as a result of the cold working, a precipitation peak temperature at which fine precipitates of Co, P and the like are obtained moves to the low-temperature side due to easier diffusion than in the case in which the cold working is not performed. At this peak temperature, the heat resistance of the matrix of the invention alloy is high, and thus a softening and recovery phenomenon of the matrix occurs but the recrystallization does not occur.

When a material made through the thin sheet manufacturing process is solution heat-treated and then cold-worked at a high rolling ratio (for example, 40%, or 50% or more, particularly 65% or more), a softening phenomenon of the matrix in the precipitation heat treatment shifts to the low-temperature side and the recovery and the recrystallization occur. Further, since the diffusion easily occurs, the precipitation also moves to the low-temperature side. However, since the shift of the recrystallization temperature of the matrix to the low-temperature side is larger than in the above case, it is difficult to balance excellent strength, electrical conductivity and ductility. That is, when a precipitation heat treatment temperature is lower than a proper temperature condition to be described later, strength is ensured because of the work hardening by the cold working but ductility becomes worse. In addition, since the precipitation occurs only slightly, a precipitated and hardened amount is small, and since the precipitation is insufficiently performed, electrical conductivity is poor. When a precipitation heat treatment temperature is higher than the proper temperature condition to be described later, the recrystallization of the matrix proceeds, so excellent ductility is obtained but it is not possible to get the benefit of the work hardening by the cold working. In addition, since the precipitation proceeds, the maximum electrical conductivity is obtained, but as the recrystallization proceeds, precipitated grains are grown and thus a contribution to the strength becomes lower.

That is, the matrix is softened and recovered into a state just before the recrystallization or a partially recrystallized state, and the precipitation of Co, P and the like sufficiently proceeds so that high electrical conductivity is obtained. In these recrystallized grains, with a low dislocation density which are generated in the precipitation heat treatment are included. In terms of strength, a state in which the softening of the matrix and the hardening caused by the precipitation of Co, P and the like are offset and the softening of the matrix is slightly better is preferably achieved, that is, a level slightly lower than in a cold-worked state at a high rolling ratio is preferably retained. The state of the matrix is a metal structure state in which a recrystallization ratio is equal to or less than 40%, preferably equal to or less than 30%, and most preferably equal to or less than 20% from the state just before the recrystallization. Even when the recrystallization ratio is equal to or less than 20%, fine recrystallized grains are formed around the original grain boundaries and thus high ductility is obtained. Further, even when final cold working is performed after the precipitation heat treatment, high ductility is maintained. When the recrystallization ratio is greater than 40%, electrical conductivity and ductility are improved, but a high-strength material cannot be obtained due to the further softening of the matrix and the coarsening of the precipitates and stress relaxation properties also become worse. An average grain size of the recrystallization portion formed in the precipitation heat treatment is in the range of 0.7 to 7 μm, preferably in the range of 0.7 to 5.5 μm, and more preferably in the range of 0.7 to 4 μm.

Conditions for the precipitation heat treatment are as follows. Herein, when a heat treatment temperature is denoted by T (° C.), a holding period of time is denoted by th(h) and a cold rolling ratio is denoted by RE (%), a heat treatment index It1 is equal to $(T-100\times th^{-1/2}-110\times(1-RE/100)^{1/2})$. Basic conditions for the precipitation heat treatment are that the temperature is in the range of 400° C. to 555° C., the period of time is in the range of 1 to 24 hours and the relationship of $275\leq It1\leq 405$ is satisfied. In each manufacturing process, preferable precipitation heat treatments E1 to E4 are as follows.

Precipitation Heat Treatment E1: Normal conditions are used. Mainly, conditions for the case in which after hot rolling, cold rolling is not performed but a precipitation heat treatment is performed, or the case in which a precipitation heat treatment is performed just one time before or after cold rolling are used. The temperature is in the range of 400° C. to 555° C., the period of time is in the range of 1 to 24 hours and the relationship of $275\leq It1\leq 405$ is satisfied. When a rolling ratio is less than 50%, it is preferable that the temperature is in the range of 440° C. to 540° C., the period of time is in the range of 1 to 24 hours and the relationship of 315≤It1≤400 is satisfied. When the rolling ratio is equal to or greater than 50%, it is preferable that the temperature is in the range of 400° C. to 525° C., the period of time is in the range of 1 to 24 hours and the relationship of 300≤It1≤390 is satisfied. In the case of a thin sheet, as described above, a precipitation heat treatment considering the balance between strength, electrical conductivity and ductility is performed. In general, this heat treatment is performed by a batch system. These precipitation heat treatment conditions also relate to the solution heat-treated state of the hot rolling and the solid solution state of Co, P and the like. For example, the higher the cooling rate of the hot rolling is, and the higher the hot rolling end temperature is, the more the most preferable condition moves to the upper-limit side in the above inequality expression.

Precipitation Heat Treatment E2: A precipitation heat treatment primarily intended to obtain high strength and ensuring high conductivity is performed. Mainly, conditions for a precipitation heat treatment which is performed after cold rolling in the case in which the precipitation heat treatment is performed before or after the cold rolling are used. When a rolling ratio is less than 50%, the temperature is in the range of 440° C. to 540° C., the period of time is in the range of 1 to 24 hours and the relationship of 320≤It1≤400 is satisfied. When the rolling ratio is equal to or greater than 50%, the temperature is in the range of 400° C. to 520° C., the period of time is in the range of 1 to 24 hours and the relationship of 305≤It1≤395 is satisfied. In the case of a thin sheet, the balance between electrical conductivity and ductility is emphasized as well as strength. In general, the heat treatment is performed by a batch system.

Precipitation Heat Treatment E3: a heat treatment is performed at temperatures lower by 0 to 50° C. than those employed in a precipitation heat treatment through which the maximum strength is obtained. Since a precipitation amount is small, both strength and electrical conductivity are slightly low. In other words, since the capacity to precipitate remains and the precipitation proceeds when the next precipitation heat treatment E2 is carried out, higher electrical conductivity and strength are obtained. Mainly, conditions for a precipitation heat treatment which is performed before cold rolling in the case in which the precipitation heat treatment is performed before or after the cold rolling are used. When a rolling ratio is less than 50%, the temperature is in the range of 420° C. to 520° C., the period of time is in the range of 1 to 24 hours and the relationship of 300≤It1≤385 is satisfied. When the rolling ratio is equal to or greater than 50%, the temperature is in the range of 400° C. to 510° C., the time is in the range of 1 to 24 hours and the relationship of 285≤It1≤375 is satisfied. In general, a batch system is employed.

Precipitation Heat Treatment E4: Conditions for a high-temperature, short-time heat treatment which is performed in a so-called AP line (continuous annealing and pickling line) in place of the precipitation heat treatments E1, E2 and E3 when a thin sheet is manufactured are used. In a copper alloy of a solution heat-treating-aging type such as Cr—Zr copper, it is difficult to achieve sufficient precipitation without much recrystallization in the matrix in a short-time heat treatment such as a continuous heat treatment line or an AP line. Through this method, the cost is decreased, productivity is increased, the problem that thin plates stick to each other does not occur, and a thin sheet having excellent strain properties can be manufactured. In addition, productivity is increased when pickling facilities are juxtaposed. However, since a cooling operation is performed from a high temperature, electrical conductivity is slightly poorer than in the precipitation heat treatments E2 and E3. When the precipitation heat treatment is performed more than once, this method is suitable for the precipitation heat treatment other than the final precipitation heat treatment. The conditions are that the highest reached temperature is in the range of 540° C. to 760° C., a holding period of time from "the highest reached temperature−50° C." to the highest reached temperature is in the range of 0.1 to 25 minutes and the relationship of 330≤It2≤510 is satisfied where the highest reached temperature is denoted by Tmax(° C.), a holding period of time is denoted by tm(min), a cold rolling ratio is denoted by RE(%) and a heat treatment index It2 is equal to $(Tmax-100\times tm^{-1/2}-100\times(1-RE/100)^{1/2})$. Preferable conditions are that the highest reached temperature is in the range of 560° C. to 720° C., a holding period of time from "the highest reached temperature−50° C." to the highest reached temperature is in the range of 0.1 to 2 minutes and the relationship of 360≤It2≤490 is satisfied. Although also depending on a cold rolling ratio of the final cold rolling, when the matrix is partially recrystallized, it is preferable to satisfy the relationship of 370≤It2≤510. When a short-time precipitation heat treatment is performed at temperatures of 545° C. to 640° C. for 0.5 to 20 minutes or performed so as to satisfy the relationship of 345≤It2≤485, and most preferably, performed at temperatures of 555° C. to 615° C. for 1 to 12 minutes or performed so as to satisfy the relationship of 365≤It2≤465 in the above-described conditions, high electrical conductivity and high strength are obtained. In the case of a conventional precipitation type copper alloy, it is impossible to obtain high electrical conductivity and strength for a short time as described above. When a solution heat-treated or rolled material subjected to the above-described drawing or press forming is heat-treated through this precipitation heat treatment, it is possible to efficiently manufacture a member having high strength and high electrical conductivity in addition to the work hardening during the forming. Needless to say, when the precipitation heat treatment E3 in which a lot of time is spent is carried out, a member having higher electrical conductivity is manufactured. Regarding a rolling ratio RE(%) of a drawn material or the like, a rate of cross-section decrease by drawing may be considered to be the same as a rate of processing by rolling, that is, a rate of cross-section decrease, and the rate of cross-section decrease by drawing is added to the rolling ratio.

In a normal precipitation hardening type alloy, precipitates become coarse even for a short time when a heating period of time at temperatures of about 600° C. or 700° C. is long. When the heating period of time is short, precipitates of a target diameter or a target amount of precipitates are not obtained because the precipitation takes a long time, or formed precipitates disappear and are solid-soluted. A high-strength and high-electrical conductivity material cannot be obtained in this manner. The most suitable precipitation condition for a normal precipitation type alloy is that the precipitation is carried out for several hours or tens of hours. However, as in the invention, the precipitation heat treatment is performed for a short time of 0.1 to 25 minutes, and this is a big feature of the invention alloy.

When a precipitation heat treatment is performed, precipitated grains in a recrystallization portion become larger in addition to the formation of twin crystals as a feature of the recrystallization or the recrystallization of a copper alloy. As the precipitates grains become larger, the strengthening by the precipitation becomes smaller. That is, the contribution to strength is small. Basically, when the precipitates are precipitated, the grains are not decreased in size unless they are subjected to the solution heat treatment and the precipitation heat treatment. By prescribing a recrystallization ratio, the diameter of the precipitates can be controlled. When the precipitated grains are large, stress relaxation properties become worse.

The precipitates obtained by these precipitation heat treatments have a substantially circular or elliptical shape on a plane when a grain diameter is measured. The precipitates are fine precipitates having an average grain diameter of 1.5 to 9.0 nm, preferably 1.7 to 6.8 nm, more preferably 1.8 to 4.5 nm, and most preferably 1.8 to 3.2 nm, and, alternatively, 90% or more, preferably 95% or more of the precipitates are in the range of 0.7 to 15 nm, more preferably in the range of 0.7 to 10 nm, and 95% or more of the precipitates are most preferably in the range of 0.7 to 5 nm, and it is desirable that the fine precipitates are uniformly dispersed. Particularly, as in the case in which cold rolling is not carried out as in the case of a thick sheet, or even when the cold rolling is performed, a cold rolling ratio is about 30% or less, or as in the case in which a cold rolling ratio after the solution heat treatment of a thin sheet is about 30% or less, when the benefits of an improvement in strength by the work hardening are small, a high-strength material cannot be obtained unless the grain diameter of the precipitates is made fine in the precipitation heat treatment. In this case, it is required that a grain diameter of the precipitates is more preferably in the range of 1.8 to 4.5 nm, and most preferably in the range of 1.8 to 3.2 nm.

In the thin sheet manufacturing process, it is desirable that in the metal structure after cold rolling and a precipitation heat treatment, the matrix is not completely changed into a recrystallized structure and a recrystallization ratio thereof is in the range of 0 to 40% (preferably in the range of 0 to 30%, and more preferably in the range of 0 to 20%).

In a conventional copper alloy, when a high rolling ratio greater than, for example, 40% or 50% is employed, work hardening is caused by cold rolling and thus ductility becomes poor. In addition, when a metal structure is changed into a completely recrystallized structure by annealing or a heat treatment, it becomes soft and thus ductility is recovered. However, when non-recrystallized grains remain during the annealing, ductility is not sufficiently recovered, and when a ratio of the non-recrystallized grains exceeds 60%, ductility is particularly insufficient. On the other hand, in the case of the invention alloy, even when the ratio of the remaining non-recrystallized grains is 60% or more, and cold rolling and annealing leaving a non-recrystallized structure are repeatedly carried out, excellent ductility is obtained. In the case of the invention alloy, even when a heat treatment is performed under a temperature condition slightly lower than a temperature at which the recrystallization starts, and a material having a non-recrystallized metal structure is used, ductility of the matrix is recovered and the material of the invention alloy is characterized by having excellent ductility itself. When a recrystallized structure is included, ductility is further improved.

In order to further improve electrical conductivity, as well as in order to improve ductility, it is required to cause the recrystallization at a recrystallization ratio of 40% or less. When a precipitation heat treatment is performed twice, it is desirable to increase a recrystallization ratio in the first precipitation heat treatment. Even before the recrystallization, electrical conductivity is improved by finely precipitating Co, P and the like, but this improvement is insufficient. While coinciding with the start of the recrystallization, the precipitation further proceeds and electrical conductivity is thus markedly improved. It is desirable that electrical conductivity is increased in advance by increasing the recrystallization ratio in the first precipitation heat treatment, and in the second precipitation heat treatment, the fine precipitation of Co, P and the like causes electrical conductivity to be increased, as well as contributing to strength. When a recrystallization ratio in the final precipitation heat treatment is increased, the strength of a final product is lowered.

In the case of a thin sheet, it is basically required that after finishing cold rolling, a recovery heat treatment is carried out in the end. However, in the case of a thick sheet, when a precipitation heat treatment is a final process, when heat is applied to a final sheet by performing further soldering or brazing, and when a sheet is drawn or punched out into a product shape by pressing and then subjected to a recovery process or a precipitation heat treatment, a recovery heat treatment is not necessarily required. In addition, after a heat treatment such as brazing, a product may be subjected to a recovery heat treatment. The significance of the recovery heat treatment is as follows.

1. Bendability and ductility of a material are increased. Strains generated by cold rolling are reduced to a micro level and an elongation value is improved. These have an effect on local deformation caused by a bend test.

2. An elastic limit is increased and a longitudinal elasticity modulus is increased. As a result, spring properties required for connectors or the like are improved.

3. In a usage environment of temperatures near 100° C. for automobile applications, stress relaxation properties are improved. When the stress relaxation properties are poor, permanent deformation occurs during use and it becomes impossible to take advantage of predetermined strength and the like.

4. Electrical conductivity is improved. In a precipitation heat treatment before final rolling, fine precipitates as a substantial non-recrystallized structure are formed. As a result, electrical conductivity is decreased more markedly than in the case in which a material with a recrystallized structure is subjected to cold rolling. By the final rolling, the increasing number of micro-vacancies and the turbulence of atoms near fine precipitates of Co, P and the like cause electrical conductivity to be lowered. However, by this recovery heat treatment, an atomic-level change to a state approaching the preceding precipitation heat treatment occurs and thus electrical conductivity is improved. In addition, when a recrystallized material is cold-rolled at a rolling ratio of 40%, conductivity is decreased only by 1 to 2%. However, in the case of the invention in a non-recrystallized state, conductivity is lowered by 3 to 5%. By this process, 3 to 4% of conductivity is recovered and this improvement in conductivity is a pronounced effect in a high-electrical conductivity material.

5. Residual stress generated by cold rolling is released.

Conditions for the recovery heat treatment are that the highest reached temperature is in the range of 200° C. to 560° C., a holding period of time from "the highest reached temperature−50° C." to the highest reached temperature is in the range of 0.03 to 300 minutes and the relationship of $150 \leq It3 \leq 320$ is satisfied, and preferably the relationship of $175 \leq It3 \leq 295$ is satisfied where a rolling ratio of cold rolling after the precipitation heat treatment is denoted by RE2 and a heat treatment index It3 is equal to $(Tmax-60\times tm^{-1/2}-50\times(1-RE2/100)^{1/2})$. In this recovery heat treatment, the precipitation hardly occurs. By atomic-level movement, stress relaxation properties, electrical conductivity, spring properties and ductility are improved. When the upper limit of the precipitation heat treatment condition of the above inequality expression is not satisfied, the matrix is softened, and depending on circumstances, recrystallization starts and thus strength decreases. When recrystallization starts as described above, precipitated grains are grown and do not contribute to strength. When the lower limit is not satisfied, atomic-level movement is less and thus stress relaxation properties, electrical conductivity, spring properties and ductility are not improved.

A high-performance copper alloy rolled sheet obtained by this series of hot rolling processes has excellent electrical conductivity and strength and its conductivity is equal to or greater than 45% IACS. When conductivity is denoted by R(% IACS), tensile strength is denoted by S(N/mm$^2$) and elongation is denoted by L(%), a value of ($R^{1/2}\times S\times(100+L)/100$) (hereinafter, referred to as performance index "Is") is equal to or greater than 4300 and also may be equal to or greater than 4600. In addition, the high-performance copper alloy rolled sheet has excellent bendability and stress relaxation properties. Regarding characteristics thereof, a variation in characteristics in rolled sheets manufactured by the same ingot is small. The high-performance copper alloy rolled sheet has uniform mechanical properties and electrical conductivity, so that regarding tensile strength of a heat-treated material or a final sheet, (minimum tensile strength/maximum tensile strength) in rolled sheets manufactured by the same ingot is equal to or greater than 0.9, and regarding conductivity, (minimum conductivity/maximum conductivity) is equal to or greater than 0.9, and these values are preferably equal to or greater than 0.95.

In addition, since a high-performance copper alloy rolled sheet according to the invention has excellent heat resistance, tensile strength thereof at 400° C. is equal to or greater than 200(N/mm$^2$). The value 200 N/mm$^2$ roughly corresponds to that of a soft material of pure copper such as C1100 or C1220 at room temperature and is a high-level value. Vickers hardness (HV) after heating at 700° C. for 100 seconds is equal to or greater than 90 or is 80% or more of a value of Vickers hardness before the heating, and alternatively, a recrystallization ratio of a metal structure after heating is equal to or less than 40%.

In summary, in the case of a thick sheet, by a combination of composition and process, most of the Co, P and the like is solution heat-treated (solid solution) during a hot rolling process and thus a high-performance copper alloy rolled sheet of the invention is configured by recrystallized grains or grains with small strain. Next, a precipitation heat treatment is performed to finely precipitate Co, P and the like and thus high strength and high electrical conductivity are obtained. When a cold rolling process is added before the precipitation heat treatment, further higher strength is obtained by work hardening without damaging electrical conductivity. In a process for obtaining further higher electrical conductivity and strength, it is desirable that after hot rolling, a first precipitation heat treatment, cold rolling and a second precipitation heat treatment are performed. In addition, it is desirable that a period of time for a precipitation heat treatment is long or that a two-stage precipitation heat treatment is performed. In the former case, since a high cold rolling ratio cannot be employed in the thick sheet, Co, P and the like are precipitated by an initial heat treatment and a number of vacancies are created at an atomic level by cold rolling to achieve easy precipitation. When the precipitation heat treatment is performed again, even higher strength is obtained. When considering strength, it is desirable that the temperature of the first precipitation heat treatment is lower than the above-described calculation expression by 10° C. to 50° C. to save the capacity to precipitate.

In the case of a thin sheet, by subjecting a cold-rolled material to a high-temperature short-time heat treatment, Co, P and the like are subjected to solid solution, and by a combination of a precipitation heat treatment and cold rolling, high electrical conductivity and high strength can be obtained.

EXAMPLES

By using the above-described first to fifth invention alloys and copper alloys each having a composition for comparison, high-performance copper alloy rolled sheets were created. Table 1 shows compositions of alloys used to create the high-performance copper alloy rolled sheets.

TABLE 1

| | Alloy | Alloy Composition (mass %) | | | | | | | | | | | | | |
|---|---|---|---|---|---|---|---|---|---|---|---|---|---|---|---|
| | No. | Cu | Co | P | Sn | Ni | Fe | Al | Zn | Ag | Mg | Zr | X1 | X2 | X3 |
| First Invention Alloy | 11 | Rem. | 0.32 | 0.08 | 1.02 | | | | | | | | 4.41 | | |
| Second Invention Alloy | 21 | Rem. | 0.27 | 0.081 | 0.04 | | | | | | | | 3.65 | | |
| | 22 | Rem. | 0.19 | 0.058 | 0.03 | | | | | | | | 3.73 | | |
| Third Invention Alloy | 31 | Rem. | 0.25 | 0.069 | 0.62 | | | | | | | | 4.05 | | |
| Fourth Invention Alloy | 41 | Rem. | 0.23 | 0.082 | 0.02 | 0.07 | | | | | | | | 3.87 | 0.08 |
| | 42 | Rem. | 0.19 | 0.067 | 0.03 | 0.03 | 0.03 | | | | | | | 3.98 | 0.10 |
| | 43 | Rem. | 0.21 | 0.065 | 0.11 | | 0.02 | | | | | | | 3.89 | 0.04 |
| Fifth Invention Alloy | 51 | Rem. | 0.29 | 0.087 | 0.03 | | | 0.03 | | | 0.02 | | 3.63 | | |
| | 52 | Rem. | 0.24 | 0.068 | 0.03 | | | | 0.03 | | | 0.007 | 3.95 | | |
| | 53 | Rem. | 0.22 | 0.079 | 0.04 | 0.05 | 0.02 | | 0.04 | | | | | 3.86 | 0.10 |
| | 54 | Rem. | 0.19 | 0.077 | 0.43 | 0.08 | | | 0.13 | | | | | 3.69 | 0.10 |
| | 55 | Rem. | 0.27 | 0.073 | 0.48 | | | | 0.04 | | 0.01 | | 4.11 | | |
| | 56 | Rem. | 0.24 | 0.074 | 0.02 | 0.04 | | 0.02 | | | | 0.02 | | 4.11 | 0.05 |
| | 57 | Rem. | 0.26 | 0.076 | 0.03 | | | | | 0.1 | | | 3.78 | | |
| Comparative Alloy | 61 | Rem. | 0.12 | 0.05 | 0.03 | | | | | | | | 2.76 | | |
| | 62 | Rem. | 0.19 | 0.041 | 0.05 | | | | | | | | 5.72 | | |
| | 63 | Rem. | 0.25 | 0.065 | 0.001 | | | | | | | | 4.34 | | |
| | 64 | Rem. | 0.25 | 0.047 | 0.04 | | | | | | | | 6.39 | | |

TABLE 1-continued

| | Alloy | Alloy Composition (mass %) | | | | | | | | | | | | | |
|---|---|---|---|---|---|---|---|---|---|---|---|---|---|---|---|
| | No. | Cu | Co | P | Sn | Ni | Fe | Al | Zn | Ag | Mg | Zr | X1 | X2 | X3 |
| | 65 | Rem. | 0.16 | 0.08 | 0.05 | 0.16 | | | | | | | | 4.07 | 0.19 |
| | 66 | Rem. | 0.17 | 0.069 | 0.04 | | 0.12 | | | | | | | 4.22 | 0.24 |
| | 67 | Rem. | 0.26 | 0.071 | 1.7 | | | | | | | | 4.08 | | |
| | 68 | Rem. | 0.17 | 0.062 | 0.002 | 0.06 | | | | | | | | 4.04 | 0.07 |
| CrZr—Cu | 70 | Rem. | 0.85Cr—.08Zr | | | | | | | | | | | | |

X1 = ([Co] − 0.007)/([P] − 0.009)
X2 = ([Co] + 0.85[Ni] + 0.75[Fe] − 0.007)/([P] − 0.009)
X3 = 1.2[Ni] + 2[Fe]

As alloys, an alloy No. 11 as the first invention alloy, alloys No. 21 and 22 as the second invention alloy, an alloy No. 31 as the third invention alloy, alloys No. 41 to 43 as the fourth invention alloy, alloys No. 51 to 57 as the fifth invention alloy, alloys No. 61 to 68 as comparative alloys, each having a composition similar to that of the invention alloy and an alloy No. 70 as conventional Cr—Zr copper were prepared, and from an arbitrary alloy, high-performance copper alloy rolled sheets were created by several processes.

Tables 2 and 3 show conditions for a thick sheet manufacturing process and Tables 4 and 5 show conditions for a thin sheet manufacturing process. Following the processes of Table 2, the processes of Table 3 were performed. In addition, following the processes of Table 4, the processes of Table 5 were performed.

TABLE 2

| | | Process | Final Sheet Thickness mm | Hot Rolling Start Temperature ° C. | Hot Rolling Final Temperature ° C. | Hot Rolling Sheet Thickness mm | Cooling Method Shower Cooling: l/min | Cooling Rate ° C./sec | Solution Heat Treatment ° C.-Time (H) |
|---|---|---|---|---|---|---|---|---|---|
| Actual Machine Test | A | A1 | 25 | 905 | 820 | 25 | 3000 | 13 | |
| | | A2 | 25 | 880 | 800 | 25 | 3000 | 13 | |
| | | A3 | 25 | 925 | 835 | 25 | 3000 | 13 | |
| | | A4H | 25 | 810 | 740 | 25 | 3000 | 9 | |
| | | A5H | 25 | 965 | 860 | 25 | 3000 | 13 | |
| | | A6H | 25 | 905 | 820 | 25 | 200 | 1.8 | |
| | | A7 | 25 | 905 | 820 | 25 | 1000 | 6.5 | |
| | | A8H | 25 | 905 | 820 | 25 | 3000 | 13 | 900-1 |
| | | A9 | 40 | 895 | 840 | 40 | 3000 | 13 | |
| | | A10H | 25 | 905 | 820 | 25 | 3000 | 13 | |
| | | A11H | 25 | 905 | 820 | 25 | 3000 | 13 | |
| | | A12 | 15 | 915 | 725 | 15 | 3000 | 5.5 | |
| | | A13H | 15 | 840 | 660 | 15 | 3000 | 4 | |
| | B | B1 | 20 | 905 | 820 | 25 | 3000 | 13 | |
| | | B2 | 20 | 880 | 800 | 25 | 3000 | 13 | |
| | | B3 | 20 | 925 | 835 | 25 | 3000 | 13 | |
| | | B4H | 20 | 810 | 740 | 25 | 3000 | 9 | |
| | | B5H | 20 | 965 | 860 | 25 | 3000 | 13 | |
| | | B6H | 20 | 905 | 820 | 25 | 300 | 2 | |
| | C | C1 | 20 | 905 | 820 | 25 | 3000 | 13 | |
| | D | D1 | 20 | 905 | 820 | 25 | 3000 | 13 | |
| Laboratory Test | LA | LA1 | 12 | 910 | 800 | 12 | 10 | 12 | |
| | LB | LB1 | 9.6 | 910 | 800 | 12 | 10 | 12 | |

TABLE 3

| | | Process | Precipitation Heat Treatment ° C.-Time (H) | Precipitation Heat Treatment Heat Treatment Index It1 | Cold Rolling mm | Cold Rolling Red (%) | Precipitation Heat Treatment ° C.-Time (H) | Precipitation Heat Treatment Heat Treatment Index It1 |
|---|---|---|---|---|---|---|---|---|
| Actual Machine Test | A | A1 | | | | 0 | 500-8 | 354.6 |
| | | A2 | | | | 0 | 500-8 | 354.6 |
| | | A3 | | | | 0 | 500-8 | 354.6 |
| | | A4H | | | | 0 | 500-8 | 354.6 |
| | | A5H | | | | 0 | 500-8 | 354.6 |

TABLE 3-continued

| | | Process | Precipitation Heat Treatment ° C.-Time (H) | Precipitation Heat Treatment Heat Treatment Index It1 | Cold Rolling mm | Cold Rolling Red (%) | Precipitation Heat Treatment ° C.-Time (H) | Precipitation Heat Treatment Heat Treatment Index It1 |
|---|---|---|---|---|---|---|---|---|
| | | A6H | | | | 0 | 500-8 | 354.6 |
| | | A7 | | | | 0 | 500-8 | 354.6 |
| | | A8H | | | | 0 | 500-8 | 354.6 |
| | | A9 | | | | 0 | 500-8 | 354.6 |
| | | A10H | | | | 0 | 400-8 | 254.6 |
| | | A11H | | | | 0 | 555-8 | 409.6 |
| | | A12 | | | | 0 | 500-8 | 354.6 |
| | | A13H | | | | 0 | 500-8 | 354.6 |
| | B | B1 | | | 20 | 20 | 495-6 | 355.8 |
| | | B2 | | | 20 | 20 | 495-6 | 355.8 |
| | | B3 | | | 20 | 20 | 495-6 | 355.8 |
| | | B4H | | | 20 | 20 | 495-6 | 355.8 |
| | | B5H | | | 20 | 20 | 495-6 | 355.8 |
| | | B6H | | | 20 | 20 | 495-6 | 355.8 |
| | C | C1 | 500-8 | 354.6 | 20 | 20 | | |
| | D | D1 | 475-5 | 320.3 | 20 | 20 | 495-4 | 346.6 |
| Laboratory | LA | LA1 | | | | 0 | 500-8 | 354.6 |
| Test | LB | LB1 | | | 9.6 | 20 | 495-6 | 355.8 |

$It1 = (T - 100 \times th^{-1/2} - 110 \times (1 - RE/100)^{1/2})$ $275 \leq It1 \leq 405$

TABLE 4

| | | Process | Final Sheet Thickness mm | Hot Rolling Start Temperature ° C. | Hot Rolling Final Temperature ° C. | Hot Rolling Sheet Thickness mm | Cooling Rate ° C./sec | Cold Rolling mm | Recrystallization Heat Treatment ° C.-Time | Cold Rolling mm | Solution Heat Treatment ° C.-Time (min) | Solution Heat Treatment Heat Treatment Index Ita |
|---|---|---|---|---|---|---|---|---|---|---|---|---|
| Actual | H | H1 | 0.4 | 905 | 690 | 13 | 3 | 2.0 | | 0.8 | 865-0.3 | 275.8 |
| Machine | | H2H | 0.4 | 905 | 690 | 13 | 3 | 2.0 | | 0.8 | 805-1.8 | 52.0 |
| Test | | H3 | 0.4 | 905 | 690 | 13 | 3 | 2.0 | | 0.8 | 920-0.2 | 415.7 |
| | | H4H | 0.4 | 905 | 690 | 13 | 3 | 2.0 | | 0.8 | 920-0.6 | 720.0 |
| | I | I | 0.4 | 905 | 690 | 13 | 3 | 2.5 | 750-0.5 min | 0.8 | 900-0.2 | 346.4 |
| | J | J1 | 0.4 | 905 | 690 | 13 | 3 | 1.5 | | | 860-0.8 | 415.7 |
| | | J2 | 0.4 | 905 | 690 | 13 | 3 | 1.5 | | | 890-0.5 | 493.0 |
| | | J3H | 0.4 | 905 | 690 | 13 | 3 | 1.5 | | | 890-0.5 | 493.0 |
| | K | K0 | 0.4 | 905 | 690 | 13 | 3 | 2.0 | | | 860-0.8 | 415.7 |
| | | K1 | 0.4 | 905 | 690 | 13 | 3 | 2.0 | | | 860-0.8 | 415.7 |
| | | K2 | 0.4 | 905 | 690 | 13 | 3 | 2.0 | | | 860-0.8 | 415.7 |
| | | K3H | 0.4 | 905 | 690 | 13 | 3 | 2.0 | | | 860-0.8 | 415.7 |
| | | K4H | 0.4 | 905 | 690 | 13 | 3 | 2.0 | | | 860-0.8 | 415.7 |
| | M | M1 | 0.4 | 905 | 690 | 13 | 3 | 2.0 | | 0.9 | 880-0.4 | 391.9 |
| | | M2 | 0.4 | 905 | 690 | 13 | 3 | 2.0 | | 0.9 | 880-0.4 | 391.9 |
| Laboratory | H | LH | 0.36 | 910 | 695 | 8 | 4 | | | 0.7 | 865-0.3 | 275.8 |
| Test | J | LJ | 0.36 | 910 | 695 | 8 | 4 | 1.5 | | | 860-0.8 | 415.7 |

$Ita = (Tmax - 800) \times ts^{1/2}$ $90 \leq Ita \leq 630$

TABLE 5

| | | Process | Precipitation Heat Treatment ° C.-Time | Precipitation Heat Treatment Heat Treatment Index It1 | Precipitation Heat Treatment Heat Treatment Index It2 | Precipitation Heat Treatment Cold Rolling mm | Precipitation Heat Treatment Cold Rolling Red (%) | Precipitation Heat Treatment ° C.-Time | Precipitation Heat Treatment Heat Treatment Index It1 | Precipitation Heat Treatment Heat Treatment Index It2 | Precipitation Heat Treatment Cold Rolling mm | Precipitation Heat Treatment Cold Rolling Red (%) | Recovery Heat Treatment ° C.-Time (min) | Recovery Heat Treatment Heat Treatment Index It3 |
|---|---|---|---|---|---|---|---|---|---|---|---|---|---|---|
| Actual | H | H1 | 495-4 h | 335.0 | | 0.4 | 50.0 | | | | | | 460-0.2 | 290.5 |
| Machine | | H2H | 495-4 h | 335.0 | | 0.4 | 50.0 | | | | | | 460-0.2 | 290.5 |

TABLE 5-continued

| | | | Precipitation Heat Treatment | | | | | Precipitation Heat Treatment | | | | | Recovery Heat Treatment | |
|---|---|---|---|---|---|---|---|---|---|---|---|---|---|---|
| | | | | Heat Treatment Index | | Cold Rolling | | | Heat Treatment Index | | Cold Rolling | | | Heat Treatment |
| | | Process | ° C.-Time | It1 | It2 | mm | Red (%) | ° C.-Time | It1 | It2 | mm | Red (%) | ° C.-Time (min) | Index It3 |
| Test | | H3 | 495-4 h | 335.0 | | 0.4 | 50.0 | | | | | | 300-60 | 256.9 |
| | | H4H | 495-4 h | 335.0 | | 0.4 | 50.0 | | | | | | 460-0.2 | 290.5 |
| | I | I | 485-6 h | 334.2 | | 0.4 | 50.0 | | | | | | 460-0.2 | 290.5 |
| | J | J1 | | | | 0.8 | 46.7 | 475-4 h | 344.7 | | 0.4 | 50.0 | 460-0.2 | 290.5 |
| | | J2 | | | | 0.8 | 46.7 | 460-8 h | 344.3 | | 0.4 | 50.0 | 460-0.2 | 290.5 |
| | | J3H | | | | 0.8 | 46.7 | 460-8 h | 344.3 | | 0.4 | 50.0 | | |
| | K | K0 | 650-0.4 min | | 391.9 | 0.7 | 65.0 | 615-0.7 min | | 431.7 | 0.4 | 42.9 | 460-0.2 | 288.1 |
| | | K1 | 650-0.4 min | | 391.9 | 0.7 | 65.0 | 590-1.5 min | | 449.2 | 0.4 | 42.9 | 460-0.2 | 288.1 |
| | | K2 | 650-0.4 min | | 391.9 | 0.7 | 65.0 | 460-4 h | 344.9 | | 0.4 | 42.9 | 460-0.2 | 288.1 |
| | | K3H | 650-0.4 min | | 391.9 | 0.7 | 65.0 | 590-0.2 min | | 307.2 | 0.4 | 42.9 | 460-0.2 | 288.1 |
| | | K4H | 650-0.4 min | | 391.9 | 0.7 | 65.0 | 680-1.5 min | | 539.2 | 0.4 | 42.9 | 460-0.2 | 288.1 |
| | M | M1 | | | | | | 560-3.5 min | | 406.5 | 0.4 | 56.0 | 420-0.2 | 252.7 |
| | | M2 | | | | 0.6 | 33.0 | 580-1.8 min | | 423.6 | 0.4 | 33.0 | 420-0.2 | 244.9 |
| Lab | H | LH | 495-4 h | 335.0 | | 0.4 | 50 | | | | | | 460-0.2 | 290.5 |
| Test | J | LJ | | | | 0.8 | 46.7 | 460-8 h | 344.3 | | 0.4 | 50.0 | 460-0.2 | 290.5 |

$It1 = T - 100 \times th^{-1/2} - 110 \times (1 - RE/100)^{1/2}$ $275 \leq It1 \leq 405$ $It2 = Tmax - 100 \times tm^{-1/2} - 100 \times (1 - RE/100)^{1/2}$ $330 \leq It2 \leq 510$ $It3 = Tmax - 60 \times tm^{-1/2} - 50 \times (1 - RE2/100)^{1/2}$ $150 \leq It3 \leq 320$ The manufacturing process was performed by changing the condition in or out of the range of the manufacturing condition of the invention in the processes A to D and the processes H to M. In the tables, for each changed condition, a number was added after the symbol of the process so as to create a symbol such as A1 or A2. At this time, for the condition out of the range of the manufacturing condition of the invention, a symbol H was added after the number.

In the process A, a raw material was melted in a medium frequency melting furnace having an inner volume of 10 ton, so that an ingot, which was 190 mm thick and 630 mm wide in the cross-section, was prepared by semicontinuous casting. The ingot was cut into a 1.5 m length, heated at temperatures of 810° C. to 965° C. and hot-rolled into a thickness of 25 mm (for some ingots, 40 mm and 15 mm). In the hot rolling of the processes A to D, an average rolling ratio from the first to the fourth pass was about 10% and an average rolling ratio after the fifth pass was about 25%. In the cooling after the hot rolling, shower cooling was performed at 3000 l/min (for some ingots, 200 l/min and 1000 l/min). After the shower cooling, a heat treatment was performed at 500° C. (for some ingots, 400° C. and 555° C.) for 8 hours as the precipitation heat treatment E1. In the processes A4H and A5H, a hot rolling start temperature is out of the range, and in the processes A6H and A13H, a cooling rate after the hot rolling is out of the range. In the process A8H, a solution heat treatment is performed after the shower cooling. In the processes A10H and A11H, the precipitation heat treatment condition is out of the range.

The shower cooling was performed as follows. Shower facilities are provided at a position distant from a roller for hot rolling on a transport roller for transporting a rolled material in the hot rolling. When the final pass of the hot rolling ends, a rolled material is transported to the shower facilities by the transport roller and passes through a position at which a shower operation is performed so as to be sequentially cooled from the top end to the rear end. A cooling rate was measured as follows. A rear-end portion (accurately, a position of 90% of the length of a rolled material from the top end of the rolling in a longitudinal direction of the rolled material) of the rolled material at the final pass of the hot rolling was set as a measurement position of the temperature of the rolled material. The temperature measurement was performed just before the transport of the rolled material, in which the final pass had ended, to the shower facilities and at the time of the end of the shower cooling. On the basis of the temperatures measured at this time and a time interval in which the measurement was performed, a cooling rate was calculated. The temperature measurement was performed by a radiation thermometer. As the radiation thermometer, an infrared thermometer Fluke-574, manufactured by TAKACHIHO SEIKI CO., LTD, was used. Accordingly, an air-cooling state is applied until the rear end of the rolled material reaches the shower facilities and the rolled material is exposed to shower water. Consequently, a cooling rate at that time is low. In addition, the smaller the thickness of the final sheet is, the more time is consumed to reach the shower facilities, and thus the cooling rate becomes low. A test piece to be described later, which is used to examine all the characteristics, is the rear end portion of the hot-rolled material and collected from a site corresponding to the rear end portion of the shower cooling.

In the process B, casting and cutting were performed in the same manner as in the process A. Heating at temperatures of 810° C. to 965° C. and hot rolling into a thickness of 25 mm were performed and then shower cooling was performed at 3000 l/min (for some ingots, 300 l/min). After that, pickling was performed and cold rolling into a thickness of 20 mm was performed. After the cold rolling, a heat treatment was performed at 495° C. for 6 hours as the precipitation heat treatment E1. In the processes B4H and B5H, a hot rolling start temperature is out of the range, and in the process B6H, a cooling rate after the hot rolling is out of the range.

In the process C, C1, the process advanced to the precipitation heat treatment E1 under the same condition as in the process A1 and then cold rolling into a thickness of 20 mm was performed.

In the process D, D1, casting and cutting were performed in the same manner as in the process A. Heating at 905° C. and hot rolling into a thickness of 25 mm were performed and then shower cooling was performed at 3000 l/min. After that, pickling was performed and a heat treatment was performed at 475° C. for 5 hours as the precipitation heat treatment E3. Then, cold rolling into a thickness of 20 mm was performed. After the cold rolling, a heat treatment was performed at 495° C. for 4 hours as the precipitation heat treatment E2.

As a laboratory test, the process LA1 based on the manufacturing process A was performed as follows. From the ingot of the manufacturing process A, a laboratory test ingot having a thickness of 40 mm, a width of 80 mm and a length of 190 mm was cut out. In addition, an ingot was prepared with predetermined components for the laboratory test by melting in an electrical furnace, casting into a mold having a thickness of 50 mm, a width of 85 mm and a length of 190 mm and then facing into a laboratory test ingot having a thickness of 40 mm, a width of 80 mm and a length of 190 mm. The laboratory test ingot was heated at 910° C., hot-rolled into a thickness of 12 mm by a hot rolling mill for the test and then cooled by shower cooling (10 l/min). After the cooling, a heat treatment was performed at 500° C. for 8 hours as the precipitation heat treatment E1. Further, as a laboratory test, the process LB1 based on the manufacturing process B was performed as follows. The process advanced to shower cooling in the same manner as in the process LA1, and after the shower cooling, pickling and cold rolling into a thickness of 9.6 mm were performed. After the cold rolling, a heat treatment was performed at 495° C. for 6 hours as the precipitation heat treatment E1.

In the manufacturing process H, casting was performed in the same manner as in the manufacturing process A. An ingot was heated at 905° C. and hot-rolled into a thickness of 13 mm. After the hot rolling, shower cooling was performed at 3000 l/min. After the shower cooling, both sides were faced by 0.5 mm from the surface and cold rolling into a thickness of 2 mm was performed. Then, further cold rolling into a thickness of 0.8 mm was performed and then a solution heat treatment was performed by the AP line at a changed temperature condition. After that, a heat treatment was performed at 495° C. for 4 hours as the precipitation heat treatment E1. After the precipitation heat treatment E1, cold rolling into a thickness of 0.4 mm and a recovery heat treatment were performed. As the recovery heat treatment, a heat treatment in which the highest reached temperature is 460° C. and a holding period of time from "the highest reached temperature−50° C." to the highest reached temperature is 0.2 minutes was performed by the AP line. However, some ingots were heat-treated at 300° C. for 60 minutes by a batch furnace. Including the case of the manufacturing process I to be described later, a cooling rate from 700° C. to 300° C. in the solution heat treatment performed by the AP line was about 20° C./sec. In the process H2H, the highest reached temperature of the solution heat treatment is lower than the condition range, and in the process H4H, a heat treatment index Ita is greater than the condition range.

In the manufacturing process I, facing was performed in the same manner as in the manufacturing process H and then cold rolling into a thickness of 2.5 mm was performed. By an AP line, recrystallization annealing was performed at 750° C. for 0.5 minutes and then cold rolling into a thickness of 0.8 mm was performed. After the cold rolling, a solution heat treatment was performed at 900° C. for 0.2 minutes by an AP line and a heat treatment was performed at 485° C. for 6 hours as the precipitation heat treatment E1. After the precipitation heat treatment E1, cold rolling into a thickness of 0.4 mm was performed and a recovery heat treatment was performed at 460° C. for 0.2 minutes by an AP line.

In the manufacturing process J, facing was performed in the same manner as in the manufacturing process H and then cold rolling into a thickness of 1.5 mm was performed. By an AP line, a solution heat treatment was performed at a changed temperature condition. In addition, including the case of the manufacturing process K to be described later, a cooling rate from 700° C. to 300° C. in the solution heat treatment performed by an AP line was about 15° C./sec. After that, cold rolling into a thickness of 0.8 mm was performed and the precipitation heat treatment E1 was performed under the changed condition. After the precipitation heat treatment E1, cold rolling into a thickness of 0.4 mm was performed and a recovery heat treatment was performed, but some ingots were not subjected to the recovery heat treatment. The recovery heat treatment was performed at 460° C. for 0.2 minutes by an AP line. In the process J3H, the recovery heat treatment is not performed.

In the manufacturing process K, facing was performed in the same manner as in the manufacturing process H and then cold rolling into a thickness of 2.0 mm was performed. By an AP line, a solution heat treatment was performed at 860° C. for 0.8 minutes, and by an AP line, the precipitation heat treatment E4 was performed at 650° C. for 0.4 minutes. After that, cold rolling into a thickness of 0.7 mm was performed, and then the precipitation heat treatment E2 was performed at 460° C. for 4 hours by a batch furnace or the precipitation heat treatment E4 was performed by an AP line under various conditions. Then, cold rolling into a thickness of 0.4 mm was performed and a recovery heat treatment was performed at 460° C. for 0.2 minutes by an AP line.

Different from the process J in which the precipitation heat treatment is performed by a batch furnace, in the manufacturing process M, the precipitation heat treatment is performed by an AP line. In the manufacturing process M, cold rolling into a thickness of 2.0 mm was performed in the same manner as in the manufacturing process K and then further cold rolling into a thickness of 0.9 mm was performed. In addition, a solution heat treatment was performed at 880° C. for 0.4 minutes by an AP line. After the solution heat treatment, some ingots were subjected to the precipitation heat treatment E4 at 560° C. for 3.5 minutes by an AP line. After that, cold rolling into a thickness of 0.4 mm was performed and a recovery heat treatment was performed at 460° C. for 0.2 minutes by an AP line (process M1). After the solution heat treatment, other ingots were cold-rolled to 0.6 mm and subjected to the precipitation heat treatment E4 at 580° C. for 1.8 minutes by an AP line. Then, cold rolling into a thickness of 0.4 mm was performed and a recovery heat treatment was performed at 460° C. for 0.2 minutes by an AP line (process M2).

In addition, the processes LH and LJ based on the manufacturing processes H and J were performed as laboratory tests. In each of the processes, the process advanced to shower cooling in the same manner as in the process LA1. In the laboratory test, a process corresponding to a short-time solution heat treatment of an AP line or the like or a process corresponding to a short-time precipitation heat treatment or recovery heat treatment was substituted by dipping of a rolled material in a salt bath. A solution temperature of the salt bath was considered as the highest reached temperature and a dipping period of time was considered as the holding period of time. Air cooling was performed after the dipping. As the salt (solution), a mixture of BaCl, KCl and NaCl was used.

As an evaluation of the high-performance copper alloy rolled sheets prepared by the above-described methods, tensile strength, Vickers hardness, elongation, bendability, stress relaxation, conductivity, heat resistance and 400° C. high-temperature tensile strength were measured. In addition, by observing a metal structure, an average grain size and a recrystallization ratio were measured. In addition, a diameter of precipitates and a ratio of precipitates of which the length of a diameter is equal to or less than a predetermined value were measured.

Tensile strength was measured as follows. The shape of a test piece was based on JIS Z 2201. When a sheet thickness was 40 mm or 25 mm, the measurement was performed with a No. 1A test piece, and when a sheet thickness was 20 mm or 2.0 mm or less, the measurement was performed with a No. 5 test piece.

A bending test (W bending, 180-degree bending) was performed as follows. When a thickness was equal to or greater than 2 mm, 180-degree bending was carried out. A bending radius was one time (1 t) the thickness of the material. When a thickness was 0.4 mm or 0.5 mm, the evaluation was performed by W bending provided by JIS. R of the R portion was the thickness of the material. The sample was carried out in a direction, referred to as a so-called Bad Way, perpendicular to the rolling direction. Regarding determination, no cracks was evaluation A, crack formation or small cracks not causing destruction was evaluation B, and crack formation or destruction was evaluation C.

A stress relaxation test was performed as follows. In the stress relaxation test of a test material, a cantilever screw jig was used. The shape of a test piece had a size of sheet thickness t×width 10 mm×length 60 mm. Load stress to a test material was 80% of 0.2% proof stress and exposure to an atmosphere of 150° C. for 1000 hours was carried out. A stress-relaxation rate was obtained by the following expression:

Stress relaxation rate=(displacement after relief/displacement at the time of stress loading)×100(%)

A stress-relaxation rate equal to or less than 25% was evaluation A (excellent), a stress-relaxation rate greater than 25% and equal to or less than 35% was evaluation B (acceptable), and a stress-relaxation rate greater than 35% was evaluation C (unacceptable).

Conductivity was measured by using a conductivity measurement device (SIGMATEST D2.068), manufactured by FORESTER JAPAN Limited. In this specification, the expression "electrical conduction" and the expression "conductive" are used as the same meaning. Since heat conductivity is significantly associated with electrical conductivity, it can be said that the higher the conductivity is, the better the heat conductivity is.

Regarding heat resistance, a material cut into a size of sheet thickness×20 mm×20 mm was dipped in a salt bath of 700° C. (a mixture in which NaCl and $CaCl_2$ were mixed at about 3:2) for 100 seconds and then cooled. Then, Vickers hardness and conductivity were measured. The aforesaid condition where holding is carried out at 700° C. for 100 seconds is roughly coincident with a condition of manual brazing when a brazing filler material Bag-7 is used.

400° C. high-temperature tensile strength was measured as follows. After holding at 400° C. for 30 minutes, a high-temperature tensile test was performed. A gage length was 50 mm and a test part was worked with a lathe to have an external diameter of 10 mm.

An average grain size was measured by using a metal microscope photograph on the basis of a comparison method of an wrought copper product grain size test method in JIS H 0501. In the case of a hot-rolled material in which an average value of L1/L2 exceeds 2, the measurement was performed by using a metal microscope photograph on the basis of a quadrature method of the wrought copper product grain size test method in JIS H 0501.

The measurement of an average grain size and a recrystallization ratio was performed by selecting a magnification depending on the grain sizes in 500-, 200- and 100-fold metal microscope photographs. Basically, an average recrystallized grain size was measured by a comparison method. In the measurement of a recrystallization ratio, classification into non-recrystallized grains and recrystallized grains was carried out, a recrystallization portion was binarized by an image analysis software "WinROOF" and an area ratio thereof was set as a recrystallization ratio. When an average grain size was small, for example, about 0.003 mm or less, that is, when it was difficult to make a judgment from a metallograph, the measurement was performed by an electron back scattering diffraction pattern (FE-SEM-EBSP) method. From a grain boundary map of a 2000- or 5000-fold magnification, grains made of grain boundaries having an orientation difference of 15° or more were marked by a pen and the marked portion was binarized by an image analysis software "WinROOF". Regarding a measurement position, two positions, that is, one point deep from the front side surface and the other from the back side surface, the depth of which is one-fourth length of the sheet thickness each, were set and the measured values at the two points were averaged. In addition, in a hot-rolled material, when a metal structure was observed in the cross-section of the grain taken along a rolling direction, a length L1 in the rolling direction of the grain and a length L2 in a direction perpendicular to the rolling direction of the grain were measured to obtain a value of L1/L2 in each of arbitrary 20 grains, and an average value thereof was calculated.

An average grain diameter of precipitates was obtained as follows. In 750,000-fold and 150,000-fold transmission electron images (detection limits were 0.7 nm and 3.0 nm, respectively) obtained by TEM, the contrast of precipitates was elliptically approximated by using an image analysis software "WinROOF" and a geometric mean value of the long axis and the short axis was obtained in each of all the precipitated grains in the field of view. An average value thereof was set an average grain diameter. In the 750,000-fold and 150,000-fold measurement, detection limits of the grain diameter were 0.7 nm and 3.0 nm, respectively. Grains having a diameter less than the limits were handled as noise and these were not included in the calculation of the average grain diameter. In addition, grains having an average grain diameter equal to or less than 6 to 8 nm, which is to be considered as a boundary diameter, were measured at 750,000 folds and grains having an average grain diameter equal to or greater than the boundary diameter were measured at 150,000 folds. In the case of a transmission electron microscope, it is difficult to accurately recognize the information of precipitates because a dislocation density is high in a cold-worked material. The diameter of precipitates does not change by the cold working. Accordingly, in the case of a thick sheet, the observation was carried out in a stage after the precipitation heat treatment where no cold working was performed, and in the case of a thin sheet, the observation was carried out in a recrystallization portion after the precipitation heat treatment and before the final cold working. Regarding a measurement position, two positions, that is, one point deep from the front side surface and the other from the back side surface, the depth of which is one-fourth length of the sheet thickness each, were set and the measured values at the two points were averaged.

Results of the above-described tests will be described. Tables 6 and 7 show results of the process Al of the thick sheets. In some cases, a tested sample in a table may be referred to with a different test No. in the other tables of test results to be described later (for example, the test sample No. 1 of Tables 6 and 7 is the same as the sample No. 1 of Tables 20 and 21).

TABLE 6

| Test No. | Alloy No. | Process | Final Sheet Thickness mm | After Hot Rolling Grain Size μm | After Hot Rolling Recrystallization Ratio % | After Hot Rolling L1/L2 | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|---|
| 1 | 21 | A1 | 25 | 20 | 98 | 1.0 | | | | 2.4 | 99 | 100 |
| 2 | 41 | A1 | 25 | 20 | 99 | 1.0 | | | | 2.6 | 98 | 100 |
| 3 | 51 | A1 | 25 | 20 | 98 | 1.0 | | | | 2.4 | 98 | 99 |
| 4 | 52 | A1 | 25 | 20 | 98 | 1.0 | | | | 2.5 | 97 | 99 |
| 5 | 53 | A1 | 25 | 20 | 98 | | | | | 2.3 | 98 | 98 |
| 6 | 61 | A1 | 25 | 100 | 100 | | | | | 21 | | 10 |
| 7 | 62 | A1 | 25 | 90 | 100 | | | | | 22 | | 15 |
| 8 | 63 | A1 | 25 | 55 | 100 | | | | | 10 | | 83 |
| 9 | 64 | A1 | 25 | 80 | 100 | | | | | 16 | | 45 |

TABLE 7

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | A1 | 395 | 111 | 47 | A | | 78 | 5128 | 102 | | 73 | 245 |
| 2 | 41 | A1 | 393 | 109 | 47 | A | | 77 | 5069 | 100 | | 72 | 237 |
| 3 | 51 | A1 | 403 | 113 | 46 | A | | 78 | 5196 | 104 | | 72 | 251 |
| 4 | 52 | A1 | 378 | 108 | 46 | A | | 80 | 4936 | 98 | | 74 | 227 |
| 5 | 53 | A1 | 395 | 111 | 45 | A | | 76 | 4993 | 103 | | 70 | 242 |
| 6 | 61 | A1 | 301 | 82 | 42 | B | | 74 | 3677 | 56 | | 65 | 127 |
| 7 | 62 | A1 | 289 | 77 | 42 | B | | 73 | 3506 | 55 | | 62 | 117 |
| 8 | 63 | A1 | 341 | 101 | 41 | A | | 78 | 4246 | 78 | | 68 | 172 |
| 9 | 64 | A1 | 318 | 89 | 41 | B | | 71 | 3778 | 58 | | 60 | 141 |

In the case of the invention alloy, the grain after the hot rolling is about 20 μm and is equal to or less than half that of the comparative alloy and the grain diameter of precipitates is one severalth of that of the comparative alloy. The invention alloy is more excellent than the comparative alloy in terms of tensile strength, Vickers hardness, elongation and bendability. In addition, the invention alloy has slightly higher conductivity than that of the comparative alloy. The performance index of the invention alloy is equal to or greater than 4900 and is more excellent than that of the comparative alloy whose performance index is equal to or less than 4300. The invention alloy is even more excellent than the comparative alloy in terms of Vickers hardness of heat resistance of 700° C., conductivity and tensile strength at 400° C.

Tables 8 and 9 show results of the process LA1 of the laboratory test of the alloys.

TABLE 8

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | LA1 | 12 | 30 | 100 | | | | 2.5 | 98 | 99 |
| 2 | 22 | LA1 | 12 | 35 | 100 | | | | 2.7 | 97 | 98 |
| 3 | 41 | LA1 | 12 | 30 | 100 | | | | 2.5 | 98 | 99 |
| 4 | 42 | LA1 | 12 | 30 | 100 | | | | 2.6 | 97 | 99 |
| 5 | 43 | LA1 | 12 | 30 | 100 | | | | 2.5 | 98 | 99 |
| 6 | 51 | LA1 | 12 | 30 | 100 | | | | 2.3 | 98 | 100 |
| 7 | 52 | LA1 | 12 | 30 | 100 | | | | 2.5 | 98 | 99 |
| 8 | 53 | LA1 | 12 | 30 | | | | | 2.4 | 98 | 99 |
| 9 | 55 | LA1 | 12 | 30 | | | | | 2.7 | 98 | 100 |
| 10 | 56 | LA1 | 12 | 30 | | | | | 2.4 | 99 | 99 |

TABLE 8-continued

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 11 | 57 | LA1 | 12 | 30 | | | | | 2.3 | 99 | 100 |
| 12 | 61 | LA1 | 12 | 100 | | | | | | | |
| 13 | 62 | LA1 | 12 | 110 | | | | | | | |
| 14 | 63 | LA1 | 12 | 70 | 100 | | | | 10 | | 83 |
| 15 | 64 | LA1 | 12 | 85 | 100 | | | | | | |
| 16 | 65 | LA1 | 12 | 65 | | | | | 9.5 | | 84 |
| 17 | 66 | LA1 | 12 | 60 | | | | | 9 | | 82 |
| 18 | 68 | LA1 | 12 | 65 | 100 | | | | 11 | | 82 |

TABLE 9

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | LA1 | 397 | 112 | 44 | A | | 78 | 5049 | 102 | | 73 | 235 |
| 2 | 22 | LA1 | 368 | 105 | 40 | A | | 82 | 4665 | 94 | | 75 | 226 |
| 3 | 41 | LA1 | 399 | 112 | 43 | A | | 78 | 5039 | 102 | | 73 | 245 |
| 4 | 42 | LA1 | 383 | 108 | 41 | A | | 79 | 4800 | 99 | | 72 | 227 |
| 5 | 43 | LA1 | 388 | 109 | 40 | A | | 74 | 4673 | 100 | | 67 | 234 |
| 6 | 51 | LA1 | 406 | 114 | 43 | A | | 78 | 5128 | 105 | | 71 | 255 |
| 7 | 52 | LA1 | 381 | 107 | 41 | A | | 79 | 4775 | 102 | | 73 | 245 |
| 8 | 53 | LA1 | 400 | 113 | 42 | A | | 76 | 4952 | 104 | | 69 | 243 |
| 9 | 55 | LA1 | 408 | 110 | 40 | A | | 66 | 4640 | 101 | | 60 | 245 |
| 10 | 56 | LA1 | 392 | 111 | 42 | A | | 78 | 4916 | 103 | | 72 | 238 |
| 11 | 57 | LA1 | 413 | 116 | 41 | A | | 77 | 5110 | 109 | | 71 | 252 |
| 12 | 61 | LA1 | 302 | 83 | 39 | B | | 74 | 3611 | 57 | | 64 | 125 |
| 13 | 62 | LA1 | 291 | 77 | 38 | B | | 73 | 3431 | | | | |
| 14 | 63 | LA1 | 343 | 102 | 39 | B | | 79 | 4238 | 79 | | 68 | 169 |
| 15 | 64 | LA1 | 320 | 90 | 38 | B | | 71 | 3721 | | | | |
| 16 | 65 | LA1 | 347 | 101 | 39 | A | | 74 | 4149 | 78 | | 67 | 173 |
| 17 | 66 | LA1 | 362 | 103 | 29 | C | | 71 | 3935 | 87 | | 58 | 192 |
| 18 | 68 | LA1 | 339 | 99 | 39 | A | | 80 | 4215 | 77 | | 67 | 166 |

In the case of the invention alloy, the grain size after the hot rolling is about 30 μm, and in the case of the comparative alloy, the grain size after the hot rolling is in the range of 60 to 110 μm. As in the actual machine test, the grain size after the hot rolling is smaller in the invention alloy than in the comparative alloy. In addition, even in the process LA1 of the laboratory test, mechanical properties such as strength and conductivity are more excellent in the invention alloy than in the comparative alloy as in the process A1 of the actual machine test.

Tables 10 and 11 show results of the process B1 of the thick alloy sheets and results of the process LB1 of the laboratory test of the invention alloys.

TABLE 10

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | B1 | 20 | 20 | 98 | | | | | | |
| 2 | 41 | B1 | 20 | 20 | 97 | | | | | | |
| 3 | 51 | B1 | 20 | 20 | 98 | | | | | | |
| 4 | 52 | B1 | 20 | 20 | 98 | | | | | | |

TABLE 10-continued

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 5 | 53 | B1 | 20 | 20 | 98 | | | | | | |
| 6 | 61 | B1 | 20 | 100 | 100 | | | | | | |
| 7 | 62 | B1 | 20 | 90 | 100 | | | | | | |
| 8 | 21 | LB1 | 9.6 | 30 | | | | | | | |
| 9 | 41 | LB1 | 9.6 | 30 | | | | | | | |
| 10 | 56 | LB1 | 9.6 | 30 | | | | | | | |
| 11 | 57 | LB1 | 9.6 | 30 | | | | | | | |

TABLE 11

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | B1 | 435 | 132 | 33 | A | | 79 | 5142 | 119 | 5 | 73 | 286 |
| 2 | 41 | B1 | 434 | 129 | 33 | A | | 79 | 5130 | 116 | 5 | 72 | 269 |
| 3 | 51 | B1 | 450 | 135 | 31 | A | | 79 | 5240 | 123 | 0 | 72 | 287 |
| 4 | 52 | B1 | 420 | 125 | 32 | A | | 81 | 4990 | 114 | | 74 | 254 |
| 5 | 53 | B1 | 440 | 135 | 32 | A | | 76 | 5063 | 119 | 5 | 70 | 277 |
| 6 | 61 | B1 | 344 | 97 | 30 | B | | 73 | 3821 | 55 | 95 | 66 | |
| 7 | 62 | B1 | 335 | 96 | 33 | B | | 72 | 3781 | 53 | 100 | 63 | |
| 8 | 21 | LB1 | 437 | 132 | 32 | A | | 78 | 5095 | 119 | | 73 | 286 |
| 9 | 41 | LB1 | 440 | 132 | 32 | A | | 78 | 5129 | 119 | | 73 | 286 |
| 10 | 56 | LB1 | 433 | 125 | 32 | A | | 77 | 5015 | 112 | | 72 | 257 |
| 11 | 57 | LB1 | 449 | 131 | 30 | A | | 76 | 5089 | 121 | | 71 | 276 |

In the process B1, the grain size after the hot rolling and the mechanical properties are more excellent in the invention alloy than in the comparative alloy as in the process A1. The invention alloy of the process B1 has more excellent tensile strength and Vickers hardness than the invention alloy of the process A1, but is poorer than the invention alloy of the process A1 in terms of elongation. In addition, the invention alloy is excellent in Vickers hardness of heat resistance with respect to the heating at 700° C. for 100 seconds and tensile strength at 400° C. In the invention alloy, a recrystallization ratio of the metal structure after the heating at 700° C. for 100 seconds was equal to or less than 10%. In the comparative alloy, a recrystallization ratio was equal to or greater than 95%.

Tables 12 and 13 show results of the process H1 of the thin alloy sheets.

TABLE 12

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | H1 | 0.4 | | | 10 | | | 3 | | 99 |
| 2 | 31 | H1 | 0.4 | 15 | 10 | 12 | | | 3.1 | | 99 |
| 3 | 41 | H1 | 0.4 | | | 10 | | | 2.8 | | 99 |
| 4 | 51 | H1 | 0.4 | | | 10 | | | 3 | | 99 |
| 5 | 52 | H1 | 0.4 | | | 12 | | | 3.1 | | 99 |
| 6 | 53 | H1 | 0.4 | | | 10 | | | 2.9 | | 98 |
| 7 | 54 | H1 | 0.4 | 15 | 10 | 12 | | | 3.1 | | 99 |
| 8 | 61 | H1 | 0.4 | | | 90 | | | 23 | | 5 |
| 9 | 62 | H1 | 0.4 | | | 100 | | | 21 | | 10 |
| 10 | 63 | H1 | 0.4 | | | 60 | | | 10 | | 84 |

TABLE 12-continued

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 11 | 64 | H1 | 0.4 | | | 80 | | | 13 | | 60 |
| 12 | 70 | H1 | 0.4 | | | 25 | | | | | |

TABLE 13

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | H1 | 520 | 163 | 10 | A | A | 78 | 5052 | | | | |
| 2 | 31 | H1 | 566 | 174 | 9 | A | A | 61 | 4818 | | | | |
| 3 | 41 | H1 | 525 | 164 | 10 | A | A | 79 | 5133 | | | | |
| 4 | 51 | H1 | 527 | 164 | 9 | A | A | 78 | 5073 | | | | |
| 5 | 52 | H1 | 505 | 158 | 9 | A | A | 79 | 4893 | | | | |
| 6 | 53 | H1 | 525 | 164 | 9 | A | A | 76 | 4989 | | | | |
| 7 | 54 | H1 | 547 | 170 | 9 | A | A | 66 | 4844 | | | | |
| 8 | 61 | H1 | 380 | 107 | 9 | C | C | 72 | 3515 | | | | |
| 9 | 62 | H1 | 372 | 105 | 8 | C | C | 74 | 3456 | | | | |
| 10 | 63 | H1 | 444 | 138 | 8 | B | C | 79 | 4262 | | | | |
| 11 | 64 | H1 | 417 | 119 | 10 | B | C | 72 | 3892 | | | | |
| 12 | 70 | H1 | 418 | 127 | 8 | A | A | 84 | 4138 | | | | |

The invention alloy is configured by recrystallized grains of which the grain size after the solution heat-treating is about 10 μm and this size is one severalth of that of the comparative alloy. Also, the grain diameter of precipitates in the invention alloy is one severalth of that of the comparative alloy. In the process H, since the precipitation heat treatment is performed immediately after the solution heat-treating, recrystallization is not achieved after the precipitation heat treatment and thus data such as a recrystallization ratio after the precipitation heat treatment is not obtained (the same as in the process I). The invention is also more excellent than the comparative alloy in terms of tensile strength, Vickers hardness and bendability. The invention alloy also has excellent stress relaxation properties and an excellent performance index. In the case of the comparative alloy No. 70, the grain size the solution heat-treating is slightly small, but tensile strength and Vickers hardness are low.

Tables 14 and 15 show results of the process LH1 of the laboratory test of the alloys.

TABLE 14

| Test No. | Alloy No. | Process | Final Sheet Thickness Mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 11 | LH1 | 0.36 | 20 | | 25 | | | 2.8 | | 99 |
| 2 | 21 | LH1 | 0.36 | 25 | | 10 | | | 2.8 | | 99 |
| 3 | 22 | LH1 | 0.36 | 25 | | 12 | | | 2.9 | | 99 |
| 4 | 31 | LH1 | 0.36 | 20 | | 15 | | | 2.9 | | 99 |
| 5 | 41 | LH1 | 0.36 | 25 | | 10 | | | 2.8 | | 99 |
| 6 | 42 | LH1 | 0.36 | 25 | | 12 | | | 2.7 | | 98 |
| 7 | 43 | LH1 | 0.36 | 25 | | 10 | | | 2.7 | | 98 |
| 8 | 51 | LH1 | 0.36 | 25 | | 10 | | | 2.7 | | 99 |
| 9 | 52 | LH1 | 0.36 | 25 | | 10 | | | 2.8 | | 99 |
| 10 | 53 | LH1 | 0.36 | 25 | | 10 | | | 2.7 | | 99 |
| 11 | 54 | LH1 | 0.36 | 25 | | 10 | | | 2.9 | | 99 |
| 12 | 55 | LH1 | 0.36 | 20 | | 12 | | | 2.8 | | 99 |
| 13 | 56 | LH1 | 0.36 | 25 | | 10 | | | 2.8 | 96 | 98 |

TABLE 14-continued

| Test No. | Alloy No. | Process | Final Sheet Thickness Mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 14 | 57 | LH1 | 0.36 | 25 | | | | | | | |
| 15 | 61 | LH1 | 0.36 | 80 | | 100 | | | | | |
| 16 | 62 | LH1 | 0.36 | 80 | | 100 | | | | | |
| 17 | 63 | LH1 | 0.36 | 60 | | 50 | | | 10 | | 86 |
| 18 | 64 | LH1 | 0.36 | 70 | | 90 | | | | | |
| 19 | 65 | LH1 | 0.36 | 60 | | 50 | | | | | |
| 20 | 66 | LH1 | 0.36 | 55 | | 35 | | | | | |
| 21 | 67 | LH1 | 0.36 | 65 | | 50 | | | 3.4 | | 97 |
| 22 | 68 | LH1 | 0.36 | 65 | | 55 | | | | | |

TABLE 15

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 11 | LH1 | 594 | 178 | 9 | A | A | 50 | 4578 | | | | |
| 2 | 21 | LH1 | 528 | 164 | 10 | A | A | 77 | 5096 | | | | |
| 3 | 22 | LH1 | 482 | 156 | 8 | A | A | 82 | 4714 | | | | |
| 4 | 31 | LH1 | 568 | 173 | 9 | A | A | 61 | 4835 | | | | |
| 5 | 41 | LH1 | 528 | 163 | 10 | A | A | 77 | 5096 | | | | |
| 6 | 42 | LH1 | 504 | 159 | 8 | A | A | 78 | 4807 | | | | |
| 7 | 43 | LH1 | 515 | 162 | 8 | A | A | 75 | 4817 | | | | |
| 8 | 51 | LH1 | 530 | 166 | 9 | A | A | 77 | 5069 | | | | |
| 9 | 52 | LH1 | 506 | 160 | 9 | A | A | 79 | 4902 | | | | |
| 10 | 53 | LH1 | 532 | 167 | 9 | A | A | 76 | 5055 | | | | |
| 11 | 54 | LH1 | 550 | 168 | 10 | A | A | 67 | 4952 | | | | |
| 12 | 55 | LH1 | 558 | 170 | 9 | A | A | 65 | 4904 | | | | |
| 13 | 56 | LH1 | 520 | 162 | 8 | A | A | 79 | 4992 | | | | |
| 14 | 57 | LH1 | 532 | 167 | 8 | A | A | 78 | 5074 | | | | |
| 15 | 61 | LH1 | 378 | 109 | 9 | A | C | 73 | 3520 | | | | |
| 16 | 62 | LH1 | 373 | 105 | 7 | A | C | 73 | 3410 | | | | |
| 17 | 63 | LH1 | 442 | 135 | 8 | A | C | 77 | 4189 | | | | |
| 18 | 64 | LH1 | 419 | 120 | 10 | A | C | 73 | 3938 | | | | |
| 19 | 65 | LH1 | 451 | 141 | 8 | B | C | 73 | 4162 | | | | |
| 20 | 66 | LH1 | 463 | 148 | 6 | B | C | 71 | 4135 | | | | |
| 21 | 67 | LH1 | 608 | 180 | 7 | C | B | 40 | 4115 | | | | |
| 22 | 68 | LH1 | 438 | 133 | 8 | A | C | 78 | 4178 | | | | |

When compared with the comparative alloy, the invention alloy exhibits the same result as in the actual machine test in terms of mechanical properties and the grain after the solution heat-treating.

Tables 16 and 17 show results of the process J1 of the thin alloy sheets.

TABLE 16

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | J1 | 0.4 | | | 12 | 8 | 2.5 | 4.3 | | 98 |
| 2 | 31 | J1 | 0.4 | | | 15 | 20 | 2.5 | 6.2 | | 97 |

TABLE 16-continued

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 3 | 41 | J1 | 0.4 | | | 12 | 10 | 2 | 4.5 | | 97 |
| 4 | 51 | J1 | 0.4 | | | 10 | 5 | 1.5 | 4.1 | | 97 |
| 5 | 52 | J1 | 0.4 | | | 12 | 15 | 3 | 5.5 | | 96 |
| 6 | 53 | J1 | 0.4 | | | 10 | 12 | 2.5 | 4.5 | | 97 |
| 7 | 54 | J1 | 0.4 | | | 12 | 15 | 2.5 | 4.4 | | 98 |
| 8 | 61 | J1 | 0.4 | | | 90 | 100 | 45 | | | |
| 9 | 62 | J1 | 0.4 | | | 80 | 100 | 45 | | | |
| 10 | 63 | J1 | 0.4 | | | 50 | 80 | 15 | 13 | | 67 |
| 11 | 64 | J1 | 0.4 | | | 90 | 100 | 40 | | | |

TABLE 17

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | J1 | 535 | 169 | 7 | A | A | 78 | 5056 | | | | |
| 2 | 31 | J1 | 571 | 176 | 8 | A | A | 62 | 4856 | | | | |
| 3 | 41 | J1 | 533 | 168 | 7 | A | A | 78 | 5037 | | | | |
| 4 | 51 | J1 | 545 | 173 | 7 | A | A | 78 | 5150 | | | | |
| 5 | 52 | J1 | 512 | 162 | 8 | A | A | 80 | 4946 | | | | |
| 6 | 53 | J1 | 541 | 171 | 7 | A | A | 76 | 5046 | | | | |
| 7 | 54 | J1 | 560 | 171 | 8 | A | A | 66 | 4913 | | | | |

In the process J1, the grain size after the solution heat-treating is smaller and mechanical properties are more excellent in the invention alloy than in the comparative alloy as in the process H1. In addition, the invention alloy of the process J1 has more excellent tensile strength and Vickers hardness than those of the invention alloy of the process H1, but is slightly poorer than the invention alloy of the process H1 in terms of elongation.

Tables 18 and 19 show results of the process K2 of the thin alloy sheets.

TABLE 18

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | K2 | 0.4 | | | 10 | 12 | 2.5 | 4.6 | | 98 |
| 2 | 31 | K2 | 0.4 | | | 15 | 25 | 2 | 6 | | 98 |
| 3 | 41 | K2 | 0.4 | | | 10 | 12 | 2.5 | 5 | | 98 |
| 4 | 51 | K2 | 0.4 | | | 10 | 12 | 2 | 4.4 | | 98 |
| 5 | 52 | K2 | 0.4 | | | 12 | 20 | 4 | 6.2 | | 97 |
| 6 | 53 | K2 | 0.4 | | | 8 | 15 | 2.5 | 5.2 | | 97 |
| 7 | 54 | K2 | 0.4 | | | 10 | 15 | 2.5 | 4.7 | | 98 |
| 8 | 63 | K2 | 0.4 | | | 50 | 90 | 18 | 14 | | 55 |
| 9 | 64 | K2 | 0.4 | | | | 100 | 40 | | | |

TABLE 19

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | K2 | 515 | 160 | 11 | A | A | 82 | 5177 | | | | |
| 2 | 31 | K2 | 565 | 173 | 10 | A | B | 64 | 4972 | | | | |
| 3 | 41 | K2 | 515 | 159 | 10 | A | A | 81 | 5099 | | | | |
| 4 | 51 | K2 | 532 | 164 | 9 | A | A | 82 | 5251 | | | | |
| 5 | 52 | K2 | 498 | 157 | 11 | A | A | 83 | 5036 | | | | |
| 6 | 53 | K2 | 518 | 162 | 10 | A | A | 79 | 5064 | | | | |
| 7 | 54 | K2 | 548 | 166 | 11 | A | A | 69 | 5053 | | | | |
| 8 | 63 | K2 | 430 | 128 | 9 | A | C | 80 | 4192 | | | | |
| 9 | 64 | K2 | 410 | 115 | 11 | A | C | 74 | 3915 | | | | |

In the process K2, the invention alloy is more excellent than the comparative alloy in terms of mechanical properties and the grain size after the solution heat-treating as in the process H1. In addition, the invention alloy of the process K2 is more excellent than the invention alloy of the process H1 in terms of elongation, conductivity and performance index Is.

Tables 20 and 21 show results of a change in a hot rolling start temperature in the process A and a change in a sheet thickness of the hot rolling.

TABLE 20

| Test No. | Alloy No. | Process | Final Sheet Thickness mm | After Hot Rolling: Grain Size μm | Recrystallization Ratio % | L1/L2 | Grain Size After Solution Heat-Treating μm | Recrystallization After Precipitation Heat Treatment: Recrystallization Ratio % | Grain Size μm | Precipitates After Precipitation Heat Treatment: Average Grain Diameter nm | Ratio of Grains of 10 nm or less % | Ratio of Grains of 15 nm or less % |
|---|---|---|---|---|---|---|---|---|---|---|---|---|
| 1 | 21 | A1 | 25 | 20 | 98 | 1.0 | | | | 2.4 | 99 | 100 |
| 2 | 21 | A2 | 25 | 18 | 96 | 1.1 | | | | 3.3 | 97 | 98 |
| 3 | 21 | A3 | 25 | 40 | 100 | 1.0 | | | | 2.3 | 99 | 100 |
| 4 | 21 | A4H | 25 | 15 | 25 | 2.3 | | | | 7.3 | | 87 |
| 5 | 21 | A5H | 25 | 90 | 100 | 1.0 | | | | 2.1 | 99 | 100 |
| 6 | 41 | A1 | 25 | 20 | 99 | 1.0 | | | | 2.6 | 98 | 100 |
| 7 | 41 | A2 | 25 | 15 | 94 | 1.2 | | | | 3.5 | 97 | 99 |
| 8 | 41 | A3 | 25 | 40 | 100 | 1.0 | | | | 2.2 | 99 | 100 |
| 9 | 41 | A4H | 25 | 13 | 30 | 2.2 | | | | 7.1 | | 87 |
| 10 | 41 | A5H | 25 | 100 | 100 | 1.0 | | | | 2.1 | 99 | 100 |
| 11 | 51 | A1 | 25 | 20 | 98 | 1.0 | | | | 2.4 | 99 | 100 |
| 12 | 51 | A3 | 25 | 40 | 100 | 1.0 | | | | 2.3 | 99 | 100 |
| 13 | 53 | A1 | 25 | 20 | 98 | 1.0 | | | | 2.3 | 99 | 99 |
| 14 | 53 | A3 | 25 | 40 | 100 | 1.0 | | | | 2.2 | 98 | 100 |
| 15 | 41 | A9 | 40 | 40 | 100 | 1.0 | | | | 2.5 | | 100 |
| 16 | 21 | A9 | 40 | 40 | 100 | 1.0 | | | | 2.4 | | 100 |

TABLE 21

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | A1 | 395 | 111 | 47 | A | | 78 | 5128 | 102 | | 73 | 245 |
| 2 | 21 | A2 | 379 | 108 | 48 | A | | 79 | 4986 | 95 | | 73 | 227 |

TABLE 21-continued

| Test No. | Alloy No. | Process | Tensile Strength N/mm² | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm² |
|---|---|---|---|---|---|---|---|---|---|---|---|---|---|
| 3 | 21 | A3 | 401 | 112 | 44 | A | | 77 | 5067 | 104 | | 73 | 243 |
| 4 | 21 | A4H | 317 | 94 | 48 | A | | 80 | 4196 | 74 | | 74 | 183 |
| 5 | 21 | A5H | 386 | 109 | 35 | B | | 76 | 4543 | 102 | | 73 | 229 |
| 6 | 41 | A1 | 393 | 109 | 47 | A | | 77 | 5069 | 100 | | 72 | 237 |
| 7 | 41 | A2 | 377 | 107 | 49 | A | | 79 | 4993 | 94 | | 72 | 219 |
| 8 | 41 | A3 | 405 | 113 | 44 | A | | 77 | 5118 | 103 | | 72 | 245 |
| 9 | 41 | A4H | 322 | 97 | 48 | A | | 80 | 4262 | 76 | | 72 | 188 |
| 10 | 41 | A5H | 385 | 109 | 36 | B | | 76 | 4565 | 98 | | 72 | 222 |
| 11 | 51 | A1 | 403 | 113 | 46 | A | | 78 | 5196 | 104 | | 72 | 251 |
| 12 | 51 | A3 | 418 | 115 | 43 | A | | 78 | 5279 | 105 | | 72 | 247 |
| 13 | 53 | A1 | 395 | 111 | 45 | A | | 76 | 4993 | 103 | | 70 | 242 |
| 14 | 53 | A3 | 404 | 113 | 43 | A | | 75 | 5003 | 106 | | 70 | 245 |
| 15 | 41 | A9 | 375 | 108 | 51 | A | | 77 | 4969 | 94 | | 73 | 230 |
| 16 | 21 | A9 | 377 | 107 | 52 | A | | 77 | 5028 | 99 | | 73 | 233 |

In the process A4H in which a hot rolling start temperature is 810° C., that is, lower than the range of the manufacturing condition, the grain diameter of precipitates is large. Since a rolling end temperature is also low, a recrystallization ratio and a value of L1/L2 are higher than those in other processed materials. In addition, tensile strength, Vickers hardness, conductivity, performance index Is, Vickers hardness of heat resistance with respect to the 700° C. heating and 400° C. high-temperature tensile strength are poor. In the process A5H in which a hot rolling start temperature is 965° C., that is, higher than the range of the manufacturing condition, grains after the hot rolling are large. In addition, elongation and performance index Is are poor. In the process A9 in which the sheet thickness after the hot rolling is 40 mm, mechanical properties are the same as those in the process A1 in which the sheet thickness after the hot rolling is 20 mm.

Tables 22 and 23 show results of a change in a cooling rate after the hot rolling in the process A.

TABLE 22

| Test No. | Alloy No. | Process | Final Sheet Thickness mm | After Hot Rolling: Grain Size μm | After Hot Rolling: Recrystallization Ratio % | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Precipitates After Precipitation Heat Treatment: Ratio of Grains of 10 nm or less % | Precipitates After Precipitation Heat Treatment: Ratio of Grains of 15 nm or less % |
|---|---|---|---|---|---|---|---|---|---|---|---|
| 1 | 21 | A1 | 25 | 20 | 98 | | | | 2.4 | 99 | 100 |
| 2 | 21 | A6H | 25 | 35 | 100 | | | | 11 | | 80 |
| 3 | 21 | A7 | 25 | 20 | 98 | | | | 3.7 | 88 | 94 |
| 4 | 41 | A1 | 25 | 20 | 99 | | | | 2.6 | 98 | 100 |
| 5 | 41 | A6H | 25 | 25 | 100 | | | | 10 | | 80 |
| 6 | 41 | A7 | 25 | 20 | 98 | | | | 3.5 | 89 | 94 |

TABLE 23

| Test No. | Alloy No. | Process | Tensile Strength N/mm² | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm² |
|---|---|---|---|---|---|---|---|---|---|---|---|---|---|
| 1 | 21 | A1 | 395 | 111 | 47 | A | | 78 | 5128 | 102 | | 73 | 245 |
| 2 | 21 | A6H | 308 | 92 | 46 | A | | 79 | 3997 | 73 | | 74 | 165 |
| 3 | 21 | A7 | 359 | 105 | 48 | A | | 78 | 4692 | 92 | | 73 | 216 |
| 4 | 41 | A1 | 393 | 109 | 47 | A | | 77 | 5069 | 100 | | 72 | 237 |
| 5 | 41 | A6H | 326 | 99 | 44 | A | | 79 | 4172 | 75 | | 72 | 178 |
| 6 | 41 | A7 | 362 | 104 | 48 | A | | 78 | 4732 | 90 | | 72 | 208 |

In the process A6H, the cooling rate is 1.8° C./sec and is lower than 5° C./sec of the condition range. In the case of the rolled sheet of the process A6H, the grain diameter of precipitates is large and tensile strength, Vickers hardness, performance index Is, Vickers hardness of heat resistance with respect to the 700° C. heating and 400° C. high-temperature tensile strength are poor.

Tables 24 and 25 show results of the solution heat treatment after the hot rolling.

TABLE 24

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Recrystallization After Precipitation Heat Treatment Average Grain Diameter nm | Recrystallization After Precipitation Heat Treatment Ratio of Grains of 10 nm or less % | Recrystallization After Precipitation Heat Treatment Ratio of Grains of 15 nm or less % |
|---|---|---|---|---|---|---|---|---|---|---|---|
| 1 | 21 | A1 | 25 | 20 | 98 | | | | 2.4 | 99 | 100 |
| 2 | 21 | A8H | 25 | 120 | 100 | | | | 1.8 | | 100 |
| 3 | 41 | A1 | 25 | 20 | 99 | | | | 2.6 | 98 | 100 |
| 4 | 41 | A8H | 25 | 120 | 100 | | | | 2 | | 100 |

TABLE 25

| Test No. | Alloy No. | Process | Tensile Strength N/mm$^2$ | Vickers Hardness HV | Elongation | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | A1 | 395 | 111 | 47 | A | | 78 | 5128 | 102 | | 73 | 245 |
| 2 | 21 | A8H | 390 | 111 | 32 | B | | 78 | 4547 | 102 | | 74 | 242 |
| 3 | 41 | A1 | 393 | 109 | 47 | A | | 77 | 5069 | 100 | | 72 | 237 |
| 4 | 41 | A8H | 383 | 110 | 32 | B | | 77 | 4436 | 99 | | 71 | 232 |

In the process A8H, the solution heat treatment is performed after the hot rolling. In the rolled sheet of the process A8H, the grain size is larger than that in the rolled sheet of the process A1 in which a particular solution heat treatment is not performed. In addition, elongation, bendability and performance index Is are poor.

Tables 26 and 27 show results of a change in conditions of the precipitation heat treatment.

TABLE 26

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | A1 | 25 | 20 | 98 | | | | 2.4 | 99 | 100 |
| 2 | 21 | A10H | 25 | 20 | 98 | | | | 1.9 | | 94 |
| 3 | 21 | A11H | 25 | 20 | 98 | | | | 9.7 | 61 | 94 |
| 4 | 41 | A1 | 25 | 20 | 99 | | | | 2.6 | 98 | 100 |
| 5 | 41 | A10H | 25 | 20 | 98 | | | | 1.9 | | 94 |
| 6 | 41 | A11H | 25 | 20 | 98 | | | | 9.5 | 56 | 90 |

TABLE 27

| Test No. | Alloy No. | Process | Tensile Strength N/mm$^2$ | Vickers Hardness HV | Elongation | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | A1 | 395 | 111 | 47 | A | | 78 | 5128 | 102 | | 73 | 245 |
| 2 | 21 | A10H | 311 | 95 | 46 | A | | 64 | 3632 | | | | |
| 3 | 21 | A11H | 318 | 96 | 49 | A | | 80 | 4238 | 72 | | 73 | 177 |
| 4 | 41 | A1 | 393 | 109 | 47 | A | | 77 | 5069 | 100 | | 72 | 237 |
| 5 | 41 | A10H | 311 | 95 | 46 | A | | 64 | 3632 | | | | |
| 6 | 41 | A11H | 316 | 95 | 47 | A | | 80 | 4155 | 71 | | 74 | 175 |

The process A10H has a smaller heat treatment index It1 than the condition range and the process A11H has a larger heat treatment index It1 than the condition range. The rolled sheet of the process A10H is poor in tensile strength, Vickers hardness, conductivity and performance index Is. In the rolled sheet of the process A11H, the grain diameter of precipitates is large, and tensile strength, Vickers hardness, Vickers hardness of heat resistance with respect to the 700° C. heating and 400° C. high-temperature tensile strength are poor.

Tables 28 and 29 show results of reducing a final sheet thickness in the hot rolling. Herein, in the cases of test Nos. 3, 6 and 8, the recrystallization ratio is 0%, but from the trace of recrystallized grains formed before the final pass of the hot rolling, a grain size and a value of L1/L2 were measured. In the processes A12 and A13H, the sheet is rolled into a thickness of 15 mm by hot rolling. Accordingly, in the process A12, a final hot rolling temperature is 715° C. and is significantly lower than that in the processes such as A1 in which the rolling into a thickness of 25 mm is performed. The value of L1/L2 is about 2 that is larger than L1/L2 in the process A1. However, characteristics such as strength are excellent as in the process A1. In the process A13H, a hot rolling start temperature is 840° C., that is, the lower side of the range of the manufacturing condition, and the temperature decreases so that a final hot rolling temperature is 650° C. Accordingly, the value of L1/L2 is equal to or greater than 4 and thus does not satisfy the condition range of 4 or less. Accordingly, tensile strength, Vickers hardness, elongation, bendability, performance index Is, heat resistance and 400° C. high-temperature tensile strength are poor.

In the process A12, the examination was also performed on a tip end portion of the rolled sheet. In the cases of the alloys 21, 41 and 53, the rolling end temperature of a tip end portion was 735° C. and an average cooling rate at which the temperature of the tip end portion decreases to 300° C. was 8.5° C./sec. In the tip end portion of the rolled sheet, the grain size was the same, a recrystallization ratio was slightly higher and a value of L1/L2 was the same or slightly less than in the rear end portion. When comparing characteristics of the tip end portion with characteristics of the rear end portion, there is little difference in strength, ductility, conductivity, performance index and heat resistance. Even when an average cooling rate in the tip end portion and an average cooling rate in the rear end portion are somewhat different, a rolled material having uniform characteristics is obtained.

TABLE 28

| Test No. | Alloy No. | Process | Final Sheet Thickness mm | After Hot Rolling: Grain Size μm | After Hot Rolling: Recrystallization Ratio % | After Hot Rolling: L1/L2 | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Ratio of Grains of 10 nm or less % | Ratio of Grains of 15 nm or less % |
|---|---|---|---|---|---|---|---|---|---|---|---|---|
| 1 | 21 | A1 | 25 | 20 | 98 | 1.0 | | | | 2.4 | 99 | 100 |
| 2 | 21 | A12 | 15 | 20 | 25 | 1.9 | | | | 2.6 | 98 | 100 |
| 3 | 21 | A13H | 15 | 15 | 0 | 4.4 | | | | 6.6 | | 89 |
| 4 | 41 | A1 | 25 | 20 | 99 | 1.0 | | | | 2.6 | 98 | 100 |
| 5 | 41 | A12 | 15 | 20 | 20 | 2.6 | | | | 2.9 | 97 | 99 |
| 6 | 41 | A13H | 15 | 15 | 0 | 4.9 | | | | 7.2 | | 87 |
| 7 | 53 | A12 | 15 | 20 | 25 | 2.1 | | | | 2.8 | 98 | 98 |
| 8 | 53 | A13H | 15 | 15 | 0 | 4.6 | | | | 6.9 | | 88 |
| 9 | 21 | A12 Tip End | 15 | 20 | 25 | 2.0 | | | | 2.6 | 98 | 100 |
| 10 | 41 | A12 Tip End | 15 | 20 | 25 | 2.4 | | | | 2.8 | 98 | 99 |
| 11 | 53 | A12 Tip End | 15 | 20 | 25 | 2.0 | | | | 2.8 | 98 | 99 |

TABLE 29

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | A1 | 395 | 111 | 47 | A | | 78 | 5128 | 102 | | 73 | 245 |
| 2 | 21 | A12 | 407 | 115 | 41 | A | | 79 | 5101 | 100 | | 73 | 231 |
| 3 | 21 | A13H | 352 | 106 | 33 | B | | 80 | 4187 | 85 | | 73 | 190 |
| 4 | 41 | A1 | 393 | 109 | 47 | A | | 77 | 5069 | 100 | | 72 | 237 |
| 5 | 41 | A12 | 403 | 113 | 40 | A | | 78 | 4983 | 97 | | 72 | 227 |
| 6 | 41 | A13H | 340 | 102 | 30 | B | | 79 | 3929 | 78 | | 72 | 184 |
| 7 | 53 | A12 | 402 | 113 | 38 | A | | 77 | 4868 | 97 | | 70 | 225 |
| 8 | 53 | A13H | 338 | 102 | 31 | B | | 77 | 3885 | 76 | | 70 | 180 |
| 9 | 21 | A12 Tip End | 409 | 116 | 40 | A | | 79 | 5089 | 101 | | 73 | 235 |
| 10 | 41 | A12 Tip End | 408 | 115 | 40 | A | | 77 | 5012 | 99 | | 72 | 239 |
| 11 | 53 | A12 Tip End | 401 | 112 | 39 | A | | 77 | 4891 | 97 | | 70 | 224 |

Tables 30 and 31 show results of a change in a hot rolling start temperature in the process B.

TABLE 30

| Test No. | Alloy No. | Process | Final Sheet Thickness mm | After Hot Rolling: Grain Size μm | After Hot Rolling: Recrystallization Ratio % | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Precipitates After Precipitation Heat Treatment: Ratio of Grains of 10 nm or less % | Precipitates After Precipitation Heat Treatment: Ratio of Grains of 15 nm or less % |
|---|---|---|---|---|---|---|---|---|---|---|---|
| 1 | 21 | B1 | 20 | 20 | 98 | | | | | | |
| 2 | 21 | B2 | 20 | 18 | 96 | | | | | | |
| 3 | 21 | B3 | 20 | 40 | 100 | | | | | | |
| 4 | 21 | B4H | 20 | 13 | 90 | | | | | | |
| 5 | 21 | B5H | 20 | 90 | 100 | | | | | | |
| 6 | 41 | B1 | 20 | 20 | 97 | | | | | | |
| 7 | 41 | B2 | 20 | 15 | 97 | | | | | | |
| 8 | 41 | B3 | 20 | 40 | 100 | | | | | | |
| 9 | 41 | B4H | 20 | 13 | 92 | | | | | | |
| 10 | 41 | B5H | 20 | 90 | 100 | | | | | | |

TABLE 31

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | B1 | 435 | 132 | 33 | A | | 79 | 5142 | 119 | 5 | 73 | 286 |
| 2 | 21 | B2 | 418 | 122 | 33 | A | | 80 | 4972 | 108 | | 73 | 255 |
| 3 | 21 | B3 | 441 | 133 | 30 | A | | 78 | 5063 | 118 | | 73 | 273 |
| 4 | 21 | B4H | 358 | 108 | 31 | A | | 80 | 4195 | 83 | | 74 | 194 |
| 5 | 21 | B5H | 422 | 128 | 22 | C | | 76 | 4488 | 114 | | 73 | 227 |
| 6 | 41 | B1 | 434 | 129 | 33 | A | | 79 | 5130 | 116 | 5 | 72 | 269 |
| 7 | 41 | B2 | 417 | 123 | 33 | A | | 79 | 4929 | 105 | | 72 | 247 |

TABLE 31-continued

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 8 | 41 | B3 | 438 | 130 | 30 | A | | 78 | 5029 | 117 | | 72 | 260 |
| 9 | 41 | B4H | 360 | 109 | 33 | A | | 79 | 4256 | 82 | | 73 | 192 |
| 10 | 41 | B5H | 422 | 127 | 23 | C | | 76 | 4525 | 112 | | 72 | 253 |

The rolled sheet of the process B4H in which a hot rolling start temperature is 810° C., that is, lower than the range of the manufacturing condition, is poor in tensile strength, Vickers hardness, performance index Is, Vickers hardness of heat resistance with respect to the 700° C. heating and 400° C. high-temperature tensile strength. In the rolled sheet of the process B5H in which a hot rolling start temperature is 965° C., that is, higher than the range of the manufacturing condition, grains after the hot rolling are large. In addition, elongation, bendability, conductivity, performance index Is and 400° C. high-temperature tensile strength are poor.

Tables 32 and 33 show results of a change in a cooling rate after the hot rolling in the process B.

TABLE 32

| Test No. | Alloy No. | Process | Final Sheet Thickness mm | After Hot Rolling: Grain Size μm | After Hot Rolling: Recrystallization Ratio % | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Precipitates After Precipitation Heat Treatment: Ratio of Grains of 10 nm or less % | Precipitates After Precipitation Heat Treatment: Ratio of Grains of 15 nm or less % |
|---|---|---|---|---|---|---|---|---|---|---|---|
| 1 | 21 | B1 | 20 | 20 | 98 | | | | | | |
| 2 | 21 | B6H | 20 | 25 | 100 | | | | | | |
| 3 | 41 | B1 | 20 | 20 | 97 | | | | | | |
| 4 | 41 | B6H | 20 | 25 | 100 | | | | | | |

TABLE 33

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | B1 | 435 | 132 | 33 | A | | 79 | 5142 | 119 | 5 | 73 | 286 |
| 2 | 21 | B6H | 355 | 111 | 30 | A | | 80 | 4128 | 85 | | 73 | 190 |
| 3 | 41 | B1 | 434 | 129 | 33 | A | | 79 | 5130 | 116 | 5 | 72 | 269 |
| 4 | 41 | B6H | 368 | 109 | 29 | A | | 79 | 4219 | 86 | | 72 | 184 |

In the process B6H, a cooling rate is 2° C./sec and is lower than the condition range of 5° C./sec. In the rolled sheet of the process B6H, the grain size after the hot rolling is large, and tensile strength, Vickers hardness, elongation, performance index Is, Vickers hardness of heat resistance with respect to the 700° C. heating and 400° C. high-temperature tensile strength are poor.

Tables 34 and 35 show results of the rolled sheets obtained by the process C in which the precipitation heat treatment is performed before the cold rolling, together with results of the rolled sheets obtained by the process B.

TABLE 34

| Test No. | Alloy No. | Process | Final Sheet Thickness Mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | B1 | 20 | 20 | 98 | | | | | | |
| 2 | 21 | C1 | 20 | 20 | 98 | | | | | | |
| 3 | 41 | B1 | 20 | 20 | 97 | | | | | | |
| 4 | 41 | C1 | 20 | 20 | 99 | | | | | | |
| 5 | 51 | B1 | 20 | 20 | 98 | | | | | | |
| 6 | 51 | C1 | 20 | 20 | 98 | | | | | | |

TABLE 35

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | B1 | 435 | 132 | 33 | A | | 79 | 5142 | 119 | 5 | 73 | 286 |
| 2 | 21 | C1 | 453 | 138 | 26 | A | | 78 | 5041 | 117 | | 73 | 268 |
| 3 | 41 | B1 | 434 | 129 | 33 | A | | 79 | 5130 | 116 | 5 | 72 | 269 |
| 4 | 41 | C1 | 455 | 137 | 25 | A | | 77 | 4991 | 115 | | 72 | 252 |
| 5 | 51 | B1 | 450 | 135 | 31 | A | | 79 | 5240 | 123 | 0 | 72 | 287 |
| 6 | 51 | C1 | 464 | 142 | 23 | A | | 78 | 5040 | | | | |

The elongation of the rolled sheet of the process C is slightly less than that of the rolled sheet of the process B in which the precipitation heat treatment is performed after the cold rolling. However, the strength of the rolled sheet of the process C is higher than that of the rolled sheet of the process B.

Tables 36 and 37 show results of the rolled sheets obtained by the process D in which the precipitation heat treatment is performed before or after the cold rolling together with results of the rolled sheets obtained by the process B.

TABLE 36

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | B1 | 20 | 20 | 98 | | | | | | |
| 2 | 21 | D1 | 20 | 20 | 98 | | | | | | |
| 3 | 41 | B1 | 20 | 20 | 97 | | | | | | |
| 4 | 41 | D1 | 20 | 25 | 99 | | | | | | |

TABLE 37

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | B1 | 435 | 132 | 33 | A | | 79 | 5142 | 119 | 5 | 73 | 286 |
| 2 | 21 | D1 | 436 | 133 | 32 | A | | 82 | 5212 | 119 | 5 | 73 | 280 |
| 3 | 41 | B1 | 434 | 129 | 33 | A | | 79 | 5130 | 116 | 5 | 72 | 269 |
| 4 | 41 | D1 | 435 | 132 | 33 | A | | 81 | 5207 | 117 | | 72 | 256 |

The rolled sheet of the process D is more excellent in conductivity and performance index Is than that of the process B1 in which the precipitation heat treatment is performed only after the cold rolling.

Tables 38 and 39 show results of a change in conditions of the solution heat-treating in the process H.

TABLE 38

| Test No. | Alloy No. | Process | Final Sheet Thickness mm | After Hot Rolling: Grain Size μm | After Hot Rolling: Recrystallization Ratio % | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Precipitates After Precipitation Heat Treatment: Ratio of Grains of 10 nm or less % | Precipitates After Precipitation Heat Treatment: Ratio of Grains of 15 nm or less % |
|---|---|---|---|---|---|---|---|---|---|---|---|
| 1 | 21 | H1 | 0.4 | | | 10 | | | 3 | | 99 |
| 2 | 21 | H2H | 0.4 | | | 12 | | | 8.2 | | 89 |
| 3 | 21 | H3 | 0.4 | | | 15 | | | 2.5 | | 99 |
| 4 | 21 | H4H | 0.4 | | | 80 | | | 2.4 | | 99 |
| 5 | 31 | H1 | 0.4 | 15 | 10 | 12 | | | 3.1 | | 99 |
| 6 | 31 | H3 | 0.4 | | | 25 | | | 2.7 | | 99 |
| 7 | 41 | H1 | 0.4 | | | 10 | | | 2.8 | | 99 |
| 8 | 41 | H2H | 0.4 | | | 12 | | | 8 | | 88 |
| 9 | 41 | H3 | 0.4 | | | 15 | | | 2.6 | | 99 |
| 10 | 41 | H4H | 0.4 | | | 90 | | | 2.5 | | 98 |
| 11 | 51 | H1 | 0.4 | | | 10 | | | 3 | | 99 |
| 12 | 52 | H1 | 0.4 | | | 12 | | | 3.1 | | 99 |
| 13 | 53 | H1 | 0.4 | | | 10 | | | 2.9 | | 98 |
| 14 | 54 | H1 | 0.4 | 15 | 10 | 12 | | | 3.1 | | 99 |
| 15 | 54 | H3 | 0.4 | | | 20 | | | 2.8 | | 99 |

TABLE 39

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | H1 | 520 | 163 | 10 | A | A | 78 | 5052 | | | | |
| 2 | 21 | H2H | 446 | 143 | 9 | A | C | 78 | 4293 | | | | |
| 3 | 21 | H3 | 541 | 170 | 9 | A | A | 77 | 5175 | | | | |
| 4 | 21 | H4H | 538 | 168 | 5 | C | A | 76 | 4925 | | | | |
| 5 | 31 | H1 | 566 | 174 | 9 | A | A | 61 | 4818 | | | | |
| 6 | 31 | H3 | 582 | 183 | 7 | A | A | 61 | 4864 | | | | |
| 7 | 41 | H1 | 525 | 164 | 10 | A | A | 79 | 5133 | | | | |
| 8 | 41 | H2H | 448 | 140 | 8 | A | C | 78 | 4273 | | | | |
| 9 | 41 | H3 | 539 | 168 | 9 | A | A | 77 | 5155 | | | | |
| 10 | 41 | H4H | 541 | 168 | 4 | C | A | 77 | 4937 | | | | |
| 11 | 51 | H1 | 527 | 164 | 9 | A | A | 78 | 5073 | | | | |
| 12 | 52 | H1 | 505 | 158 | 9 | A | A | 79 | 4893 | | | | |

TABLE 39-continued

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 13 | 53 | H1 | 525 | 164 | 9 | A | A | 76 | 4989 | | | | |
| 14 | 54 | H1 | 547 | 170 | 9 | A | A | 66 | 4844 | | | | |
| 15 | 54 | H3 | 564 | 177 | 8 | A | A | 65 | 4911 | | | | |

In the process H2H, a solution heat temperature is 800° C. and is lower than the condition range of 820° C. to 960° C. In the rolled sheet of the process H2H, the grain diameter of precipitates is large and tensile strength, Vickers hardness and stress relaxation properties are poor. In the rolled sheet of the process H4H, the grain size after the solution heat-treating is large and a result of the bending test is bad.

Tables 40 and 41 show results of the rolled sheets obtained by the process I.

TABLE 40

| Test No. | Alloy No. | Process | Final Sheet Thickness mm | After Hot Rolling: Grain Size μm | After Hot Rolling: Recrystallization Ratio % | Grain Size After Solution Heat-Treating μm | Recrystallization After Precipitation Heat Treatment: Recrystallization Ratio % | Recrystallization After Precipitation Heat Treatment: Grain Size μm | Precipitates After Precipitation Heat Treatment: Average Grain Diameter nm | Precipitates After Precipitation Heat Treatment: Ratio of Grains of 10 nm or less % | Precipitates After Precipitation Heat Treatment: Ratio of Grains of 15 nm or less % |
|---|---|---|---|---|---|---|---|---|---|---|---|
| 1 | 21 | I | 0.4 | | | 12 | | | 2.7 | | 100 |
| 2 | 31 | I | 0.4 | | | 15 | | | 2.8 | | 100 |
| 3 | 41 | I | 0.4 | | | 12 | | | 2.7 | | 99 |
| 4 | 54 | I | 0.4 | | | 12 | | | 2.9 | | 100 |

TABLE 41

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 21 | I | 532 | 165 | 9 | A | A | 77 | 5088 | | | | |
| 2 | 31 | I | 572 | 176 | 9 | A | A | 62 | 4909 | | | | |
| 3 | 41 | I | 532 | 164 | 9 | A | A | 78 | 5121 | | | | |
| 4 | 54 | I | 551 | 173 | 9 | A | A | 67 | 4916 | | | | |

In the process I, the recrystallization heat treatment is performed during the cold rolling before the solution heat-treating. The rolled sheet of the process I has excellent mechanical properties, and particularly, has excellent tensile strength and Vickers hardness.

Tables 42 and 43 show results of a change in conditions of the precipitation heat treatment and the recovery heat treatment in the process J.

TABLE 42

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter Nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | J1 | 0.4 | | | 12 | 8 | 2.5 | 4.3 | | 99 |
| 2 | 21 | J2 | 0.4 | | | 15 | 2 | 1.5 | 4 | | 99 |
| 3 | 21 | J3H | 0.4 | | | 15 | 2 | 1.5 | 4 | | 99 |
| 4 | 31 | J2 | 0.4 | | | 25 | 15 | 1.5 | 5.2 | | 99 |
| 5 | 31 | J3H | 0.4 | | | 25 | 15 | 1.5 | 5.2 | | 99 |
| 6 | 41 | J1 | 0.4 | | | 12 | 10 | 2 | 4.5 | | 98 |
| 7 | 41 | J2 | 0.4 | | | 15 | 3 | 1.5 | 3.9 | | 99 |
| 8 | 41 | J3H | 0.4 | | | 15 | 3 | 1.5 | 3.9 | | 99 |
| 9 | 51 | J1 | 0.4 | | | 10 | 5 | 1.5 | 4.1 | | 98 |
| 10 | 52 | J1 | 0.4 | | | 12 | 15 | 3 | 5.5 | | 97 |
| 11 | 53 | J1 | 0.4 | | | 10 | 12 | 2.5 | 4.5 | | 98 |
| 12 | 54 | J1 | 0.4 | | | 12 | 15 | 2.5 | 4.7 | | 99 |

TABLE 43

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | J1 | 535 | 169 | 7 | A | A | 78 | 5056 | | | | |
| 2 | 21 | J2 | 541 | 170 | 7 | A | A | 77 | 5080 | | | | |
| 3 | 21 | J3H | 555 | 176 | 3 | B | C | 73 | 4884 | | | | |
| 4 | 31 | J2 | 586 | 182 | 7 | A | A | 61 | 4897 | | | | |
| 5 | 31 | J3H | 598 | 185 | 3 | B | C | 58 | 4691 | | | | |
| 6 | 41 | J1 | 533 | 168 | 7 | A | A | 78 | 5037 | | | | |
| 7 | 41 | J2 | 549 | 172 | 7 | A | A | 77 | 5155 | | | | |
| 8 | 41 | J3H | 557 | 177 | 4 | B | C | 74 | 4983 | | | | |
| 9 | 51 | J1 | 545 | 173 | 7 | A | A | 78 | 5150 | | | | |
| 10 | 52 | J1 | 512 | 162 | 8 | A | A | 80 | 4946 | | | | |
| 11 | 53 | J1 | 541 | 171 | 7 | A | A | 76 | 5046 | | | | |
| 12 | 54 | J1 | 560 | 171 | 8 | A | A | 66 | 4913 | | | | |

In the processes J1 and J2, the precipitation heat treatment and the recovery heat treatment are performed in the condition range. In the process J3H, the recovery heat treatment is not performed. The rolled sheets of the processes J1 and J2 have excellent mechanical properties, but the rolled sheet of the process J3H is poor in elongation, bendabillty and stress relaxation properties.

Tables 44 and 45 show results of the rolled sheets obtained by the process K.

TABLE 44

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 1 | 21 | K0 | 0.4 | | | 10 | 15 | 2 | 4.5 | | 98 |
| 2 | 21 | K1 | 0.4 | | | 10 | 15 | 2 | 4.8 | | 98 |
| 3 | 21 | K2 | 0.4 | | | 10 | 12 | 2.5 | 4.6 | | 98 |

TABLE 44-continued

| Test No. | Alloy No. | Process | Final Sheet Thickness mm | After Hot Rolling Grain Size μm | After Hot Rolling Recrystallization Ratio % | Grain Size After Solution Heat-Treating μm | Recrystallization After Precipitation Heat Treatment Recrystallization Ratio % | Recrystallization After Precipitation Heat Treatment Grain Size μm | Precipitates After Precipitation Heat Treatment Average Grain Diameter nm | Precipitates After Precipitation Heat Treatment Ratio of Grains of 10 nm or less % | Precipitates After Precipitation Heat Treatment Ratio of Grains of 15 nm or less % |
|---|---|---|---|---|---|---|---|---|---|---|---|
| 4 | 21 | K3H | 0.4 | | | 10 | 0 | | | | |
| 5 | 21 | K4H | 0.4 | | | 10 | 65 | 8 | 13 | | 65 |
| 6 | 31 | K2 | 0.4 | | | 15 | 25 | 2 | 6 | | 98 |
| 7 | 41 | K0 | 0.4 | | | 10 | 12 | 2.5 | 5 | | 98 |
| 8 | 41 | K1 | 0.4 | | | 10 | 12 | 3 | 5 | | 99 |
| 9 | 41 | K2 | 0.4 | | | 10 | 12 | 2.5 | 5 | | 98 |
| 10 | 41 | K3H | 0.4 | | | 10 | 0 | | | | |
| 11 | 41 | K4H | 0.4 | | | 10 | 60 | 7 | 13 | | 66 |
| 12 | 51 | K0 | 0.4 | | | 10 | 15 | 2.5 | 4.5 | | 98 |
| 13 | 51 | K1 | 0.4 | | | 10 | 12 | 2 | 5 | | 98 |
| 14 | 51 | K2 | 0.4 | | | 10 | 12 | 2 | 4.4 | | 98 |
| 15 | 51 | K3H | 0.4 | | | 10 | 0 | | | | |
| 16 | 51 | K4H | 0.4 | | | 10 | 65 | 8 | 12 | | 75 |
| 17 | 52 | K2 | 0.4 | | | 12 | 20 | 4 | 6.2 | | 97 |
| 18 | 53 | K2 | 0.4 | | | 8 | 15 | 2.5 | 5.2 | | 97 |
| 19 | 54 | K2 | 0.4 | | | 10 | 15 | 2.5 | 4.7 | | 98 |

25

TABLE 45

| Test No. | Alloy No. | Process | Tensile Strength N/mm$^2$ | Vickers Hardness HV | Elongation % | Bendability | Stress Relaxation Properties | Conductivity % IACS | Performance Index Is | Heat Resistance with respect to Heating at 700° C. for 100 seconds Vickers Hardness HV | Heat Resistance with respect to Heating at 700° C. for 100 seconds Recrystallization Ratio % | Heat Resistance with respect to Heating at 700° C. for 100 seconds Conductivity % IACS | 400° C. High-Temperature Tensile Strength N/mm$^2$ |
|---|---|---|---|---|---|---|---|---|---|---|---|---|---|
| 1 | 21 | K0 | 519 | 163 | 9 | A | A | 76 | 4932 | | | | |
| 2 | 21 | K1 | 517 | 162 | 10 | A | A | 77 | 4990 | | | | |
| 3 | 21 | K2 | 515 | 160 | 11 | A | A | 82 | 5177 | | | | |
| 4 | 21 | K3H | 525 | 165 | 4 | C | A | 73 | 4665 | | | | |
| 5 | 21 | K4H | 455 | 141 | 10 | A | C | 72 | 4247 | | | | |
| 6 | 31 | K2 | 565 | 173 | 10 | A | A | 64 | 4972 | | | | |
| 7 | 41 | K0 | 522 | 164 | 8 | A | A | 74 | 4939 | | | | |
| 8 | 41 | K1 | 525 | 163 | 10 | A | A | 75 | 5001 | | | | |
| 9 | 41 | K2 | 515 | 159 | 10 | A | A | 81 | 5099 | | | | |
| 10 | 41 | K3H | 533 | 167 | 4 | C | A | 71 | 4671 | | | | |
| 11 | 41 | K4H | 460 | 141 | 9 | A | C | 71 | 4225 | | | | |
| 12 | 51 | K0 | 527 | 163 | 8 | A | A | 77 | 4994 | | | | |
| 13 | 51 | K1 | 530 | 165 | 9 | A | A | 77 | 5069 | | | | |
| 14 | 51 | K2 | 532 | 164 | 9 | A | A | 82 | 5251 | | | | |
| 15 | 51 | K3H | 545 | 167 | 3 | C | A | 73 | 4796 | | | | |
| 16 | 51 | K4H | 470 | 142 | 8 | A | C | 73 | 4337 | | | | |
| 17 | 52 | K2 | 498 | 157 | 11 | A | A | 83 | 5036 | | | | |
| 18 | 53 | K2 | 518 | 162 | 10 | A | A | 79 | 5064 | | | | |
| 19 | 54 | K2 | 548 | 166 | 11 | A | A | 69 | 5053 | | | | |

In the processes K0 and K1, the precipitation heat treatment E4 is performed by an AP line after the cold rolling, and in the process K2, the precipitation heat treatment E2 is performed by a batch furnace after the cold rolling. All of the rolled sheets of the processes K0, K1 and K2 exhibit excellent mechanical properties. However, the rolled sheet of the process K2 is slightly better than those of the processes K0 and K1 in terms of conductivity and performance index. Even when the precipitation heat treatment is performed by using a continuous heat treatment line as described above, high conductivity, strength and performance index Is are obtained. This is supported from the fact that there is no significant difference between the grain diameter of precipitated grains obtained by this process and the grain diameter of precipitated grains obtained by a long-time heat treatment. In the processes K3H and K4H, the precipitation heat treatment E4 is performed by an AP line as in the processes K0 and K1. However, in the process K3H, a heat treatment index It2 of the second precipitation heat treatment is smaller than the range of the manufacturing condition and thus elongation and bendability are poor. In the process K4H, a heat treatment index It2 of the second precipitation heat treatment is larger than the range of the manufacturing condition and thus tensile strength, Vickers hardness and stress relaxation properties are poor.

Tables 46 and 47 show results of the rolled sheets obtained by the process M. In the process M, the precipitation heat treatment is performed by a continuous heat treatment line. Even when the precipitation heat treatment is performed by using a productive continuous heat treatment line, conductivity slightly deteriorates compared to a long-time batch-type heat treatment and a significant difference does not exist. In addition, high conductivity, strength and performance index Is are obtained. This is supported from the fact that a significant difference does not exist between the diameter of precipitated grains formed by this process and the diameter of precipitates grains formed by the batch system. In the process M2, the precipitation heat treatment is performed after the cold rolling, and thus, although the precipitated grains were not observed, after making a judgment on the characteristics, it is thought that precipitated grains having almost the same grain diameter as in the process M1 are precipitated.

elongation thereof are 28, 26, 27, 27, 30 and 29%. Despite the short-time precipitation heat treatment, they have high conductivity of 79, 63, 78, 79, 80 and 77% IACS and have a high value in performance index Is, that is, 5085, 4840, 4980, 5192, 5011 and 5087, respectively. From these results, it is thought that precipitates having the same diameter as in the process M1 are precipitated. In this manner, when electric and electronic components, home electric components and vehicle components such as sensors, relays and connectors, subjected to a forming process such as drawing or pressing, are subjected to a precipitation heat treatment after the forming, excellent high-electrical conductivity and

TABLE 46

| | | | | After Hot Rolling | | Grain Size After Solution Heat-Treating | Recrystallization After Precipitation Heat Treatment | | Precipitates After Precipitation Heat Treatment | | |
|---|---|---|---|---|---|---|---|---|---|---|---|
| Test No. | Alloy No. | Process | Final Sheet Thickness mm | Grain Size μm | Recrystallization Ratio % | Heat-Treating μm | Recrystallization Ratio % | Grain Size μm | Average Grain Diameter Nm | Ratio of Grains of 10 nm or less % | Ratio of Grains of 15 nm or less % |
| 1 | 21 | M1 | 0.4 | | | 12 | | | 2.9 | | 99 |
| 2 | 21 | M2 | 0.4 | | | 12 | | | | | |
| 3 | 31 | M1 | 0.4 | | | 20 | | | 3.2 | | 99 |
| 4 | 31 | M2 | 0.4 | | | 20 | | | | | |
| 5 | 41 | M1 | 0.4 | | | 15 | | | 2.9 | | 99 |
| 6 | 41 | M2 | 0.4 | | | 15 | | | | | |
| 7 | 51 | M1 | 0.4 | | | 10 | | | 3.2 | | 99 |
| 8 | 52 | M1 | 0.4 | | | 12 | | | 3.3 | | 98 |
| 9 | 53 | M2 | 0.4 | | | 12 | | | | | |
| 10 | 54 | M2 | 0.4 | | | 12 | | | | | |

TABLE 47

| | | | | | | | | | | Heat Resistance with respect to Heating at 700° C. for 100 seconds | | | 400° C. High-Temperature |
|---|---|---|---|---|---|---|---|---|---|---|---|---|---|
| Test No. | Alloy No. | Process | Tensile Strength N/mm$^2$ | Vickers Hardness HV | Elongation % | Bendability | Stress Relaxation Properties | Conductivity % IACS | Performance Index Is | Vickers Hardness HV | Recrystallization Ratio % | Conductivity % IACS | Tensile Strength N/mm$^2$ |
| 1 | 21 | M1 | 521 | 161 | 8 | A | A | 76 | 4905 | | | | |
| 2 | 21 | M2 | 509 | 157 | 9 | A | A | 75 | 4805 | | | | |
| 3 | 31 | M1 | 563 | 172 | 6 | A | A | 60 | 4623 | | | | |
| 4 | 31 | M2 | 550 | 171 | 7 | A | A | 59 | 4691 | | | | |
| 5 | 41 | M1 | 522 | 163 | 8 | A | A | 77 | 4947 | | | | |
| 6 | 41 | M2 | 515 | 160 | 8 | A | A | 75 | 4817 | | | | |
| 7 | 51 | M1 | 520 | 162 | 8 | A | A | 76 | 4896 | | | | |
| 8 | 52 | M1 | 500 | 157 | 7 | A | A | 77 | 4695 | | | | |
| 9 | 53 | M2 | 515 | 160 | 8 | A | A | 73 | 4752 | | | | |
| 10 | 54 | M2 | 536 | 164 | 8 | A | A | 64 | 4631 | | | | |

In addition, 0.9 mm-thick, solution heat-treated materials of the process M were used and subjected to drawing into a cup shape of 100 mm in length and 20 mm in diameter of the bottom portion thereof. A rate of decrease in the cross-section of the side was 10%. The drawn materials were subjected to a precipitation heat treatment at 565° C. for 5 minutes and subjected to a tensile test. Results of the alloy Nos. 21, 31, 41, 51, 52 and 53 are 447, 484, 444, 460, 431 and 445 N/mm$^2$, respectively. Vickers hardness of the deep-drawn side thereof are 138, 150, 136, 141, 134 and 137 and high-strength members are obtained. In the conventional precipitation type alloys, it is impossible that high electrical conductivity, strength and performance index Is are obtained by a short-time precipitation heat treatment as described above.

In addition, by using 0.9 mm-thick, solution heat-treated materials of the process M, a deep drawability test and an Erichsen test were performed and results thereof are shown in Table 48.

TABLE 48

| Test No. | Alloy No. | Process | Thick Sheet mm | Earing Rate % | Erichsen Value mm |
|---|---|---|---|---|---|
| 1 | 21 | Up to | 0.9 | 0.4 | 13.3 |
| 2 | 31 | Solution | 0.9 | 0.6 | 13.0 |
| 3 | 41 | Heat | 0.9 | 0.4 | 13.1 |
| 4 | 51 | Treatment | 0.9 | 0.4 | 13.2 |
| 5 | 52 | of Process M | 0.9 | 0.4 | 13.4 |
| 6 | 53 | | 0.9 | 0.5 | 13.1 |

In the deep drawability test, a blank diameter was 78 mm, and by using a punch which is 40 mm in diameter and which has a shoulder portion with a curvature of 8 mm, deep drawing into a cup shape (cylindrical shape with a bottom) was performed and an earing rate V(%) of the resulting processed product was obtained. The result thereof is shown in the table. Since a processed sheet is obtained by rolling, of course, directivity is generated in its properties. Accordingly, a so-called earing phenomenon is generated at the end edge of the opening of a product deep-drawn into a cup shape and thus the end edge of the opening has a corrugated shape, not linear shape (at the end edge of the opening, peaks and valleys are formed). The earing rate V is expressed by the percentage ($V=((W1-W2)/W0)\times 100$) of a difference between an average value W1 ($=(w1+w2+w3+w4)/4$) of heights w1, w2, w3 and w4 of the peaks (4 points) at the end edge of the opening having such a shape and an average value W2 ($=(w5+w6+w7+w8)/4$) of heights w5, w6, w7 and w8 of the valleys (4 points) with respect to an average value W0 ($=(w1+w2+w3+w4+w5+w6+w7+w8)/8$) of the heights. The height of the peak or the valley is a distance in an axial direction of the cup-shaped processed product from a reference plane (for example, the bottom of the processed product) to the peak or the valley. The earing rate V shows the directivity (anisotropy) of a processed sheet. For example, a high earing rate V indicates that strength/ductility at 0°, 45° and 90° are different.

When the earing rate V is larger than a certain value, a yield of deep-drawn material deteriorates and deep-drawing accuracy is lowered. Accordingly, the excellence of deep drawability can be judged by the earing rate V. In general, when the earing rate V is equal to or less than 1.0%, excellent deep drawing can be performed, and when the earing rate V is greater than 1.0%, it is difficult to obtain a deep-drawn product with high quality. As is obvious from the table, in all of the alloys of the examples, the earing rate V is equal to or less than 1.0% and it is understood that the alloys are excellent in required deep drawability.

The Erichsen test is widely employed as a method of examining bulging formability of metal. The invention alloy sheet was cut into a square shape of 90 mm×90 mm and supported on a ring-shaped base with a die having a diameter of 27 mm. Deformation was applied thereto by a spherical punch having a diameter of 20 mm and a deformation depth (mm) when cracking had occurred was measured. The result thereof is as shown in the table. The Erichsen test is performed to determine adequacy for the deep drawing by measuring the ductility of a sheet. The larger the measured value (deformation depth) is, the stricter bulging and deep drawing can be performed. All of the invention alloys exhibit a high value. As is obvious from the results of the deep drawability test and the Erichsen test, it is confirmed that the invention alloy has very excellent drawability such as deep-drawing. In this manner, when a solution heat-treated material is subjected to drawing, that is, when a solution heat-treated material is subjected to the precipitation heat treatment in addition to cold working which is the same as cold rolling, a high-strength and high-electrical conductivity product having a cup shape, for example, a sensor, connector or plug is completed. Herein, the present alloy is different from a conventional precipitation type copper alloy and the precipitation heat treatment can be performed for a short time. Accordingly, the present alloy is advantageous in heat treatment facilities or productivity in the heat treatment.

Tables 49 and 50 show results of the rolled sheets of Cr—Zr copper, obtained by the processes A5H, A8H, H1, H2 and H3. In the process A8H, the solution heat treatment was performed under the conditions of 950° C. and 1-hour holding time. The precipitation heat treatment of each process was performed under the conditions of 470° C. and 4-hour holding time.

TABLE 49

| | | | | After Hot Rolling | | Grain Size After Solution Heat-Treating | Recrystallization After Precipitation Heat Treatment | | Precipitates After Precipitation Heat Treatment | | |
|---|---|---|---|---|---|---|---|---|---|---|---|
| Test No. | Alloy No. | Process | Final Sheet Thickness mm | Grain Size μm | Recrystallization Ratio % | μm | Recrystallization Ratio % | Grain Size μm | Average Grain Diameter nm | Ratio of Grains of 10 nm or less % | Ratio of Grains of 15 nm or less % |
| 1 | 70 | A5H | 25 | 65 | 100 | | | | | | |
| 2 | 70 | A8H | 25 | | | 120 | | | | | |
| 3 | 70 | H1 | 0.4 | | | 25 | | | | | |
| 4 | 70 | H3 | 0.4 | | | 50 | | | | | |
| 5 | 70 | H3 | 0.4 | | | 80 | | | | | |

TABLE 50

| Test No. | Alloy No. | Process | Tensile Strength N/mm$^2$ | Vickers Hardness HV | Elongation | Bendability | Stress Relaxation Properties | Conductivity % IACS | Performance Index Is | Heat Resistance with respect to Heating at 700° C. for 100 seconds: Vickers Hardness HV | Recrystallization Ratio % | Conductivity % IACS | 400° C. High-Temperature Tensile Strength N/mm$^2$ |
|---|---|---|---|---|---|---|---|---|---|---|---|---|---|
| 1 | 70 | A5H | 325 | 94 | 36 | B | | 88 | 4146 | 74 | | 75 | 166 |
| 2 | 70 | A8H | 378 | 105 | 32 | B | | 84 | 4573 | 89 | | 75 | 233 |
| 3 | 70 | H1 | 418 | 127 | 8 | A | A | 84 | 4138 | | | | |
| 4 | 70 | H3 | 433 | 135 | 8 | B | A | 83 | 4260 | | | | |
| 5 | 70 | H3 | 447 | 138 | 6 | B | A | 82 | 4291 | | | | |

Cr—Zr copper is poor in tensile strength, Vickers hardness, elongation, bendability and performance index in all the processes.

The following results were obtained from the tests in the above-described processes. A rolled sheet of the alloy No. 61 in which the content of Co is smaller than the composition range of the invention alloy, the alloy No. 62 in which the content of P is small or the alloy No. 64 in which the balance between Co and P is poor has low strength, electrical conductivity, heat resistance and high-temperature strength and has poor stress relaxation properties. It is thought that this is because a precipitation amount is small and an element Co or P is excessively subjected to solid solution, or precipitates are different from the form prescribed in the invention.

In a rolled sheet of the alloy No. 63 or 68 in which the amount of Sn is smaller than the composition range of the invention alloy, the recrystallization of the matrix occurs more rapidly than the precipitation. Accordingly, a recrystallization ratio becomes higher and precipitated grains become larger. It is thought that, as a result, strength is low, a performance index is low, stress relaxation properties are poor and heat resistance is low.

In a rolled sheet of the alloy No. 67 in which the amount of Sn is larger than the composition range of the invention alloy, the recrystallization of the matrix occurs more rapidly than the precipitation. Accordingly, a recrystallization ratio becomes higher and precipitated grains become larger. It is thought that, as a result, conductivity is low, a performance index is low and stress relaxation properties are poor.

In a rolled sheet of the alloy No. 65 or 66 in which the amount of Fe and the amount of Ni are large and the relationship of $1.2\times[Ni]+2\times[Fe]>[Co]$ is satisfied, the form of precipitates is not a predetermined form of the invention. In addition, since elements not relating to the precipitation are excessively subjected to solid solution, the recrystallization of the matrix occurs more rapidly than the precipitation. Accordingly, a recrystallization ratio becomes higher and precipitated grains become larger. It is thought that, as a result, strength is low, a performance index is low, conductivity is rather low and stress relaxation properties are poor.

The higher the cooling rate after hot rolling is, and the higher the heating temperature of hot rolling is, the larger amount of Co, P and the like is subjected to solid solution and precipitates formed during the precipitation heat treatment become smaller. In this manner, high strength, performance index and heat resistance are observed.

When the cooling rate after hot rolling is low, precipitation occurs during the cooling after the hot rolling and thus the capacity to precipitate becomes smaller and precipitated grains also become larger. Similarly, when a hot rolling start temperature is low, Co, P and the like are not sufficiently subjected to solid solution and thus the capacity to precipitate becomes smaller. As a result, strength is low, a performance index is low and heat resistance is also low.

When a hot rolling temperature is too high, grains become larger and thus the bendability of a final sheet is poor.

The higher the temperature of the solution heat treatment in the thin sheet manufacturing process is, and the higher the cooling rate is, the more Co, P and the like are subjected to solid solution and the recrystallization of the matrix and the precipitation occur at the right timing during the precipitation heat treatment which is performed after cold rolling. As a result, a recrystallization ratio becomes lower and formed precipitates become smaller, and thus high strength and performance index and excellent stress relaxation properties are observed. However, when the temperature of the solution heat treatment is too high, grains become larger and thus the bendability of a final sheet is poor.

The lower the temperature of the solution heat treatment in the thin sheet manufacturing process is, and the lower the cooling rate is, the solid solution of Co, P and the like becomes less sufficient and the capacity to precipitate becomes smaller. Since the recrystallization of the matrix occurs more rapidly than the precipitation during the precipitation heat treatment of the post-process, precipitates become larger. As a result, strength is low, a performance index is low and stress relaxation properties are also poor.

When the temperature is higher than the upper limit of the proper temperature condition for the precipitation heat treatment, the recrystallization of the matrix proceeds. Accordingly, a recrystallization ratio becomes higher, so the precipitation is almost completed and thus electrical conductivity is excellent. However, precipitated grains become larger. As a result, strength is low, performance index is low and stress relaxation properties are poor.

When the temperature is lower than the lower limit of the proper temperature condition for the precipitation heat treatment, ductility of the matrix is not recovered and thus elongation and bendability thereof are poor. In addition, since the precipitation is insufficient, conductivity is also low and stress relaxation properties are poor. In addition, even when the precipitation heat treatment is performed for a short time, high electrical conductivity, high strength and excellent ductility are obtained.

In the above-described embodiments, a high-performance copper alloy rolled sheet was obtained in which precipitates are formed in the metal structure, the shape of the precipitates is substantially circular or elliptical on a two-dimensional observation plane, the precipitates are made to have an average grain diameter of 1.5 to 9.0 nm, or 90% or more of all the precipitates are made to have a diameter of 15 nm or less to be fine precipitates, and the precipitates are uniformly dispersed (see test Nos. 1 to 5 of Tables 6 and 7, test Nos. 1 to 7 of Tables 12 and 13, test Nos. 1 to 7 of Tables 16 and 17, test Nos. 1 to 7 of Tables 18 and 19, test Nos. 1 to 4 of Tables 40 and 41, test Nos. 2, 3, 7, 8, 12, 14, 15 and 16 of Tables 20 and 21, test Nos. 3 and 6 of Tables 22 and 23, test Nos. 2, 4 and 7 of Tables 42 and 43, test Nos. 2 and 8 of Tables 44 and 45). FIG. 3 shows metal structures after the precipitation heat treatment of the high-performance copper alloy rolled sheet of the test No. 1 of the Tables 6 and 7 and the test No. 1 of the Tables 12 and 13. In both of them, fine precipitates are uniformly distributed.

A high-performance copper alloy rolled sheet having a performance index Is of 4300 or greater was obtained (see test Nos. 1 to 5 of Tables 6 and 7, test Nos. 1 to 5 of Tables 10 and 11, test Nos. 1 to 7 of Tables 12 and 13, test Nos. 1 to 7 of Tables 16 and 17, test Nos. 1 to 7 of Tables 18 and 19, test Nos. 2, 3, 7, 8, 12, 14, 15 and 16 of Tables 20 and 21, test Nos. 3 and 6 of Tables 22 and 23, test Nos. 2, 3, 7 and 8 of Tables 30 and 31, test Nos. 2 and 4 of Tables 36 and 37, test Nos. 3, 6, 9 and 12 of Tables 38 and 39, test Nos. 1 to 4 of Tables 40 and 41, test Nos. 2, 4 and 7 of Tables 42 and 43, test Nos. 2 and 8 of Tables 44 and 45).

A high-performance copper alloy rolled sheet having tensile strength of more than 200 ($N/mm^2$) at 400° C. was obtained (see test Nos. 1 to 5 of Tables 6 and 7, test Nos. 1 to 5 of Tables 10 and 11, test Nos. 2, 3, 7, 8, 12, 14, 15 and 16 of Tables 20 and 21, test Nos. 3 and 6 of Tables 22 and 23, test Nos. 2, 3, 7 and 8 of Tables 30 and 32, test Nos. 2 and 4 of Tables 36 and 37).

A high-performance copper alloy rolled sheet of which Vickers hardness (HV) after heating at 700° C. for 100 seconds is equal to or greater than 90, or 80% or more of a value of Vickers hardness before the heating was obtained (see test Nos. 1 to 5 of Tables 6 and 7, test Nos. 1 to 5 of Tables 10 and 11, test Nos. 2, 3, 7, 8, 12, 14, 15 and 16 of Tables 20 and 21, test Nos. 3 and 6 of Tables 22 and 23, test Nos. 2, 3, 7 and 8 of Tables 30 and 31, test Nos. 2 and 4 of Tables 36 and 37).

The invention is not limited to the configurations of the above-described various embodiments and various modifications may be made without departing from the purpose of the invention. For example, machining or a heat treatment not affecting a metal structure may be performed in an arbitrary stage of the process.

INDUSTRIAL APPLICABILITY

As described above, a high-performance copper alloy rolled sheet according to the invention can be used for the following purposes.

Thick sheet: Members mainly requiring high electrical conductivity, high heat conductivity and high high-temperature strength: Mold (mold for continuous casting), backing plate (plate for supporting a sputtering target), heat sink for large-sized computer, photovoltaic generation, power module and fusion facilities, rocket, aircraft•rocket members requiring heat resistance and high electrical conductivity, and members for welding. Members mainly requiring high electrical conductivity, high heat conductivity, high strength at room temperature and high high-temperature strength: Heat sink (cooling for hybrid car, electrical vehicle and computer), heat spreader, power relay, bus bar, and high-current purpose material typified by hybrid.

Thin Sheet: Members requiring highly balanced strength and electrical conductivity and high heat conductivity: Various components for a vehicle, information instrument component, measurement instrument component, lighting equipment, issuance diode, household electrical appliance, heat exchanger, connector, terminal, connecting terminal, sensing member, drawn vehicle•electrical•electronic instrument, switch, relay, fuse, IC socket, wiring instrument, power transistor, battery terminal, contact volume, breaker, switch contact, power module member, heat sink, heat spreader, power relay, bus bar, and high-current purpose typified by hybrid and photovoltaic generation.

The invention claimed is:

1. A high-strength and high-electrical conductivity copper alloy rolled sheet that has an alloy composition comprising:

(a) 0.14 to 0.34 mass % of Co;

(b) 0.046 to 0.098 mass % of P;

(c) 0.005 to 0.095 mass % of Sn; and (d) the balance including Cu and inevitable impurities, wherein [Co] mass % representing a Co content and [P] mass % representing a P content satisfy a relationship of $3.0 \leq ([Co]-0.007)/([P]-0.009) \leq 5.9$, wherein the copper alloy rolled sheet includes precipitates and the precipitates are based on Co and P, wherein a range of a numerical expression $1.2\times[Ni]+2\times[Fe] \leq [Co]$ is satisfied even if the alloy composition includes Fe and Ni as the inevitable impurities, and wherein the shape of the precipitates is circular or elliptical on a two-dimensional observation plane, wherein the precipitates have an average grain diameter of 1.5 to 9.0 nm, or 90% or more of all the precipitates have a diameter of 15 nm or less so as to be fine precipitates, and the precipitates are uniformly dispersed in the alloy composition.

2. The high-strength and high-electrical conductivity copper alloy rolled sheet according to claim 1, wherein the alloy composition includes 0.16 to 0.33 mass % of Co, 0.051 to 0.096 mass % of P, and 0.005 to 0.045 mass % of Sn, and [Co] mass % representing a Co content and [P] mass % representing a P content satisfy the relationship of $3.2 \leq ([Co]-0.007)/([P]-0.009) \leq 4.9$.

3. The high-strength and high-electrical conductivity copper alloy rolled sheet according to claim 1, wherein the alloy composition includes 0.16 to 0.33 mass % of Co, 0.051 to 0.096 mass % of P and 0.005 to 0.095 mass % of Sn, and [Co] mass % representing a Co content and [P] mass % representing a P content satisfy the relationship of $3.2 \leq ([Co]-0.007)/([P]-0.009) \leq 4.9$.

4. The high-strength and high-electrical conductivity copper alloy rolled sheet according to claim 1, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr.

5. The high-strength and high-electrical conductivity copper alloy rolled sheet according to claim 1, wherein conductivity of the copper alloy rolled sheet is equal to or greater than 70% IACS, and a value of $(R^{1/2}\times S\times(100+L)/100)$ is equal to or greater than 4300, wherein conductivity is denoted by R in % IACS, tensile strength is denoted by S in$N/mm^2$, and elongation is denoted by L in %, wherein the copper alloy rolled sheet has uniform mechanical properties and electrical conductivity.

6. The high-strength and high-electrical conductivity copper alloy rolled sheet according to claim 1, manufactured by a manufacturing process including hot rolling, wherein a rolled material subjected to the hot rolling has an average grain size equal to or greater than 6 μm and equal to or less than 70 μm, or satisfies the relationship of $5.5\times(100/RE0)\leq D\leq 90\times(60/RE0)$, wherein a rolling ratio of the hot rolling is denoted by RE0(%) and a grain size after the hot rolling is denoted by D μm.

7. The high-strength and high-electrical conductivity copper alloy rolled sheet according to claim 1, wherein Vickers hardness after heating the copper alloy rolled sheet at 700° C. for 100 seconds is equal to or greater than 90, or 80% or more of a value of Vickers hardness before heating the copper alloy rolled sheet at 700° C. for 100 seconds.

8. The high-strength and high-electrical conductivity copper alloy rolled sheet according to claim 7, wherein tensile strength of the copper alloy composition at 400° C. is equal to or greater than 200 $N/mm^2$.

9. A method of manufacturing the high-strength and high-electrical conductivity copper alloy rolled sheet according to claim 1, the method comprising:

heating and hot-rolling an ingot at temperatures of 820° C. to 960° C.;

performing cooling in which an average cooling rate until the temperature of the rolled material subjected to the final pass of the hot rolling or the temperature of the rolled material goes down from 700° C. to 300° C. is 5° C./sec or greater; and performing a precipitation heat treatment which is performed at temperatures of 400° C. to 555° C. for 1 to 24 hours after the hot rolling and satisfies the relationship of $275\leq(T-100\times th^{-1/2}-110\times(1-RE/100)^{1/2})\leq 405$ where a heat treatment temperature is denoted by T(° C.), a holding period of time is denoted by th(h) and a rolling ratio of the cold rolling between the hot rolling and the precipitation heat treatment is denoted by RE(%).

10. A method of manufacturing the high-strength and high-electrical conductivity copper alloy rolled sheet according to claim 1, the method comprising:

subjecting a rolled material to a solution heat treatment in which the highest reached temperature is in the range of 820° C. to 960° C., a holding period of time from "the highest reached temperature −50° C." to the highest reached temperature is in the range of 2 to 180 seconds and the relationship of $90\leq(Tmax-800)\times ts^{1/2}\leq 630$ is satisfied where the highest reached temperature is denoted by Tmax(° C.) and a holding period of time is denoted by ts(s);

performing cooling in which an average cooling rate from 700° C. to 300° C. is 5° C./sec or greater after the solution heat treatment;

performing a precipitation heat treatment at temperatures of 400° C. to 555° C. for 1 to 24 hours which satisfies a relationship of $275\leq(T-100\times th^{-1/2}-110\times(1-RE/100)^{1/2}\leq 405$ where a heat treatment temperature is denoted by T(° C.), a holding period of time is denoted by th(h) and a rolling ratio of the cold rolling before the precipitation heat treatment is denoted by RE(%), or a precipitation heat treatment in which the highest reached temperature is in the range of 540° C. to 760° C., a holding period of time from "the highest reached temperature−50° C." to the highest reached temperature is in the range of 0.1 to 25 minutes and the relationship of $330\leq(Tmax-100\times tm^{-1/2}-100\times(1-RE/100)^{1/2})\leq 510$ is satisfied where a holding period of time is denoted by tm(min);

performing cold rolling after the final precipitation heat treatment; and performing a heat treatment in which the highest reached temperature is in the range of 200° C. to 560° C., a holding period of time from "the highest reached temperature −50° C." to the highest reached temperature is in the range of 0.03 to 300 minutes and the relationship of $150\leq(Tmax-60\times tm^{-1/2}-50\times(1-RE2/100)^{1/2})\leq 320$ is satisfied where a rolling ratio of the cold rolling is denoted by RE2.

11. The high-strength and high-electrical conductivity copper alloy rolled sheet according to claim 2, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg, and 0.001 to 0.1 mass % of Zr.

12. The high-strength and high-electrical conductivity copper alloy rolled sheet according to claim 3, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg, and 0.001 to 0.1 mass % of Zr.

13. A method of manufacturing the high-strength and high-electrical conductivity copper alloy rolled sheet according to claim 4, the method comprising:

heating and hot-rolling an ingot at temperatures of 820° C. to 960° C.;

performing cooling in which an average cooling rate until the temperature of the rolled material subjected to the final pass of the hot rolling or the temperature of the rolled material goes down from 700° C. to 300° C. is 5° C./sec or greater; and performing a precipitation heat treatment which is performed at temperatures of 400° C. to 555° C. for 1 to 24 hours after the hot rolling and satisfies the relationship of $275\leq(T-100\times th^{-1/2}-110\times(1-RE/100)^{1/2})\leq 405$ where a heat treatment temperature is denoted by T(° C.), a holding period of time is denoted by th(h) and a rolling ratio of the cold rolling between the hot rolling and the precipitation heat treatment is denoted by RE(%).

14. A method of manufacturing the high-strength and high-electrical conductivity copper alloy rolled sheet according to claim 4, the method comprising:

subjecting a rolled material to a solution heat treatment in which the highest reached temperature is in the range of 820° C. to 960° C., a holding period of time from "the highest reached temperature −50° C." to the highest reached temperature is in the range of 2 to 180 seconds and the relationship of $90\leq(Tmax-800)\times ts^{1/2}\leq 630$ is satisfied where the highest reached temperature is denoted by Tmax(° C.) and a holding period of time is denoted by ts(s);

performing cooling in which an average cooling rate from 700° C. to 300° C. is 5° C./sec or greater after the solution heat treatment;

performing a precipitation heat treatment at temperatures of 400° C. to 555° C. for 1 to 24 hours which satisfies a relationship of $275\leq(T-100\times th^{-1/2}-110\times(1-RE/100)^{1/2}\leq 405$ where a heat treatment temperature is denoted by T(° C.), a holding period of time is denoted by th(h) and a rolling ratio of the cold rolling before the precipitation heat treatment is denoted by RE(%), or a precipitation heat treatment in which the highest reached temperature is in the range of 540° C. to 760° C., a holding period of time from "the highest reached temperature−50° C." to the highest reached temperature is in the range of 0.1 to 25 minutes and the relationship of $330 \leq (Tmax - 100 \times tm^{-1/2} - 100 \times (1 - RE/100)^{1/2}) \leq 510$ is satisfied where a holding period of time is denoted by tm(min);

performing cold rolling after the final precipitation heat treatment; and performing a heat treatment in which the highest reached temperature is in the range of 200° C. to 560° C., a holding period of time from "the highest reached temperature −50° C." to the highest reached temperature is in the range of 0.03 to 300 minutes and the relationship of $150 \leq (Tmax - 60 \times tm^{-1/2} - 50 \times (1 - RE2/100)^{1/2}) \leq 320$ is satisfied where a rolling ratio of the cold rolling is denoted by RE2.

15. A high-strength and high-electrical conductivity copper alloy rolled sheet that has an alloy composition consisting of:

(a) 0.14 to 0.34 mass % of Co;

(b) 0.046 to 0.098 mass % of P;

(c) 0.005 to 0.095 mass % of Sn; and (d) the balance including Cu and inevitable impurities, wherein [Co] mass % representing a Co content and [P] mass % representing a P content satisfy a relationship of $3.0 \leq ([Co] - 0.007)/([P] - 0.009) \leq 5.9$, wherein the copper alloy rolled sheet includes precipitates and the precipitates are based on Co and P, wherein a range of a numerical expression $1.2 \times [Ni] + 2 \times [Fe] \leq [Co]$ is satisfied even if the alloy composition includes Fe and Ni as the inevitable impurities, and wherein the shape of the precipitates is circular or elliptical on a two-dimensional observation plane, wherein the precipitates have an average grain diameter of 1.5 to 9.0 nm, or 90% or more of all the precipitates have a diameter of 15 nm or less so as to be fine precipitates, and the precipitates are uniformly dispersed in the alloy composition.

16. The high-strength and high-electrical conductivity copper alloy rolled sheet according to claim 15, wherein the alloy composition includes 0.16 to 0.33 mass % of Co, 0.051 to 0.096 mass % of P, and 0.005 to 0.045 mass % of Sn, and [Co] mass % representing a Co content and [P] mass % representing a P content satisfy the relationship of $3.2 \leq ([Co] - 0.007)/([P] - 0.009) \leq 4.9$.

17. The high-strength and high-electrical conductivity copper alloy rolled sheet according to claim 15, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr.

18. The high-strength and high-electrical conductivity copper alloy rolled sheet according to claim 15, wherein conductivity of the copper alloy rolled sheet is equal to or greater than 70% IACS, and a value of $(R^{1/2} \times S \times (100 + L)/100)$ is equal to or greater than 4300, wherein conductivity is denoted by R in % IACS, tensile strength is denoted by S in $N/mm^2$, and elongation is denoted by L in %.

19. The high-strength and high-electrical conductivity copper alloy rolled sheet according to claim 15, manufactured by a manufacturing process including hot rolling, wherein a rolled material subjected to the hot rolling has an average grain size equal to or greater than 6 μm and equal to or less than 70 μm, or satisfies the relationship of $5.5 \times (100/RE0) \leq D \leq 90 \times (60/RE0)$, wherein a rolling ratio of the hot rolling is denoted by RE0(%) and a grain size after the hot rolling is denoted by D μm.

20. The high-strength and high-electrical conductivity copper alloy rolled sheet according to claim 19, wherein tensile strength of the copper alloy composition at 400° C. is equal to or greater than 200 $N/mm^2$.

21. The high-strength and high-electrical conductivity copper alloy rolled sheet according to claim 15, wherein Vickers hardness after heating the copper alloy rolled sheet at 700° C. for 100 seconds is equal to or greater than 90, or 80% or more of a value of Vickers hardness before heating the copper alloy rolled sheet at 700° C. for 100 seconds.

22. The high-strength and high-electrical conductivity copper alloy rolled sheet according to claim 16, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg, and 0.001 to 0.1 mass % of Zr.

23. The high-strength and high-electrical conductivity copper alloy rolled sheet according to claim 17, wherein the alloy composition further comprises at least one additional component selected from the group consisting of 0.002 to 0.2 mass % of Al, 0.002 to 0.6 mass % of Zn, 0.002 to 0.6 mass % of Ag, 0.002 to 0.2 mass % of Mg, and 0.001 to 0.1 mass % of Zr.

24. A high-strength and high-electrical conductivity copper alloy rolled sheet that has an alloy composition consisting of:

(a) 0.14 to 0.34 mass % of Co;

(b) 0.046 to 0.098 mass % of P;

(c) 0.005 to 0.095 mass % of Sn; and (d) the balance including Cu and inevitable impurities, wherein [Co] mass % representing a Co content and [P] mass % representing a P content satisfy the relationship of $3.0 \leq ([Co] - 0.007)/([P] - 0.009) \leq 5.9$, wherein the copper alloy rolled sheet includes precipitates and the precipitates are based on Co and P, wherein a range of a numerical expression $1.2 \times [Ni] + 2 \times [Fe] \leq [Co]$ is satisfied even if the alloy composition includes Fe and Ni as the inevitable impurities, and wherein the shape of the precipitates is circular or elliptical on a two-dimensional observation plane, wherein the precipitates have an average grain diameter of 1.5 to 9.0 nm, 90% or more of all the precipitates have a diameter of 15 nm or less so as to be fine precipitates, and the precipitates are uniformly dispersed in the alloy composition, and wherein tensile strength of the copper alloy composition at 400° C. is equal to or greater than 200 $N/mm^2$.

* * * * *